US010646059B1

(12) United States Patent
van der Walde

(10) Patent No.: US 10,646,059 B1
(45) Date of Patent: May 12, 2020

(54) SUSPENDED SEGMENTED DISPLAY ARRAY WITH LOW VISIBILITY HARDWARE

(71) Applicant: Keith van der Walde, San Diego, CA (US)

(72) Inventor: Keith van der Walde, San Diego, CA (US)

( * ) Notice: Subject to any disclaimer, the term of this patent is extended or adjusted under 35 U.S.C. 154(b) by 31 days.

(21) Appl. No.: 15/881,800

(22) Filed: Jan. 28, 2018

Related U.S. Application Data

(60) Provisional application No. 62/452,339, filed on Jan. 30, 2017, provisional application No. 62/451,721, filed on Jan. 28, 2017.

(51) Int. Cl.
*A47G 1/16* (2006.01)
*A47G 1/17* (2006.01)

(52) U.S. Cl.
CPC ..... *A47G 1/1686* (2013.01); *A47G 1/1606* (2013.01); *A47G 1/17* (2013.01)

(58) Field of Classification Search
CPC ..... A47G 1/1686; A47G 1/1606; A47G 1/17
See application file for complete search history.

(56) References Cited

U.S. PATENT DOCUMENTS 1,089,916 A 3/1914 Fisher
1,127,676 A 2/1915 Ramm
2,056,328 A * 10/1936 Price ..... E04B 2/7457 52/243
2,366,695 A 1/1945 Bisheff
3,853,226 A 1/1974 Hine
3,854,259 A * 12/1974 Lechene ..... E04B 1/6112 52/704
3,939,564 A * 2/1976 Slawinski, Sr. ..... B43L 13/16 33/1 K
4,064,644 A * 12/1977 Warner ..... A47G 1/0605 40/782
4,162,056 A * 7/1979 Moorhead ..... A47G 1/1633 248/495

(Continued)

FOREIGN PATENT DOCUMENTS

GB 1382905 A * 2/1975 ..... A47G 1/20

OTHER PUBLICATIONS

Art Trac cable suspension product by Griplock Systems, Inc of Carpentaria, CA. PDF of website portion included herein from Nov. 7, 2012. http://www.griplocksystems.com/artsuspension/detail.cfm?Art-Track&id=344&cat=8 http://www.griplocksystems.com/product_specsheets/ART-TRAC.PDF.

(Continued)

*Primary Examiner* — Ko H Chan

(57) ABSTRACT

Embodiments of the present disclosure relate to segmented display arrays, methods of assembling the same, and components thereof. In one embodiment, a segmented display array comprises wall-mounted first and second standoff members, each standoff member having a wall attachment base and first and second standoff arms extending therefrom. The segmented display array embodiment further comprises a first elongated member segment coupled to each of the first and second standoff members via the associated standoff arms, a second elongated member segment coupled to each of the first and second standoff members via the associated standoff arms, and display panels coupled to each of the first and second elongated member segments.

29 Claims, 62 Drawing Sheets

(56) References Cited

U.S. PATENT DOCUMENTS

| | | | | |
|---|---|---|---|---|
| 4,192,602 | A | 3/1980 | Lamoreaux | |
| 4,497,125 | A | 2/1985 | Hutchinson | |
| 4,561,617 | A * | 12/1985 | Hafner | A47F 5/04 248/121 |
| 4,577,444 | A | 3/1986 | Sanderson | |
| 4,712,761 | A * | 12/1987 | Wassell | A47G 1/1606 248/220.1 |
| 4,897,944 | A | 2/1990 | Otake | |
| 5,042,766 | A * | 8/1991 | Baker | F16M 13/025 248/200.1 |
| 5,090,145 | A | 2/1992 | Chiang | |
| 5,094,421 | A * | 3/1992 | Zaccone | A47G 1/1653 248/220.1 |
| 5,179,796 | A * | 1/1993 | Gephart, Jr. | G09F 19/02 40/473 |
| 5,181,335 | A * | 1/1993 | Todd | G09F 7/18 248/125.1 |
| 5,342,014 | A | 8/1994 | Wilson | |
| 6,015,123 | A * | 1/2000 | Perez | F16M 13/02 248/201 |
| 6,212,810 | B1 * | 4/2001 | Jones | G09F 15/0037 160/135 |
| 6,256,109 | B1 | 7/2001 | Rosenbaum | |
| 6,659,418 | B2 * | 12/2003 | Lemire | A47G 1/0655 248/476 |
| 6,820,853 | B1 | 11/2004 | DuBarry | |
| 7,086,190 | B2 | 8/2006 | Voluckas | |
| 7,086,546 | B2 * | 8/2006 | Meier | A47F 7/30 211/183 |
| 7,841,115 | B2 | 11/2010 | Saunders-Singer | |
| 7,934,331 | B2 | 5/2011 | Zlotocha | |
| 8,215,042 | B1 * | 7/2012 | Kilmer | A47G 1/1653 248/220.1 |
| 8,371,543 | B2 * | 2/2013 | Schneider | A47G 1/1606 248/224.8 |
| 9,311,836 | B1 | 4/2016 | van der Walde | |
| 9,723,732 | B2 | 8/2017 | van der Walde | |
| 9,993,678 | B2 * | 6/2018 | Hopperstad | A63B 21/078 |
| 10,087,639 | B1 * | 10/2018 | Simonsen | E04F 13/0875 |
| 2004/0026593 | A1 | 2/2004 | Fay | |
| 2005/0001136 | A1 | 1/2005 | Fleishman | |
| 2005/0155268 | A1 | 7/2005 | Engelhardt | |
| 2005/0193610 | A1 | 9/2005 | Rost | |
| 2006/0201039 | A1 | 9/2006 | Gilliland | |
| 2008/0276510 | A1 | 11/2008 | Harris | |
| 2009/0139127 | A1 | 6/2009 | Southard | |
| 2011/0101187 | A1 | 5/2011 | Shaha | |
| 2011/0113661 | A1 | 5/2011 | Pemberton | |
| 2012/0198788 | A1 * | 8/2012 | MacDonald | E04F 13/0825 52/747.1 |
| 2013/0269229 | A1 | 10/2013 | Rodriguez-Aparicio, Sr. | |
| 2014/0053472 | A1 * | 2/2014 | DeLorean | A47B 81/00 52/29 |
| 2018/0326250 | A1 * | 11/2018 | Henniger | A63B 21/068 |

OTHER PUBLICATIONS

Wall mounted sign system by Griplock Systems, Inc of Carpentaria, CA. Links provided; last visited Nov. 7, 2012. PDF printout of website content submitted herein http://www.griplocksystems.com/guidelines/Wall-Mounted%202-Cable%20Signage%20w.%20Stand-Off%20Mounts%20&%20Anchor%20Plates..PDF http://www.griplocksystems.com/product_specsheets/DG-25-SOM-SAT.PDF.

IXXI Company product; links provided below; last visited Nov. 7, 2012. PDF printout of website content submitted herein. http://www.ixxidesign.com http://www.ixxidesign.com/en/categorien/3-ixxi-tools.html.

Modern Mural, LLC as seen at www.modernmural.com. PDF printout of sample from website 2011 submitted herein.

Discount Displays (UK); pdf printout of website content submitted herein; visited 2012 , links included: http://www.discountdisplays.co.uk http://www.discountdisplays.co.uk/html/display-cable-system-window-cable-display-system.html.

* cited by examiner

SUSPENDED SEGMENTED DISPLAY ARRAY WITH LOW VISIBILITY HARDWARE

REFERENCE TO RELATED APPLICATIONS

This application claims the benefit of priority under 35 U.S.C.§ 119(e) to U.S. Provisional Patent Application No. 62/451,721 filed on Jan. 28, 2017 by the present inventor, which is herein incorporated by reference. This application also claims the benefit of priority under 35 U.S.C.§ 119(e) to U.S. Provisional Patent Application No. 62/452,339 filed on Jan. 30, 2017 by the present inventor, which is herein incorporated by reference.

TECHNICAL FIELD

The present disclosure relates to systems for displaying art, and, more particularly, to systems for displaying decorative panels adjacent to building surfaces.

BACKGROUND

Positioning display elements in an array allows for the presentation of information and, in the context of ornate display elements, makes for visually expressive decoration which can take on many creative forms. Large-scale installations of such display arrays, however, can be difficult to install, costly, cumbersome when changing out the display panels, and the supporting hardware can be overly visually prominent.

SUMMARY

Described herein are embodiments of segmented display arrays, methods of assembling the same, and components thereof. These embodiments of segmented display arrays use elongated member segments (e.g., cables, cords, rope, wire, etc.) that may be routed to substantially lie within a plane. Display panels, such as mounted photos or graphics, are coupled to the elongated member segments using retention members. Standoff members, which are attached to a wall or other building surface, serve to secure these elongated member segments in position and offset the elongated member segments and associated display panels from the wall. In some embodiments, two elongated member segments are generally associated with each display panel, and two or more retention members are used to establish the coupling between the elongated member segments and each display panel. Such a segmented display array allows for highly versatile usage, where a broad range of display panel types and sizes can be used for a given hardware installation. For example, mounted art prints can be secured to this system, as can translucent acrylic sheets, or elements of a collage of varying sizes. Also, display panel change-out is well facilitated.

Embodiments herein provide simple and effective elongated member segment coupling wherein the elongated member segments are positioned on the standoff members near the outermost regions of the arms of the standoff members (referred to as "standoff arms"), minimizing hardware interference issues with respect to the display panels that attach to the elongated member segments in close proximity to the standoff members. The standoff member embodiments themselves are strong, inexpensive, and simple to install. Some standoff member embodiments do not necessitate pronounced localized bending of the associated elongated member segments (elongated member segment bending can be undesirable for some types of elongated member segments which may form kinks when bent under load). Moreover, some embodiments presented herein allow for the capture of elongated member segments from the side, as opposed to requiring that elongated member segments be thread through small apertures. The elongated member segments, as a result, can have large hardware elements affixed thereto (to facilitate, for example, display panel attachment).

Embodiments presented herein have additional advantages. For example, in accordance with one embodiment, a standoff member comprises a thin and lightweight unitary sheet of material that is formed into its final shape. Here, a wall attachment base lies flush with the wall and receives anchors for wall mounting, while generally planar standoff arms are disposed on each end of this base and interface with elongated member segments such that the load is applied along the edge of the standoff arms and the load is directed in-plane with respect to the standoff arms. This results in maximal standoff arm stiffness and strength, and minimal out-of-plane standoff arm bending and/or twisting. Thus such embodiments of standoff members can be made of lightweight materials yet can support relatively heavy loads. Some embodiments incorporate tapering of the standoff arms, further optimizing material usage therefore minimizing weight. A lightweight standoff is desirable for ease of handling and transport, as well as to facilitate easier initial positioning of the standoff on the wall during installation. Unitary construction of the standoff member further makes for lower manufacturing cost.

Compared to some of the previous segmented display assemblies which require four standoff members be used to support a single column of display panels (i.e. one pair of opposing standoff members per elongated member segment, with two such sets required per column of display panels), a lower component count is achieved with embodiments of the present disclosure where a single standoff member may provide coupling to two or more elongated member segments. Moreover, the present embodiments achieve a fixed offset distance between elongated member segments, thus ensuring elongated member segment alignment with pre-positioned retention members on the display panels. Further, some embodiments herein provide multiple apertures in the wall attachment base to allow for the selection of wall anchoring locations of greatest convenience. The apertures themselves may be slots, which may have their long dimension horizontal, allowing fine adjustment of standoff member location when the anchors are in place preceding final tightening. Further, some embodiments presented herein include standoff members having wall attachment bases with straight horizontal edges that readily facilitate alignment with a template or carpenter's level during installation, ensuring installation accuracy.

The embodiments of the present disclosure are further advantageous as they provide a simple and effective elongated member segment tensioning assembly that is maintenance free, does not require adjustment (as do some turnbuckles used in some previous assemblies), and is not visually prominent. Some standoff member embodiments of the present disclosure result in a small visual "footprint" when the associated surrounding display panels are installed, allowing for a large range of viewing angles of the display panels in which the standoff member embodiments cannot be seen. This can be highly relevant for embodiments of segmented display arrays, given there can be visually prominent gaps between adjacent display panels in which a viewer of the display array may not wish to see supporting hardware.

This summary is provided to introduce a selection of concepts in a simplified form that, along with additional concepts, are described in further detail in the detailed description and drawings contained herein. This summary is not intended to identify key features or essential features of the claimed subject matter, nor is it intended to be used as an aid in determining the scope of the claimed subject matter. Yet other concepts, forms, embodiments, advantages, benefits, features, and aspects of the present invention will become apparent from the detailed description and drawings contained herein, as well as from the claims.

BRIEF DESCRIPTION OF THE DRAWINGS

The present disclosure is illustrated by way of example, and not by way of limitation, in the figures of the accompanying drawings.

FIG. 12E Top view of magnet carrier, showing retaining pin and base.

FIG. 12F Side view of magnet carrier, showing passage for elongated member segment.

FIG. 12G Front perspective view of dual magnet coupling system with panel.

FIG. 12H Pre-mate-up perspective view of dual magnet coupling system with panel.

FIG. 12I Post-mate-up perspective view of dual magnet coupling system with panel.

FIG. 12J Close-up of dual magnet mate-up in FIG. 12I.

FIG. 12K Rear view of panel and mated-up magnet sets.

DETAILED DESCRIPTION

Introductory Remarks

Figure 1A:
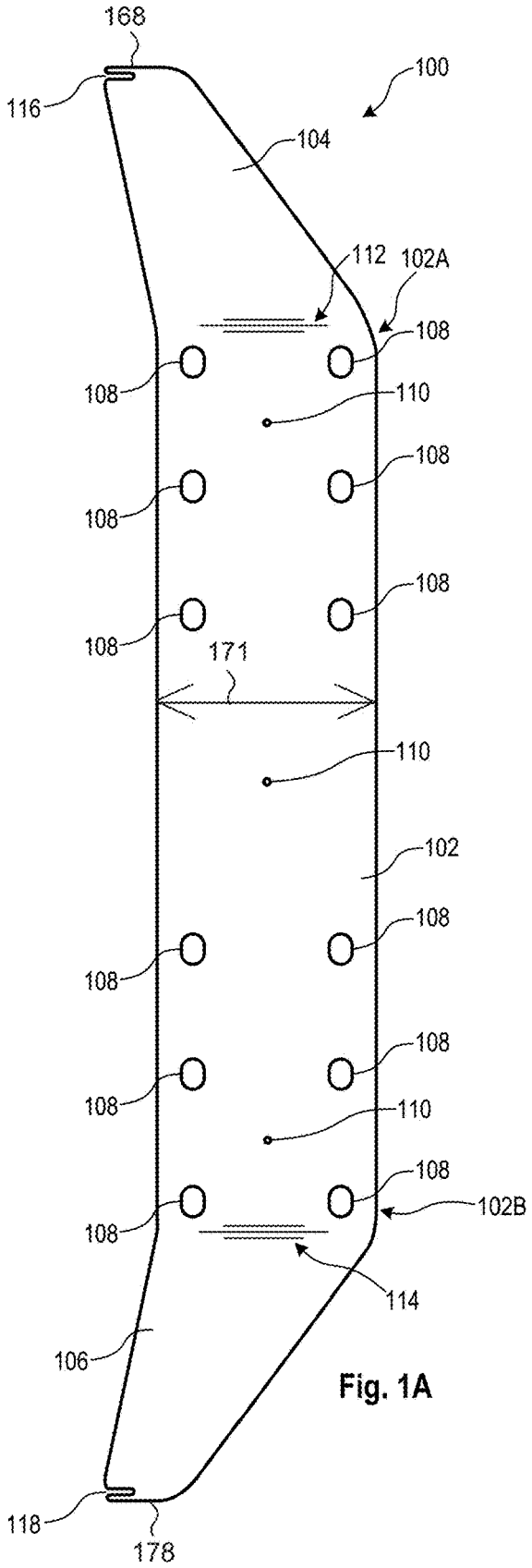
FIG. 1A is a front view of a first embodiment of a standoff member.

For the purposes of promoting and understanding the principles of the present disclosure, reference will now be made to the embodiments illustrated in the drawings and specific language will be used to describe the same. It will nevertheless be understood that no limitation of the scope of these embodiments is thereby intended. Alterations and further modification in the described embodiments, and further applications of the principles of the embodiments as described herein are contemplated as would normally occur to one skilled in the art to which the disclosure relates.

In the following description, numerous specific details are set forth, such as specific materials, dimensions, etc., to provide a thorough understanding of the embodiments of the present disclosure. The particular features, structures, materials, or characteristics may be combined in any suitable manner in one or more embodiments. The words "example" or "exemplary" are used herein to mean serving as an example, instance, or illustration. Any aspect or design described herein as "example" or "exemplary" is not necessarily to be construed as preferred or advantageous over other aspects or designs. Rather, use of the words "example" or "exemplary" is intended to present concepts in a concrete fashion.

As used herein, the terms "comprises," "comprising," "includes," "including,", "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, as used in this application, the term "or" is intended to mean an inclusive "or" rather than an exclusive "or". That is, unless specified otherwise, or clear from context, "X includes A or B" is intended to mean any of the natural inclusive permutations. That is, if X includes A; X includes B; or X includes both A and B, then "X includes A or B" is satisfied under any of the foregoing instances. In addition, the articles "a" and "an" as used in this application and the appended claims should generally be construed to mean "one or more" unless specified otherwise or clear from context to be directed to a singular form.

Reference throughout this specification to "an embodiment", "certain embodiments", or "one embodiment" means that a particular feature, structure, or characteristic described in connection with the embodiment is included in at least one embodiment. Thus, the appearances of the phrase "an embodiment", "certain embodiments", or "one embodiment" in various places throughout this specification are not necessarily all referring to the same embodiment. Furthermore, the particular features, structures, or characteristics may be combined in any suitable manner in one or more embodiments.

Subsection titles are used throughout the present Detailed Description section. These are not intended to define, describe, or limit the scope of the associated content, but rather simply seek to enhance document readability.

The terms "suspended segmented display array" or "segmented display array" are herein used throughout. In this context, consistent with the teachings of the present specification, "segmented" is understood to be two or more parts that collectively form a whole, and not necessarily an original whole that is broken into parts. Further, the term "array" is understood to be in reference to an arrangement of elements that might be regular (i.e., with uniform rows and columns), irregular (i.e., with no observable organization), or a mix of regular and irregular.

As used herein, the terms "elongated member segment(s)" or "elongated member" are understood to refer to cable, cord, thread, rope, string, wire, monofilament, tubing, bars, rod, wire rope, and other such elements. As used herein, the term "standoff member(s)" refers to any component that is mountable to a surface and offsets other components coupled to the standoff member (e.g., via "standoff arms" of the standoff member) away from the surface. The standoff members described herein offset the elongated member segments, and therefore the display panels, from the wall, creating the appearance that the display panels are "floating" and not directly attached to the wall.

Throughout the present disclosure, the term "display panel(s)" is used and typically shown as a characteristically two-dimensional part. This is, however, understood to represent a great many possibilities. By way of non-limiting example, display panels can be: prints on paper, mounted prints, graphics, signage, ads, fabric, translucent plastic, relief cut material, lit material, painted images, acoustic material, metal, wood, glass, acrylic, stretch canvas, artwork of all types, shadow boxes, whiteboards, flat screen digital displays, video panels, and three-dimensional/sculptural art of all sorts. Display panels can further be overlapping and amorphous in form. Also, any combination of these exemplary elements can be used simultaneously.

As used herein, a "wall" refers to a generally planar, generally vertical, interior or exterior building surface.

Standoff Embodiments & Materials Thereof

Figure 1B:
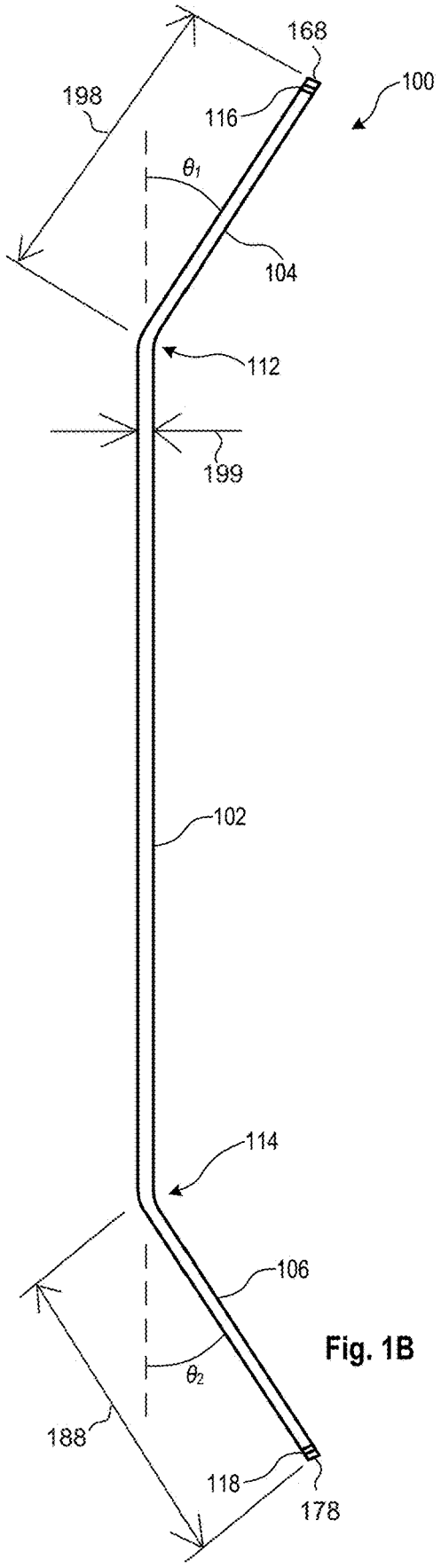
FIG. 1B is a top view of the first embodiment of the standoff member.

FIGS. 1A and 1B are front and top views, respectively, of an embodiment of a standoff member 100. The standoff member 100 comprises a wall attachment base 102, a first standoff arm 104, and a second standoff arm 106. In some embodiments, the wall attachment base 102 is rectangular in shape, with the first standoff arm 104 and the second standoff arm 106 being disposed at a first end 102A and a second end 102B, respectively, of the wall attachment base 102. In other embodiments, the wall attachment base 102 may take on different shapes, such as being square or having curved edges. The wall attachment base 102 has thickness 199 and width 171 (which will be the vertical dimension of the wall attachment base 102 when the standoff member 100 is in its wall-mounted position).

The wall attachment base 102 may include a plurality of apertures 108 formed therethrough to allow the passage of anchors, which can be used to mount the wall attachment base 102 to a wall. These apertures 108 may be slots, as illustrated. In some embodiments, the wall attachment base 102 may not include the plurality of apertures 108 and the wall attachment base 102 may be mounted to the wall using a different mounting mechanism. For example, the wall attachment base 102 may be mounted to the wall using an adhesive material attached to an opposite side of the wall attachment base 102 or any other suitable attachment mechanism as would be appreciated by one of ordinary skill in the art. In some embodiments, one or more portions of the wall attachment base 102 are planar. In other embodiments, the wall attachment base 102 is non-planar.

The first standoff arm 104 and the second standoff arm 106 may be planar or non-planar, in portions or throughout. FIGS. 1A and 1B illustrate the first standoff arm 104 and the second standoff arm 106 as being planar. For example, the first standoff arm 104 is oriented at an angle of $\theta_1$ with respect to the wall attachment base 102 at a joint 112 which is where the first standoff arm 104 couples to the wall attachment base 102. Similarly, the second standoff arm 106 is oriented at an angle of $\theta_2$ with respect to the wall attachment base 102 at a joint 114 which is correspondingly where the second standoff arm 106 couples to the wall attachment base 102. When the standoff member is in its installed state, these angles are in relation to the wall, and therefore are also meaningful for non-planar wall attachment base embodiments. In some embodiments, $\theta_1$ and $\theta_2$ may each range from 5° to 170°, 25° to 65°, 35° to 55° (e.g., 45°). In some embodiments, $\theta_1$ and $\theta_2$ are the same and in other embodiments they may be different. The first standoff arm 104 and the second standoff arm 106 may each have a slot 116 and a slot 118, respectively, formed therein, which may be used to couple to elongated member segments, as will be described in greater detail below. The first standoff arm 104 has length 198; the second standoff arm 106 has length 188.

Figure 2A:
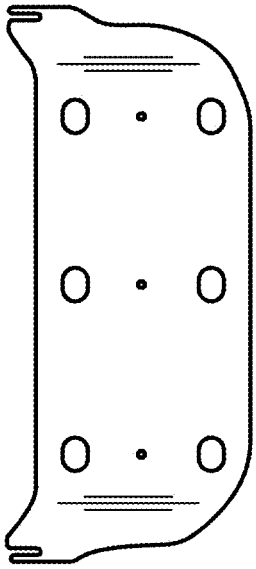
FIG. 2A is a front view of a second embodiment of a standoff member.
Figure 2B:
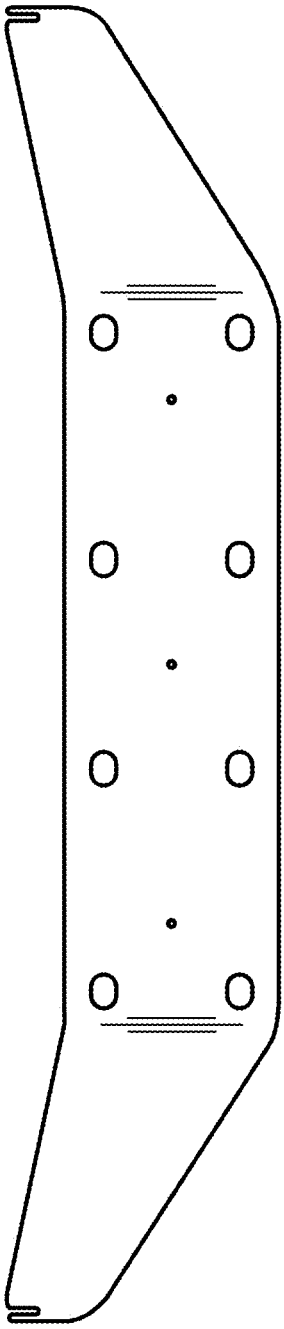
FIG. 2B is a front view of a third embodiment of a standoff member.
Figure 2C:
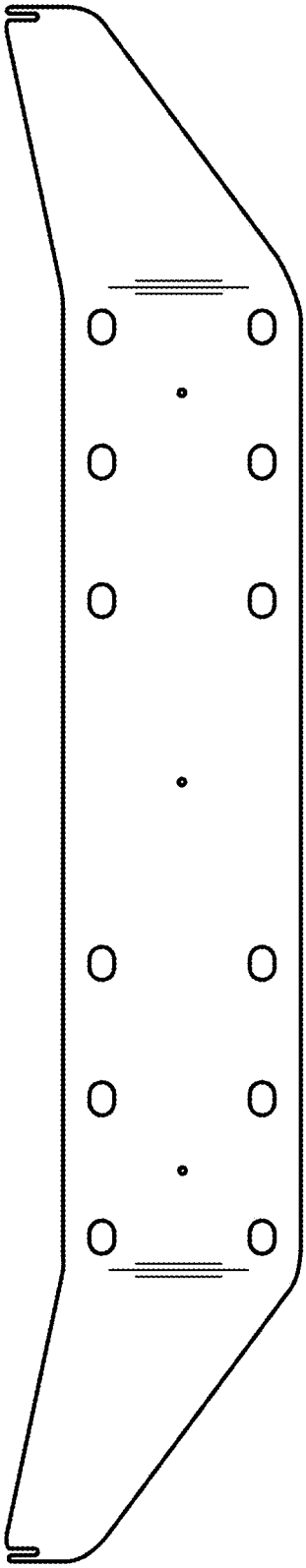
FIG. 2C is a front view of a fourth embodiment of a standoff member.

FIGS. 2A-2C show front views of various embodiments of a standoff member for comparative purposes, which are similar in structure to the standoff member 100 of FIGS. 1A and 1B. The dimensions of a standoff member may be selected based on the specific sizes of display panels to be accommodated, and other such considerations.

Returning attention to FIGS. 1A and 1B, it is noted that in some embodiments, the standoff member 100 may be formed from a single unitary piece of material, such as an aluminum sheet. The standoff member 100, for example, may first be cut from the single unitary piece of material, and the first standoff arm 104 and the second standoff arm 106 may be angularly oriented, as shown in FIG. 1B, by mechanical deformation at the respective joints 112, 114. Other sheet material known in the art may be used for this purpose as well, including transparent plastic sheet material. Such a part may also be molded or made by a host of different processes.

Figure 2D:
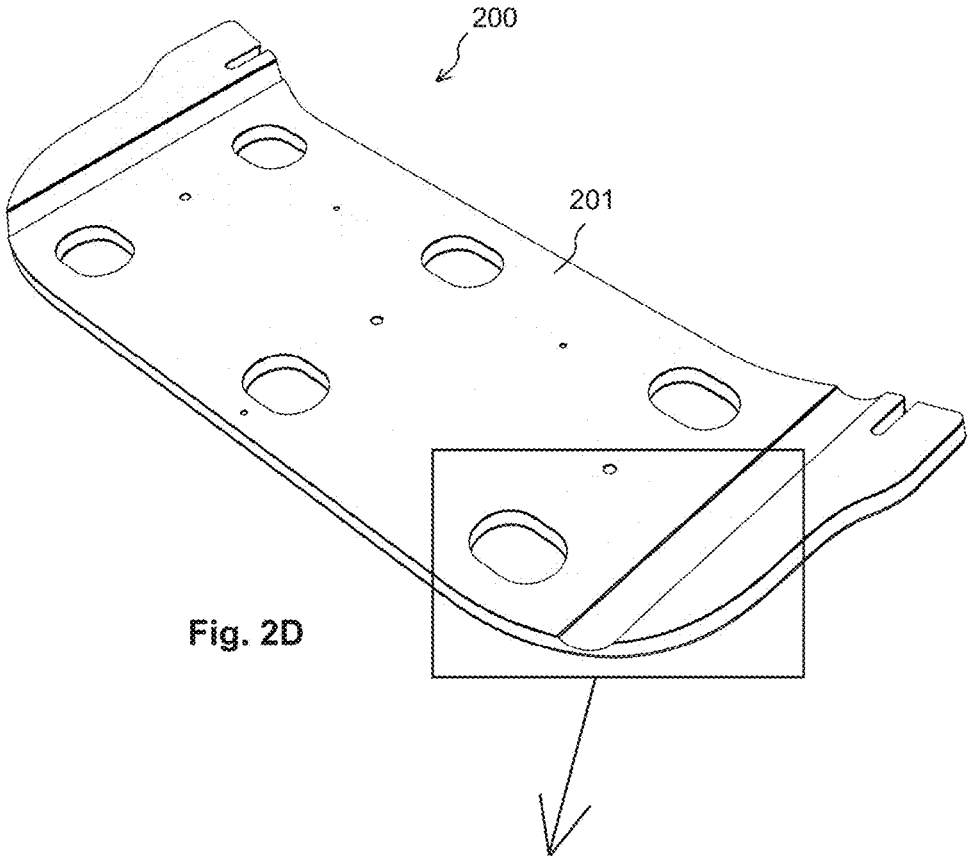
FIG. 2D is a perspective view of a fifth embodiment of a standoff member.
Figure 2E:
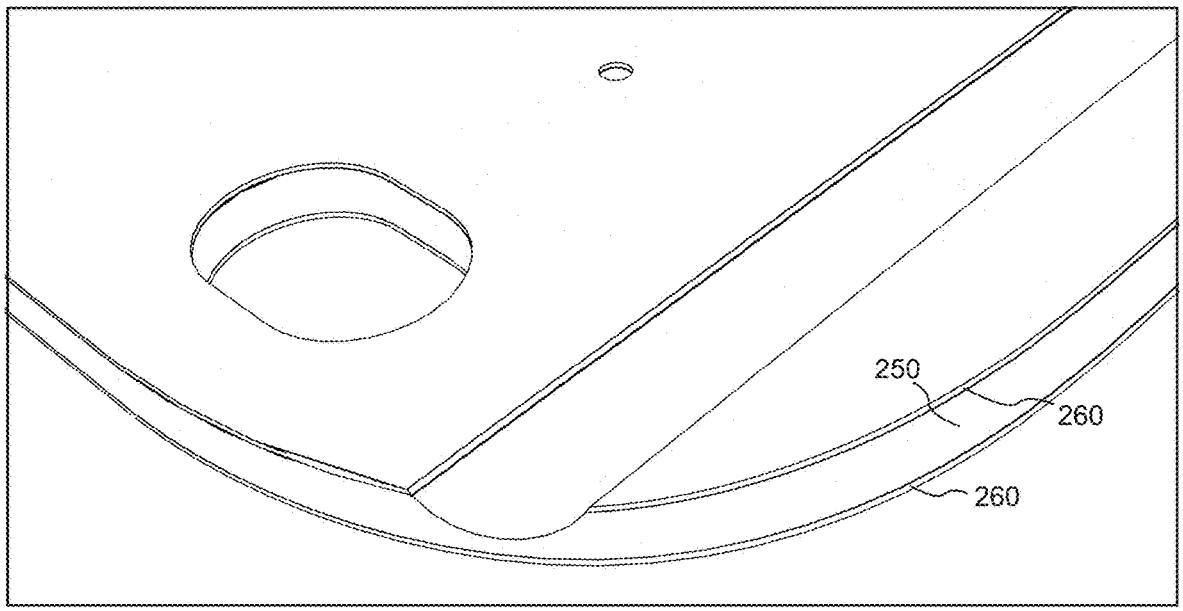
FIG. 2E is a close up view of the fifth embodiment of a standoff member.

FIGS. 2D and 2E show a perspective view of an embodiment of a standoff member 200 similar in structure to the standoff member shown in FIG. 2A. In this embodiment, the standoff member 200 is comprised of a multilayered sheet material 201 having, for present illustrative purposes, a flexible polymer as an innermost layer 250, and two outermost layers 260 comprising a metal. By way of non-limiting example, a suitable multilayered sheet material that is commercially available is ⅛" thick Aluminum Composite Material (ACM), wherein polyethylene makes up the innermost layer, and aluminum makes up the two outermost layers. Dibond® brand ACM by 3A Composites Inc, of Davidson N.C. is a specific example of such a multilayered sheet material readily adapted for embodiments of the present disclosure. Standoff member embodiments presented herein may be made from multiple materials (joined, fastened, adhered, bonded, or welded together), single unitary sheet material, multilayered sheet material, and/or any combination thereof.

In some embodiments, the first standoff member 100 may be formed from a dual-layer sheet material (e.g., metal on metal, plastic on plastic, plastic on metal, or other material combinations). Suitable plastic materials for the various embodiments may include polyethylene, polypropylene, other plastic materials, and combinations thereof. Suitable metals for the various embodiments may include aluminum, copper, stainless steel, magnetic materials (e.g., for mounting to a metal wall via magnetic coupling), or other plastic materials, and combinations thereof. In other embodiments, one or more of first standoff arm 104 or the second standoff arm 106 may be formed from separate sheets of material (and/or of different compositions), and may, for example, be attached to the wall attachment base 102 via adhesives, welding, mechanical coupling, or any other suitable attachment mechanism as would be appreciated by one of ordinary skill in the art.

Standoff Arms & Elongated Member Segment Coupling Thereto

Figure 3A:
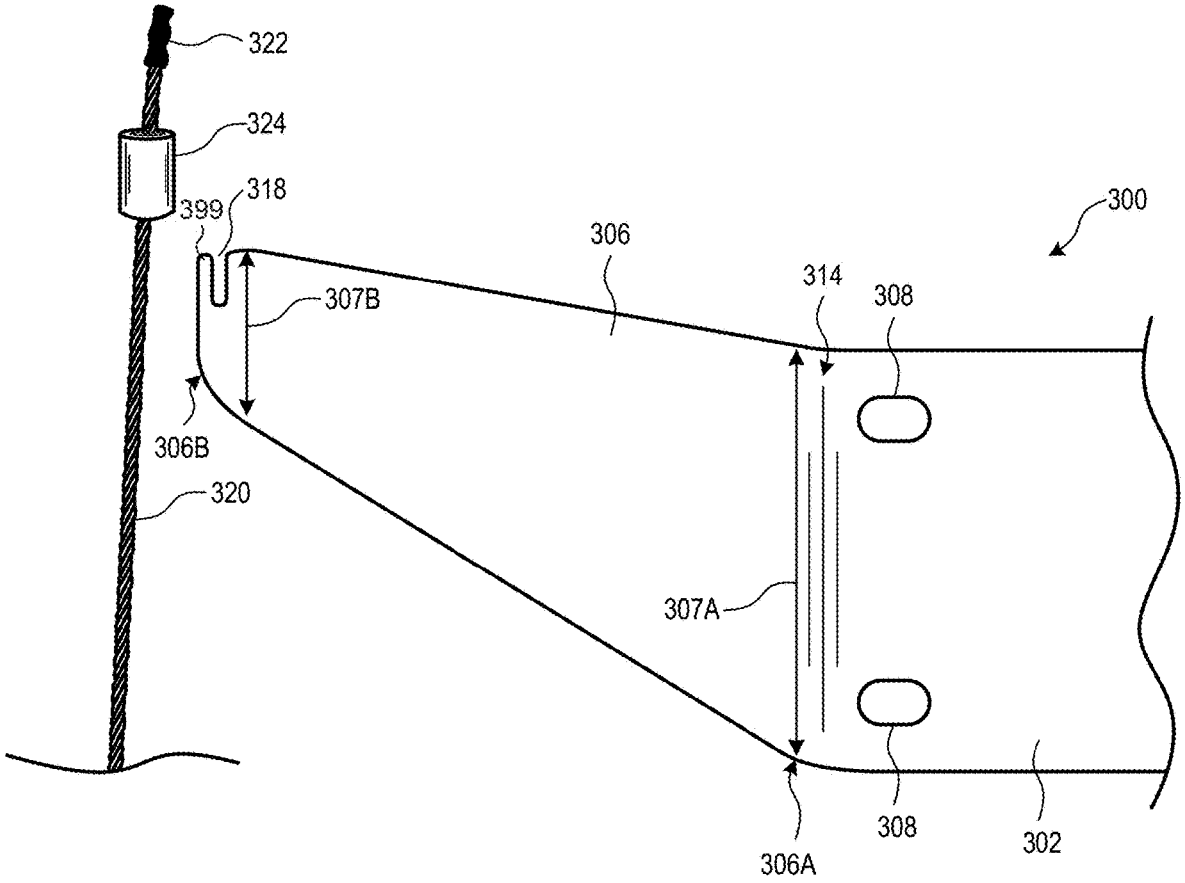
FIG. 3A is a front view of an embodiment of a standoff arm illustrating its coupling to an embodiment of an elongated member segment.

FIG. 3A illustrates coupling of an elongated member segment 320 to a standoff arm 306 of a standoff member 300. Each of the components of the standoff member 300 may be the same as, or similar to, their identically named counterparts of FIGS. 1A and 1B. The standoff member 300 includes a wall attachment base 302 with the standoff arm 306 coupled thereto at an end of the wall attachment base 302 at a joint 314. The wall attachment base 302 includes a plurality of apertures 308 for coupling the standoff member 300 to a wall. In some embodiments, as illustrated, these apertures 308 are slots. By departing from circularity and taking on this form, these slotted apertures 308 afford the standoff member 300 greater positional adjustability with respect to the wall in the direction in which the apertures 308 are slotted (i.e. elongated), which is in the horizontal sense in the embodiment shown in FIG. 3A. Additionally, in some embodiments, as illustrated, the standoff arm 306 is tapered from a proximal end 306A (i.e. an end coupled to the wall attachment base 302) to a distal end 306B (i.e. the standoff arm's 306 other end) such that a width 307A of the standoff arm 306 at the proximal end 306A is greater than a width 307B of the standoff arm 306 at the distal end 306B. In other embodiments, the width 307A is the same as the width 307B. In some embodiments, at least a portion of the standoff arm 306 is planar.

The elongated member segment 320 may be, for example, a braided wire cable. While a wide range of types and sizes can be used for this purpose, it has been found that 3/64" diameter 302/304 stainless steel wire rope braided in a 7×7 configuration works well. Other components may be used as well, including rope, string, cord, monofilament, tubing, bars, and rods. As illustrated, the elongated member segment 320 includes a terminal 322 at one of its ends, which has a diameter greater than that of the elongated member segment 320. The terminal 322 may be formed, for example, from solidified glue, epoxy, or resin; it may be an adhesive, a tape, a wrapped plastic, a heat shrink plastic, or other suitable material. The terminal may further be a crushed piece of metal, a crimped sleeve, a metal or foil strip wrapped around the elongated member segment 320, a melted or welded metal, or a clip or mechanical clamp. Many other materials and components known in the art can be used to serve the purpose of the terminal 322.

Figure 3B:
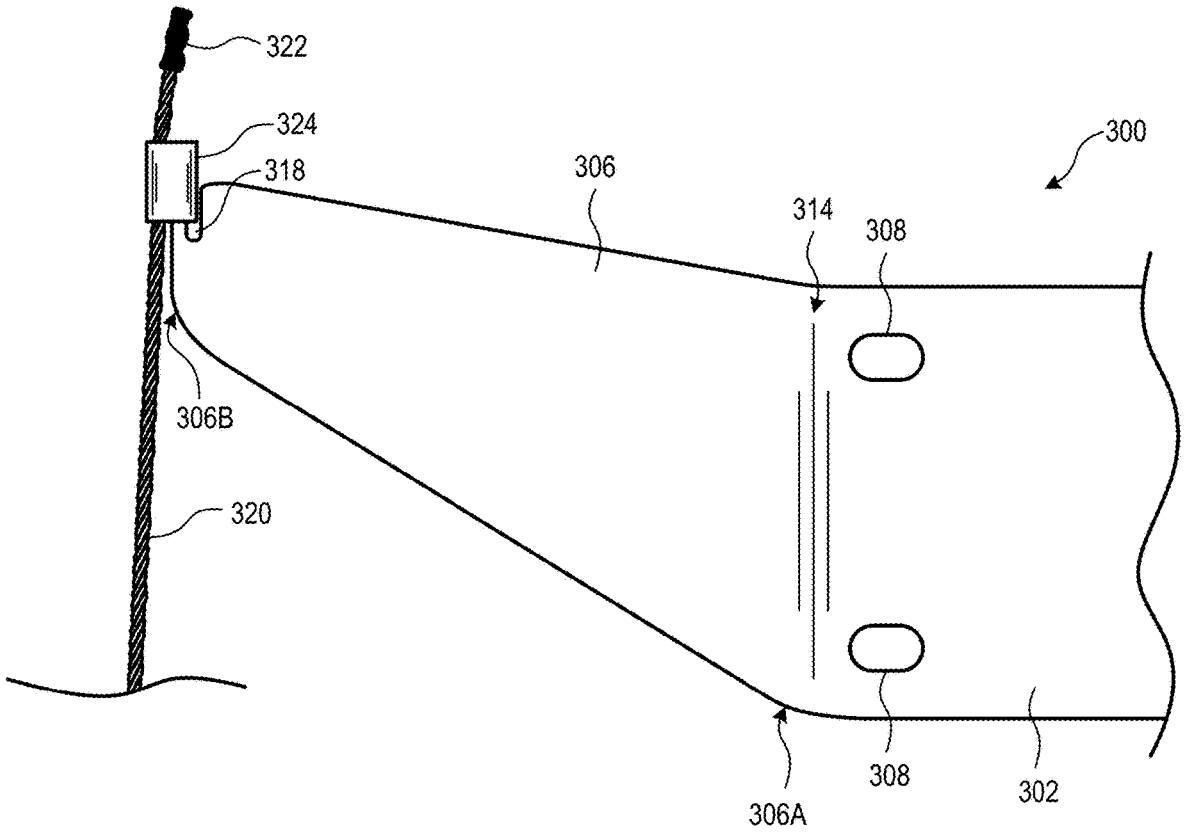
FIG. 3B is a front view of the embodiment of the standoff arm further illustrating its coupling to the embodiment of the elongated member segment.

In some embodiments, the standoff arm 306 has a slot 318 formed therein at the distal end 306B, that is used to couple the elongated member segment 320 to the standoff arm 306. As illustrated in FIG. 3A, the elongated member segment 320 is inserted through capture band 324 that is sized such that a portion of the capture band 324 is receivable by the slot 318. This is accomplished in the present illustrative embodiment by the capture band 324 being a hallow elongated cylinder having appropriately-sized inner and outer diameters. In other embodiments, the capture band is laterally elongated in one direction, akin to a partially crushed hallow cylinder, and it can further be an open-loop. Both of these exemplary embodiments will subsequently be shown. FIG. 3B illustrates a portion of the capture band 324 being inserted into the slot 318. As a downward force is applied to the elongated member segment 320, the elongated member segment 320 will pass through the capture band 324 until the terminal 322 abuts the capture band 324 (and also typically a point at or near the distal-most tip 399 (FIG. 3A) of the standoff arm 306), thus coupling the elongated member segment 320 to the slot 318 (and therefore to the standoff arm 306).

Figure 3C:
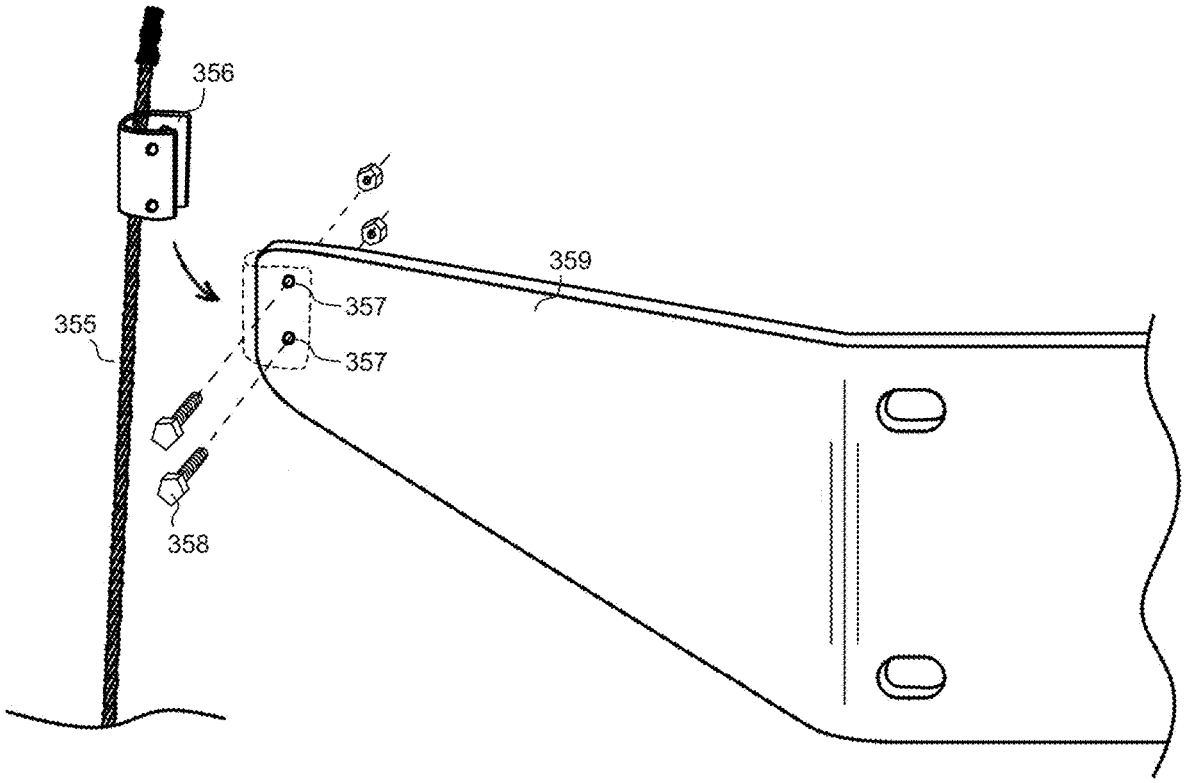
FIG. 3C is a front view of an embodiment of a standoff arm illustrating its coupling to an embodiment of an elongated member segment via an open-loop capture band.

FIG. 3C illustrates the use of an open loop capture band 356. That is, this figure shows an alternate means of coupling an elongated member segment 355 to a standoff arm 359 using the open loop capture band 356. Secondary hardware, such as fastener 358, is used to couple the capture band 356 to the standoff arm 359, and therefore the elongated member segment 355, to the standoff arm 359.

Standoff Wall Attachment & Loading

Figure 4A:
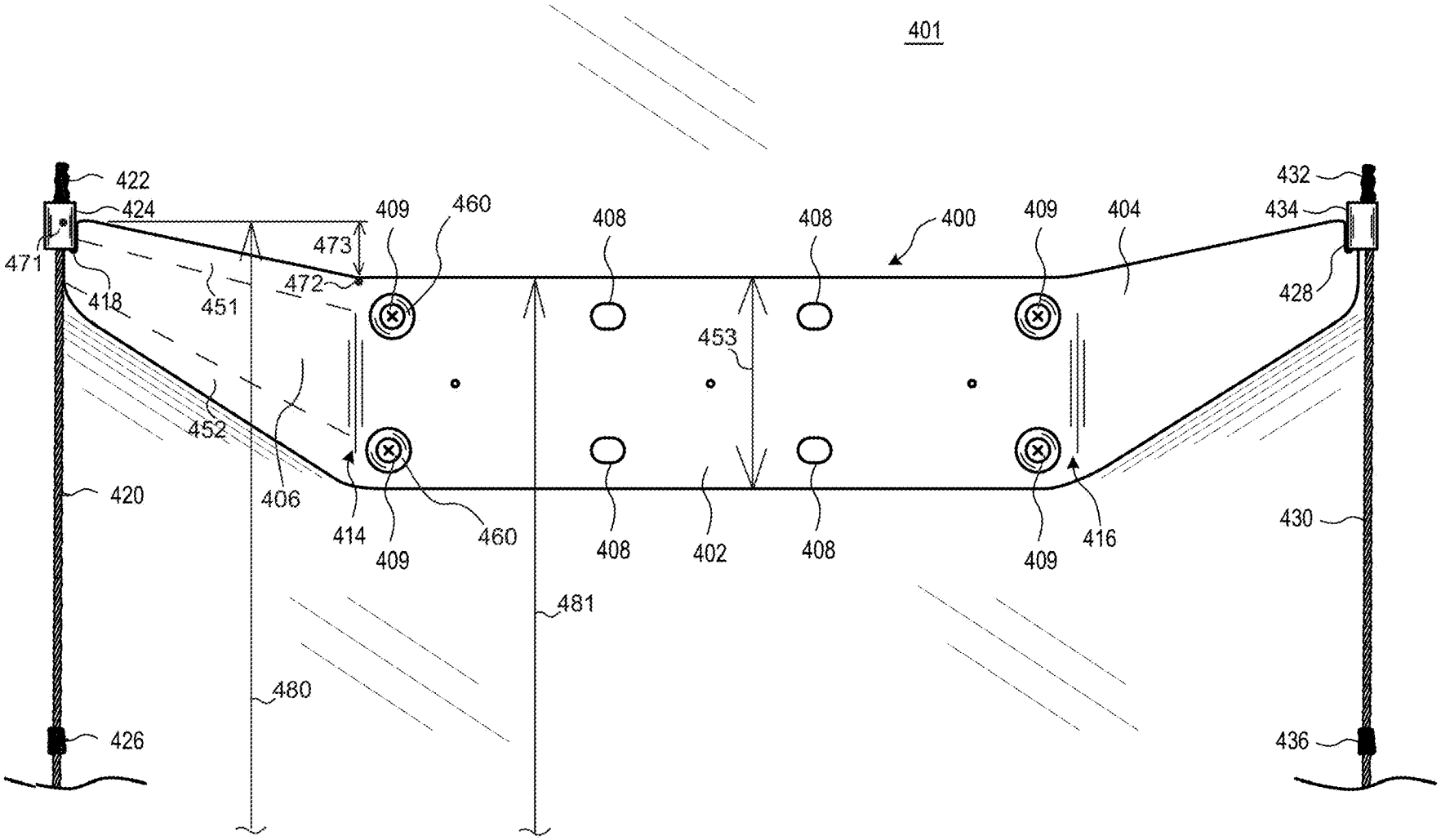
FIG. 4A is a front view of an embodiment of a standoff member mounted to a wall and coupled to elongated member segments.
Figure 4B:
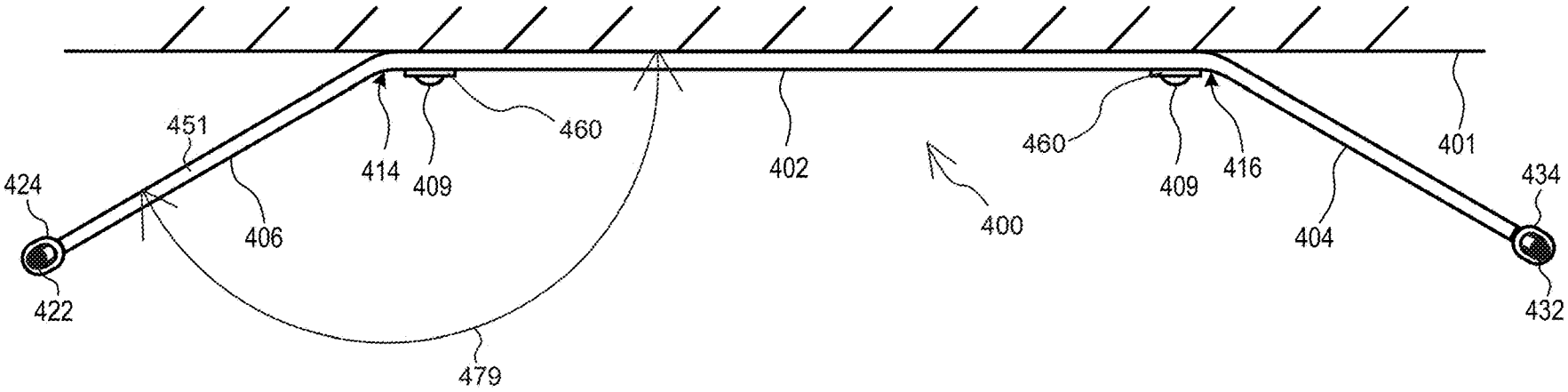
FIG. 4B is a top view of the embodiment of the standoff member mounted to the wall and coupled to the elongated member segments.
Figure 4C:
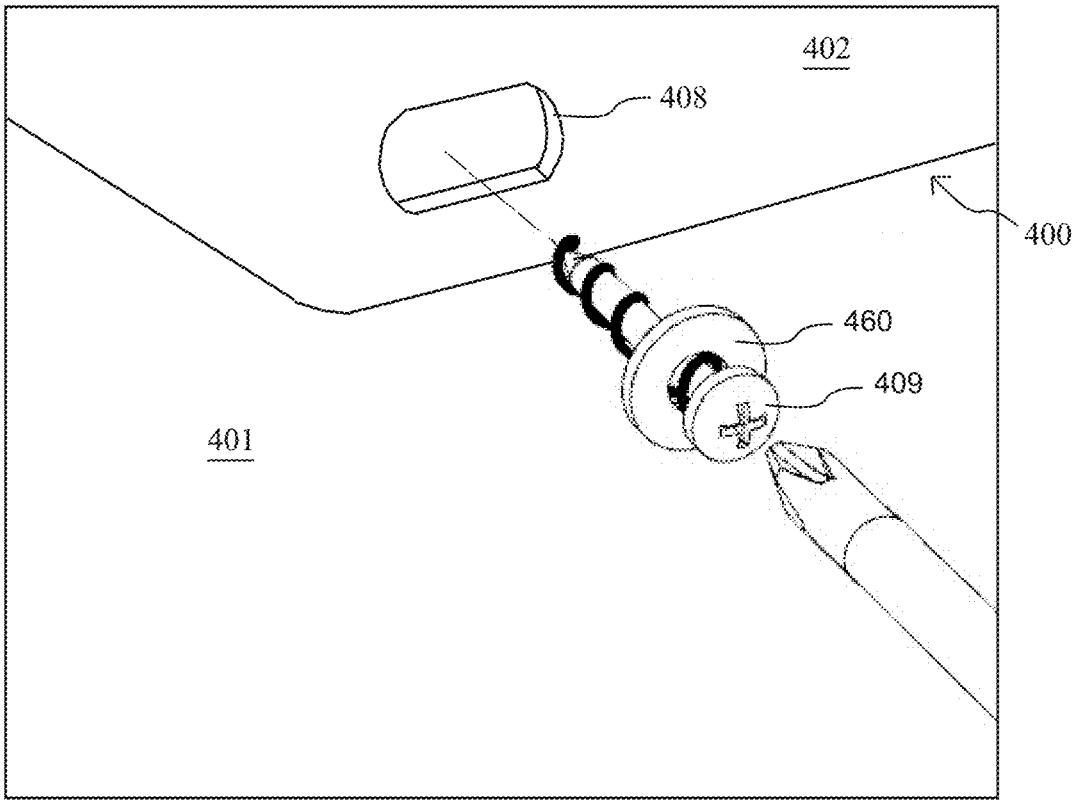
FIG. 4C is a front perspective view showing the mounting of the standoff member embodiment to the wall via a wall anchor and washer.

FIGS. 4A and 4B are front and top views, respectively, of an embodiment of a standoff member 400 mounted to a wall 401 and coupled to elongated member segments 420, 430. The standoff member 400 includes a wall attachment base 402 with standoff arms 404, 406 coupled thereto and extending therefrom at respective joints 416, 414. The wall attachment base 402 may include, as illustrated, a plurality of apertures 408 through which wall anchors 409 pass for coupling the standoff member 400 to the wall 401. By way of non-limiting example, washers 460 facilitate the mating of anchors 409 to the wall attachment base 402, as shown in FIGS. 4A and 4B, and in detail in FIG. 4C. An example of an anchor suitable for serving in this capacity is Wall-Dog™ by Powers® Fasteners of Brewster, N.Y., which can be screwed into drywall and can make use of a #12 washer to facilitate wall attachment base mating. Many other arrangements known in the art can be used for anchoring, including all manner of drywall anchors, toggle bolt anchors, concrete screws, wood screws, steel stud screws, and screws suitable for masonry and plaster, to name a few. The wall attachment base 402 has a vertical dimension 453 as shown in FIG. 4A. This vertical dimension 453 is constant in the present embodiment yet it is understood that it can vary with horizontal position and therefore there can be a largest vertical dimension of the wall attachment base 402 differing from a smallest vertical dimension.

Returning to FIG. 4A, the standoff arm 406 has a slot 418 formed therein (analogous to slot 318 shown in FIG. 3A); the elongated member segment 420 is coupled to this slot 418 via a capture band 424. Attached to elongated member segment 420 is terminal 422 that may abut the capture band 424 and also may abut the standoff arm 406 at or near a distal most point on standoff arm 406 (as will be shown), thereby securing the elongated member segment 420 in place as a downward force is applied to the elongated member segment 420. Similarly, the standoff arm 404 has a slot 428 formed therein and the elongated member segment 430 is coupled analogously to the described coupling of elongated member segment 420.

In the present disclosure, the "connection point" is defined as the outermost location on a standoff arm (i.e. furthest from the wall attachment base) where the standoff arm presses against a corresponding elongated member segment, or against coupling hardware associated with this elongated member segment. If there are two such outermost locations for a given standoff arm, then the midpoint of a line drawn between them shall be considered the connection point. For three or more such points, the connection point would be what is known in mathematics as the centroid—the point that minimizes the sum of the squared distances between itself and each point in the group.

Figure 4D:
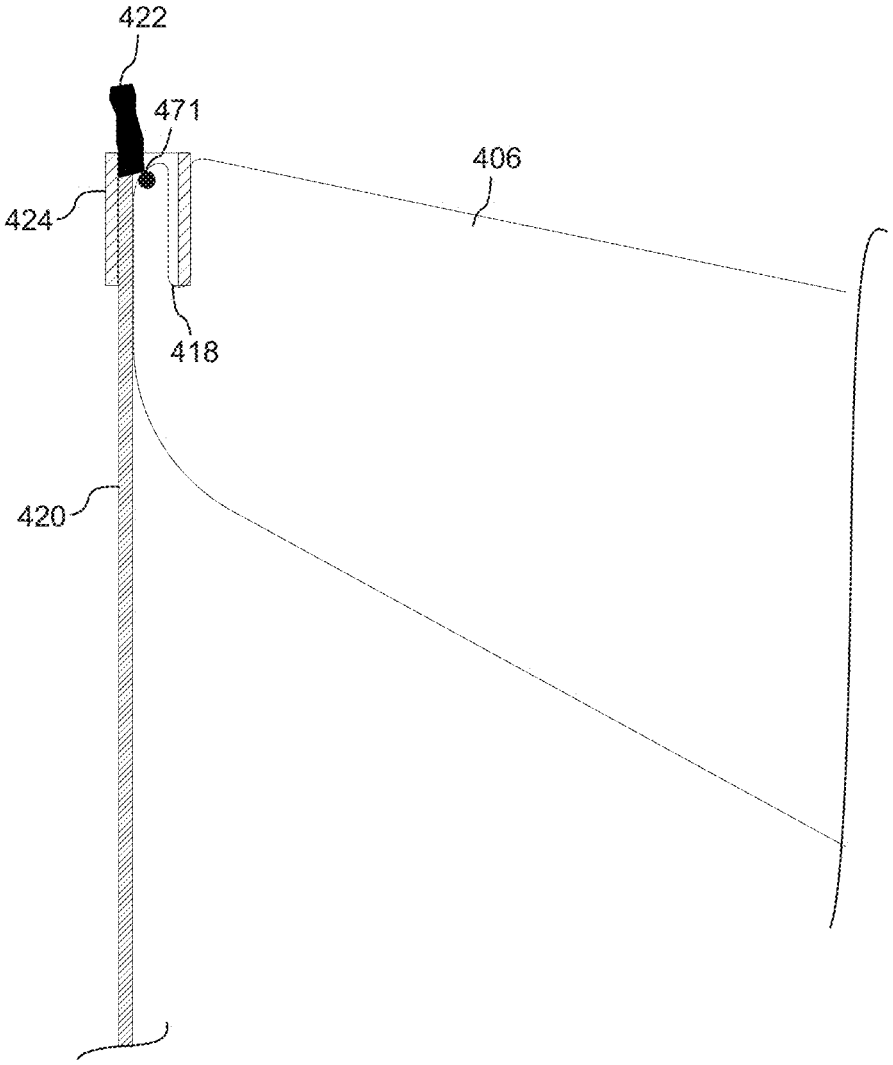
FIG. 4D is a front close-up view of the view presented in FIG. 4A with a connection point visible.

Focusing on the interface of the elongated member segment 420 with the standoff arm 406, FIG. 4D is considered. Here the capture band 424 is shown in cut-away view, and a tension force in the elongated member segment 420 is considered (resulting from, for example, display panel weight). The terminal 422 is wedged against capture band 424 and against the standoff arm 406 at connection point 471. It is clear that the connection point for a given standoff arm is simply the distal-most point on the standoff arm that experiences direct or indirect (via coupling hardware) elongated member segment loading.

Returning to FIG. 4A, while keeping FIG. 4B in mind, it is appreciated that the standoff arm 406 positions the connection point 471 away from the wall at a connection point height 480, which is understood to be with respect to some datum such as the ground. Additionally, the closest point 472 of the corresponding wall attachment base 402 is at a closest point height 481 with respect to the same datum as that of connection point height 480. The difference between these heights 480, 481 is a vertical distance 473 as shown. This vertical distance 473 may be a small fraction of the wall attachment base 402 largest vertical dimension 453, it may be a multiple of this dimension, it may be zero, and it may extend in the opposite sense (i.e., downward in FIG. 4A).

As seen in FIG. 4A, each of the elongated member segments 420, 430 have respective sleeves 426, 436 formed, crushed, crimped, or adhered (etc.) thereon, to secure display panels in place by restricting their motion along the elongated member segments 420, 430, as will be shown. These sleeves 426, 436 may be formed from solidified glue, epoxy, or resin; they may be an adhesive, a tape, a wrapped plastic, a heat shrink plastic, or other suitable material. The sleeves 420, 430 may further be crushed metal, crimped thin-walled tube sections, metal or foil strips wrapped around the elongated member segments 420, 430, melted or welded metal, or a clip or mechanical clamp. Many other materials and components known in the art can be used to serve the purpose of the sleeves 426, 436.

There are many acceptable values for the angles of the standoff arms 404, 406 with respect to the portion of the wall 401 behind the wall attachment base 402. FIG. 4B illustrates this angle 479 for standoff arm 406 as obtuse, which is particularly favorable in relation to minimizing hardware visibility once display panels are installed, as will subsequently be shown.

Standoff arms 406, 404 are depicted as generally planar in this exemplary embodiment (see, in particular, FIG. 4B) and are noted to be loaded by respective elongated member segments 420, 430 at or very near their distal edges (FIGS. 4A, 4B). This loading is, by definition, aligned with the direction of the elongated member segments 420, 430 (i.e., aligned with the direction that the elongated member segments 420, 430 are "tensioned"), which is in the vertical sense. The generally planar standoff arms 406, 404 are also oriented in the vertical sense (see FIG. 4B), and therefore, given the edge loading mentioned, undergo minimal out-of-plane bending or twisting due to the loading applied from the elongated member segments 420, 430. Expressed more generally, the respective elongated member segments 420, 430 are coupled to and substantially parallel with the generally planar standoff arms 406, 404. (This substantially parallel description is intended to encompass the case when an elongated member segment falls within, i.e., is coincident with, the plane described by a generally planar standoff arm.) Under these loading condition, the standoff arms 406, 404 behave like structural beams (see next paragraph), having high load carry capacity and maximizing material usage, meaning they are stiff and light weight.

Figure 4E:
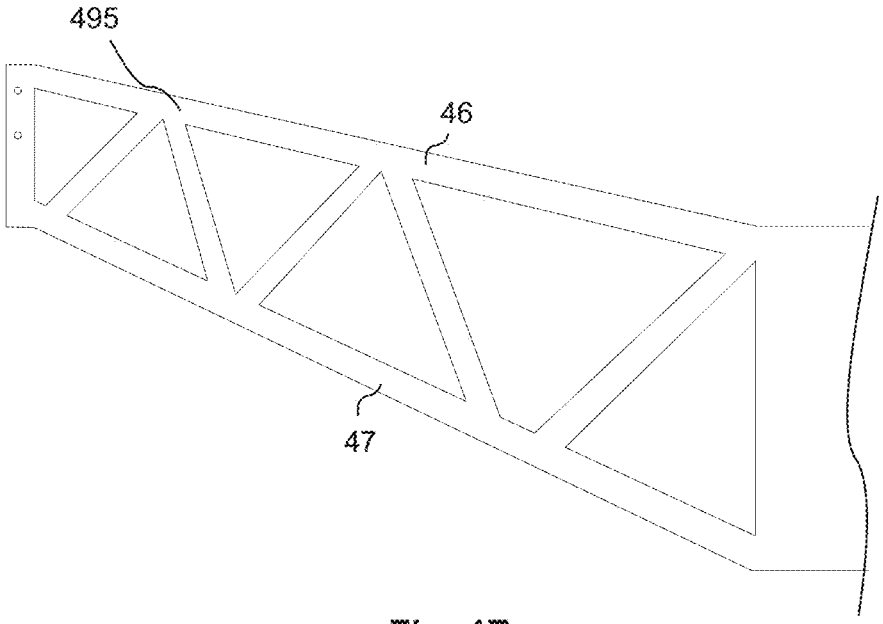
FIG. 4E is a front view of a portion of a standoff member with a truss-like standoff arm.
Figure 4F:
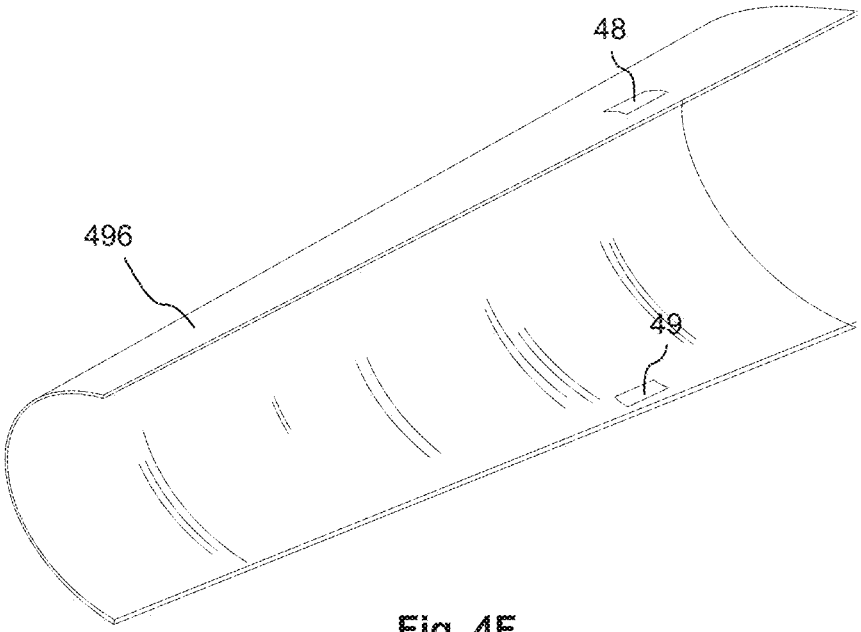
FIG. 4F is a front perspective view of a standoff arm of an open tube-like structure.

As seen in FIG. 4A, the standoff arm 406 has an upper portion 451 that is positioned directly above a lower portion 452 (which is clear in FIG. 4B, in which the upper portion 451 is visible while the lower portion 452 is not). The upper portion 451 and lower portion 452 serve as flanges akin to an I-beam, providing stiffness for the standoff arm 406. Other embodiments of standoff arms also having upper portions directly above corresponding lower portions are contemplated, such as, in FIG. 4E, upper portion 46 in relation to lower portion 47 (for truss-like standoff arm 495), and, in FIG. 4F, upper portion 48 in relation to lower portion 49 (for the open tube-like structure of standoff arm 496).

It is noted that, while the present discussion applies to the foregoing exemplary embodiments, other embodiments have different material and load orientations and may exhibit different performance characteristics.

Elongated Member Segment Tensioning Assembly

Figure 5A:
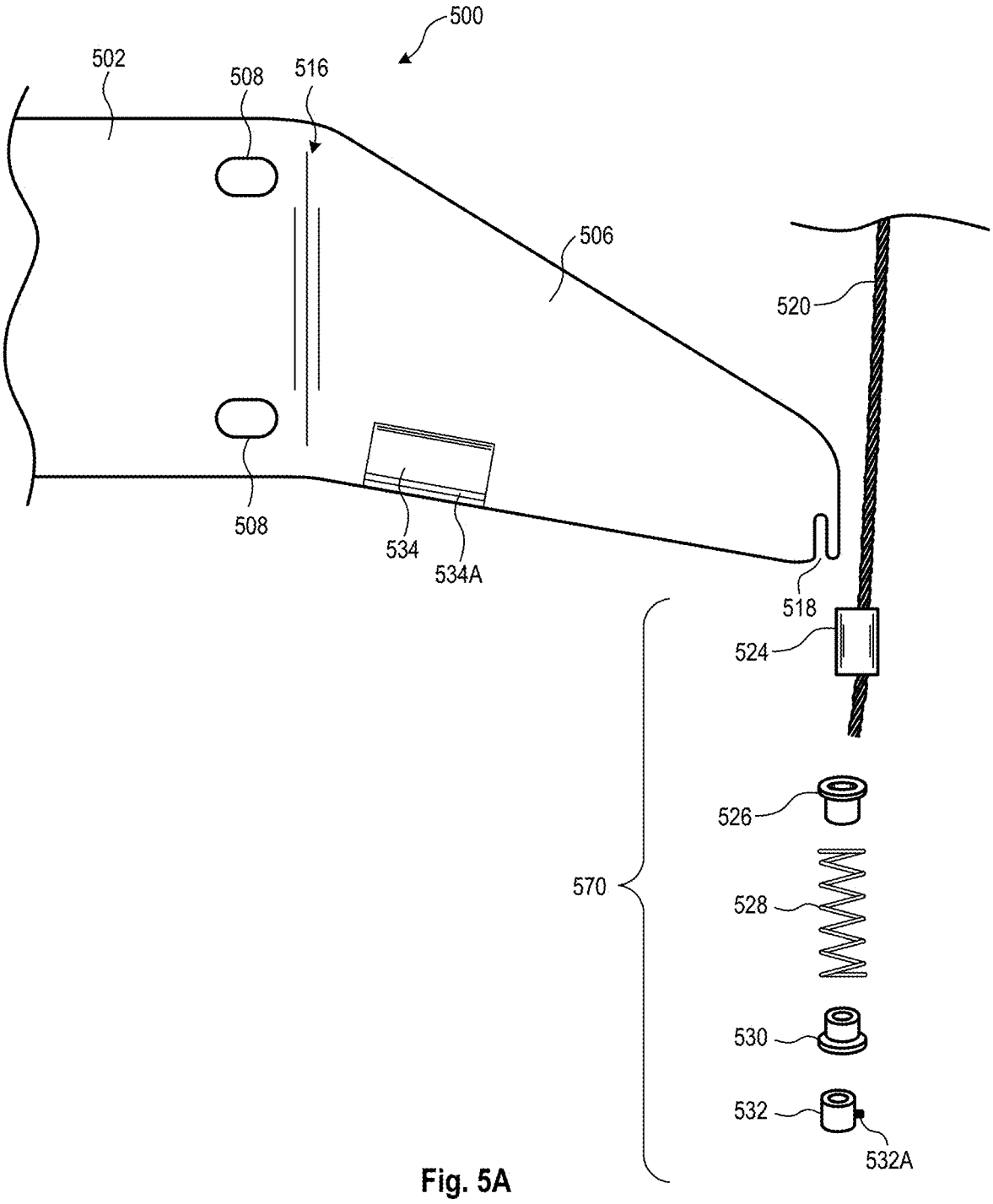
FIG. 5A illustrates coupling of an elongated member segment embodiment to a standoff arm of a standoff member embodiment using a tensioning assembly embodiment.
Figure 5B:
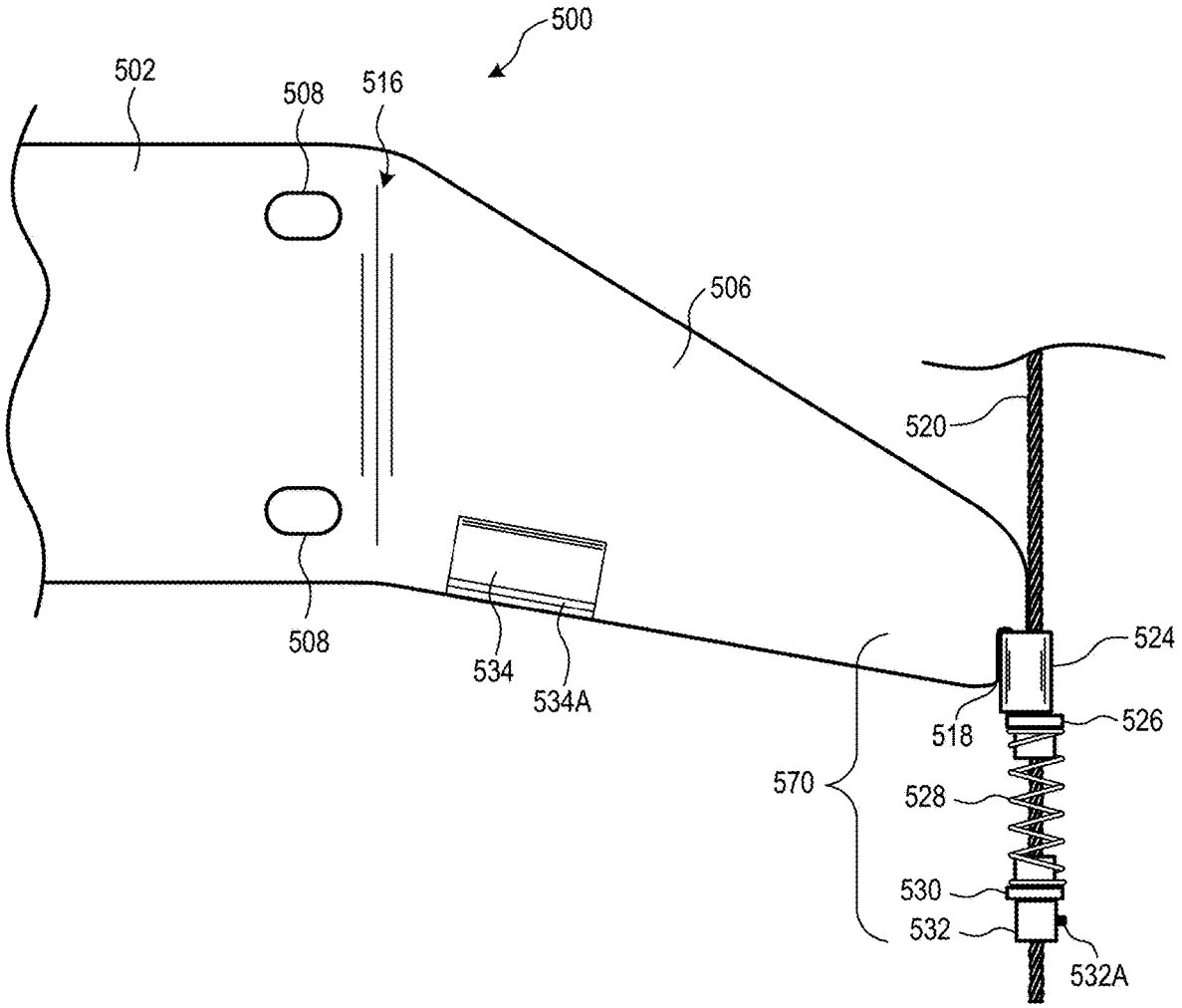
FIG. 5B further illustrates coupling of the elongated member segment embodiment to the standoff arm of the standoff member embodiment using the tensioning assembly embodiment.

FIGS. 5A and 5B illustrate coupling of an elongated member segment 520 to a standoff arm 506 of a standoff member 500 using a tensioning assembly 570. Each of the components of the standoff member 500 may be the same as, or similar to, their identically named counterparts of the preceding figures. The standoff member 500 includes a wall attachment base 502 with the standoff arm 506 coupled to and extending from the wall attachment base 502 at a joint 516. The wall attachment base 502 may include a plurality of slots apertures 508 for coupling the standoff member 500 to a wall. In some embodiments, at least a portion of the standoff arm 506 is planar. The standoff arm 506 may further include a retention member 534 having a slot 534A in which a portion of the elongated member segment 520 fits and is therein retained.

The tensioning assembly 570 includes a plurality of components that, together, couple the elongated member segment 520 to the slot 518 and induce tension in the elongated member segment 520. As illustrated, the tensioning assembly 570 includes a capture band 524, flange washers 526, 530, a spring 528, and a gripper 532. The capture band 524 may be the same as or similar to its identically named counterpart of FIGS. 3A and 3B. The flange washer 526 is in the form of an elongated hollow cylinder with a first outer diameter that is larger than an inner diameter of the spring 528, and a second outer diameter that is smaller than the inner diameter of the spring 528, such that only the portion of the flange washer 526 having the second outer diameter fits within the spring 528. The flange washer 530 may be identical to or similar to the flange washer 526. The spring 528 may be a standard metal spring that is compressible and may have a relatively low stiffness (e.g., compressible between an individual's index finger and thumb) or a somewhat higher stiffness. By way of non-limiting example, a compression spring having a 1.35 inch undeformed length and 0.45 inch maximally deformed (compressed) length, with a stiffness of 5.5 lbs./in. is well-suited for this application. Other elastic elements that would be appreciated by one of ordinary skill in the art having a range of stiffnesses and working lengths may also be used for this purpose The exemplary embodiment of the gripper 532 shown is composed of a hollow cylinder through which the elongated member segment passes, and a clamping screw 532A that passes through an outer wall of the gripper 532 into its interior, and is used to clamp against the elongated member segment 520. In some embodiments, other types of mechanical clamps may be used as the gripper 532. In other embodiments, an adhesive material may be secured to the elongated member segment 520 and may act as the gripper 532 by providing a stationary structure against which the flange washer 530 and/or other components of the tensioning assembly 570 abut.

FIG. 5B illustrates the tensioning assembly 570 with the elongated member segment 520 passing through each of the components. In order to induce tension in the elongated member segment 520, for example, spring 528 is compressed slightly by the flange washer 530 and the gripper 532. Once compressed, the clamping screw 532A is tightened against the elongated member segment 520 to secure the gripper 532 against the elongated member segment near a first end (shown) of the elongated member segment 520, while an opposite end (not shown) of the elongated member segment 520 and the standoff member 500 are stationary relative to each other (e.g., when the standoff member 500 is surface-mounted and the opposite end of the elongated member segment 520 is coupled to separate standoff member that is mounted to the same surface as the standoff member 500). This results in a restoring force in the spring, which induces tension in the elongated member segment 520 between the gripper 532 and the stationary opposite end of the elongated member segment 520. In the event that the elongated member segment 520 elongates slightly over time (due to, for example, the weight of display panels that it supports), or the standoff member 500 itself settles slightly on a wall to which it is anchored, the spring 528 in the tensioning assembly 570 will accommodate such displacement while still maintaining tension in the elongated member segment 520. The tensioning assembly 570 thus provides maintenance free operation.

Figure 6A:
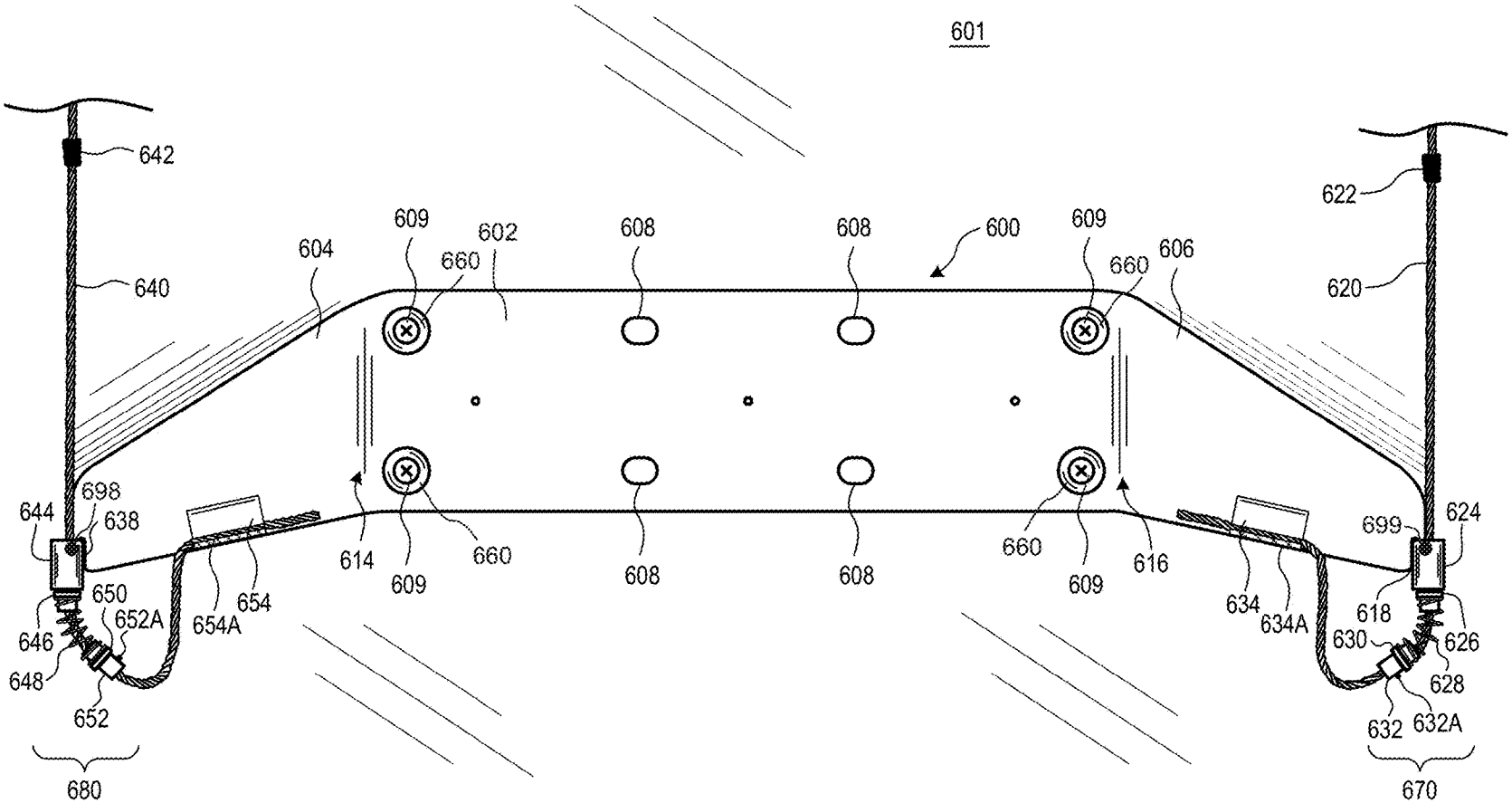
FIG. 6A is a front view of an embodiment of a standoff member mounted to a wall and coupled to elongated member segment embodiments via tensioning assembly embodiments.

FIG. 6A is a front view of an embodiment of a standoff member 600 mounted to a wall 601 and coupled to elongated member segments 620, 640. Each of the components depicted may be the same as, or similar to, their identically named counterparts of FIGS. 5A and 5B. The standoff member 600 includes a wall attachment base 602 with standoff arms 604, 606 coupled to and extending from the wall attachment base 602 at respective joints 614, 616. The wall attachment base 602 includes a plurality of apertures 608 for coupling the standoff member 600 to the wall 601, e.g., via anchors 609 used in concert with washers 660.

The standoff arm 606 has a slot 618 formed therein, to which the elongated member segment 620 is coupled via tensioning assembly 670. The tensioning assembly 670 may be the same as, or similar to, the tensioning assembly 570, and includes a capture band 624, flange washers 626, 630, a spring 628, and a gripper 632 (with clamping screw 632A). The standoff arm 606 may further include a retention member 634 having a slot 634A that is sized such that a portion of the elongated member segment 620 fits and is retained therein.

Similarly, the standoff arm 604 has a slot 638 formed therein, to which the elongated member segment 640 is coupled via tensioning assembly 680. The tensioning assembly 680 may be the same as, or similar to, the tensioning assembly 670, and includes a capture band 644, flange washers 646, 650, a spring 648, and a gripper 652 (with clamping screw 652A). The standoff arm 604 may further include a retention member 654 having a slot 654A that is sized such that a portion of the elongated member segment 640 fits and is therein retained.

Each of the elongated member segments 620, 640 have respective sleeves 622, 642 formed, crushed, crimped, or adhered (etc.) thereon, which secure display panels thereto by restricting their motion along the elongated member segments 620, 640.

Figure 6B:
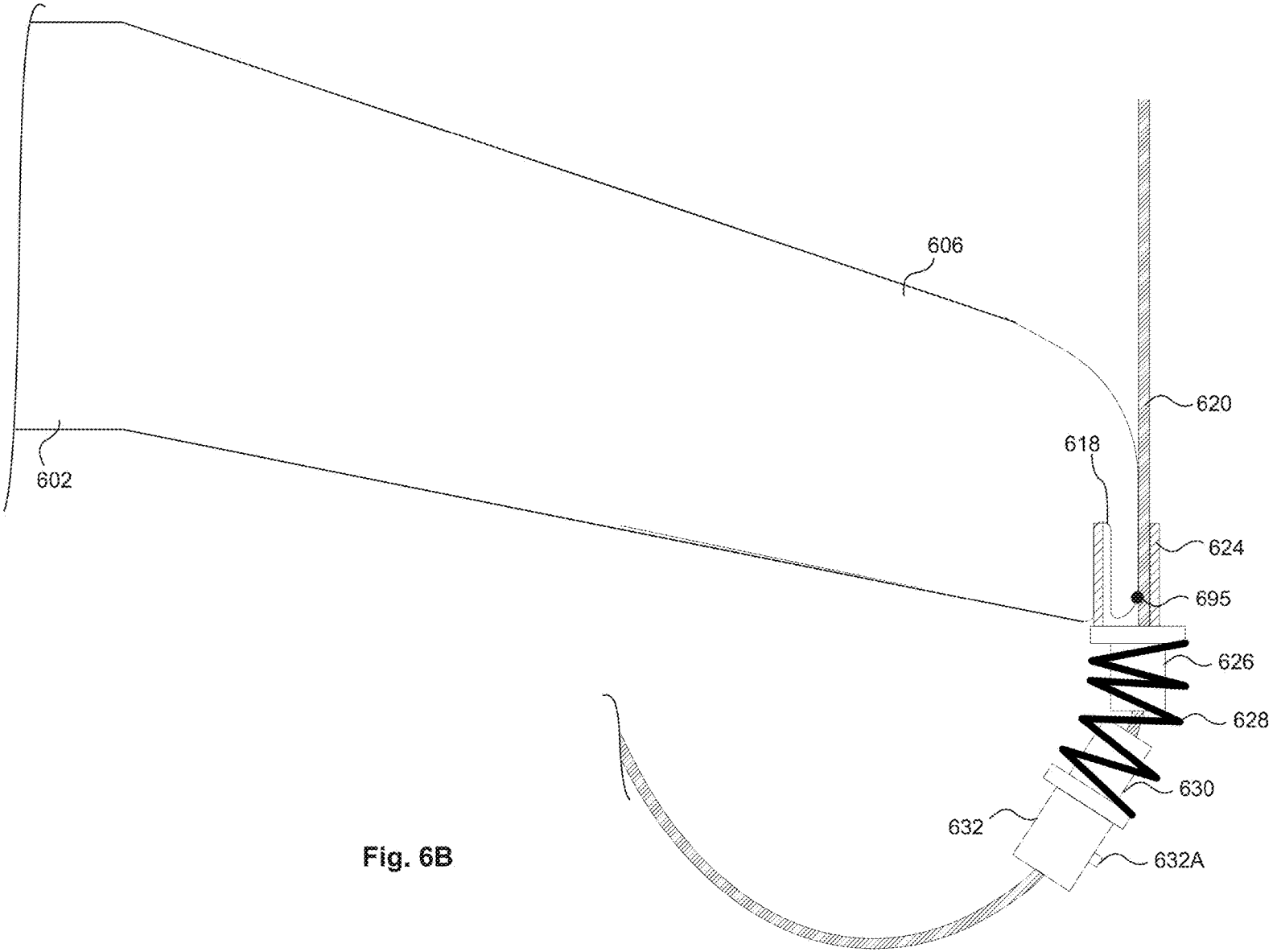
FIG. 6B is a close-up front view of the embodiment of the standoff member mounted to the wall in FIG. 6A showing a connection point.

FIG. 6B shows a close-up of standoff arm 606 with a cutaway view of capture band 624. Connection point 695 is shown, being noted to be the furthest contact point of the elongated member segment (and coupling hardware) from the wall attachment base 602.

Segmented Display Array Embodiment

Figure 7A:
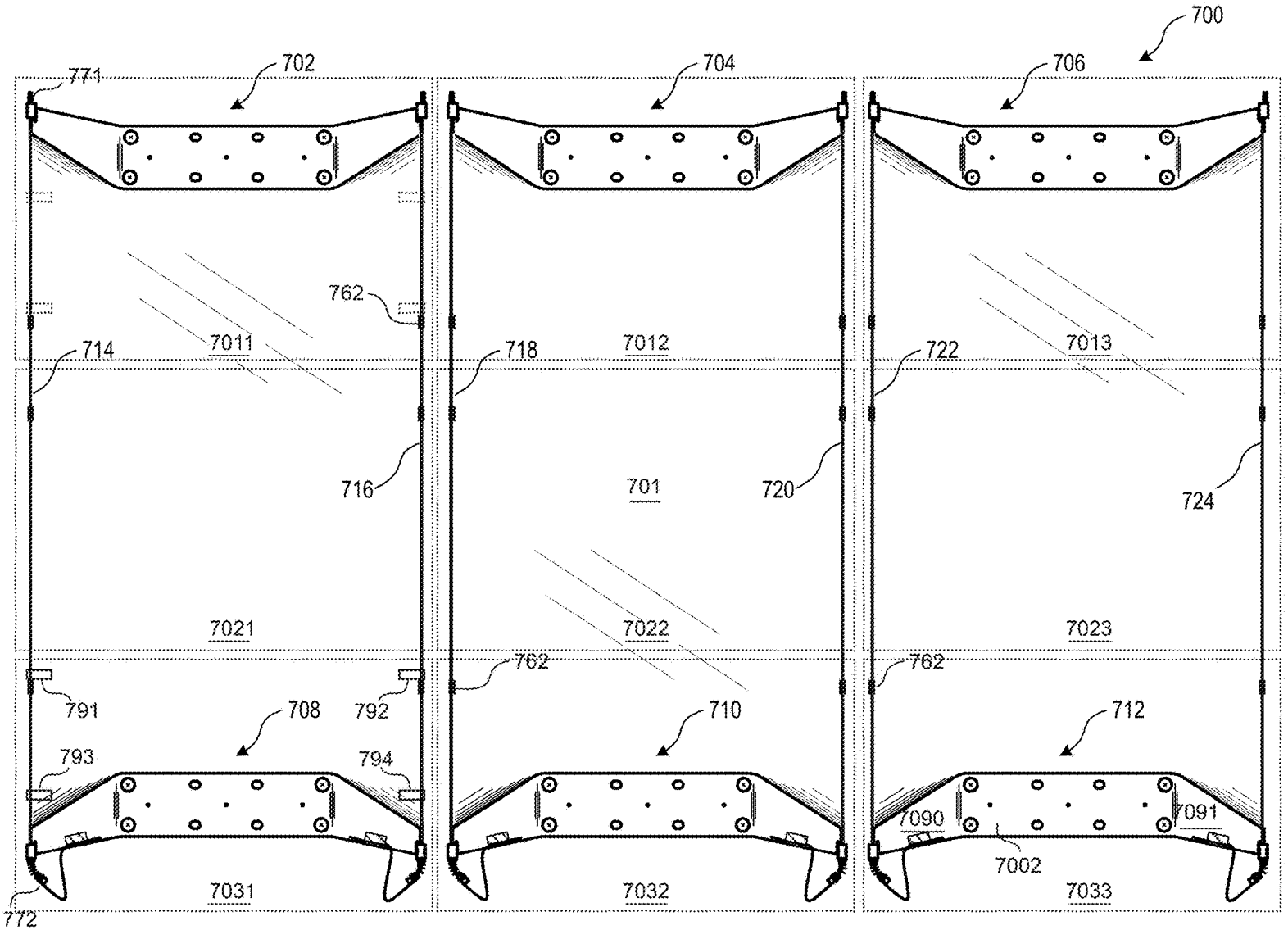
FIG. 7A illustrates an embodiment of a segmented display array wherein display panel embodiments are translucent (dashed lines)

FIG. 7A illustrates an embodiment of a segmented display array 700. Here display panels 7011, 7012, 7013, 7021, 7022, 7023, 7031, 7032, 7033 are shown and, though they are in the foreground, are indicated by dashed lines and made transparent so that the underlying hardware can be seen. Each of standoff members 702, 704, 706, 708, 710, 712 are mounted to a wall 701 (e.g., as illustrated in FIGS. 4A, 4B, and 6A), and elongated member segments 714, 716, 718, 720, 722, 724 are routed between associated opposing standoff members (e.g., also as illustrated by FIGS. 4A and 6A). Sleeves 762, which secure the display panels in place, are shown on each of the elongated member segments 714, 716, 718, 720, 722, 724. This is accomplished via the use of retention members that are affixed to the back of the display panels 7011, 7012, 7013, 7021, 7022, 7023, 7031, 7032, 7033, where two sleeves 762 support two associated retention members on each display panel 7011, 7012, 7013, 7021, 7022, 7023, 7031, 7032, 7033. To illustrate this, retention members 791, 792, 793, 794 are shown just on display panel 7031 (these are understood to exist in an analogous manner for each display panel). These are bonded, or otherwise affixed to the display panel 7031 and retain the associated elongated member segments 714, 716. The two sleeves 762 that are within the bounds of the display panel 7031, being associated with elongated member segments 714, 716, limit the sliding of retention members 791, 792 along respective elongated member segments 714, 716 and therefore secure in place display panel 7031. Subsequent discussion will make this embodiment more clear. Many other retention members know in the art may be used for the purpose of securing the display panels in place, including elastically opposing clamps, magnets, and more.

Figure 7B:
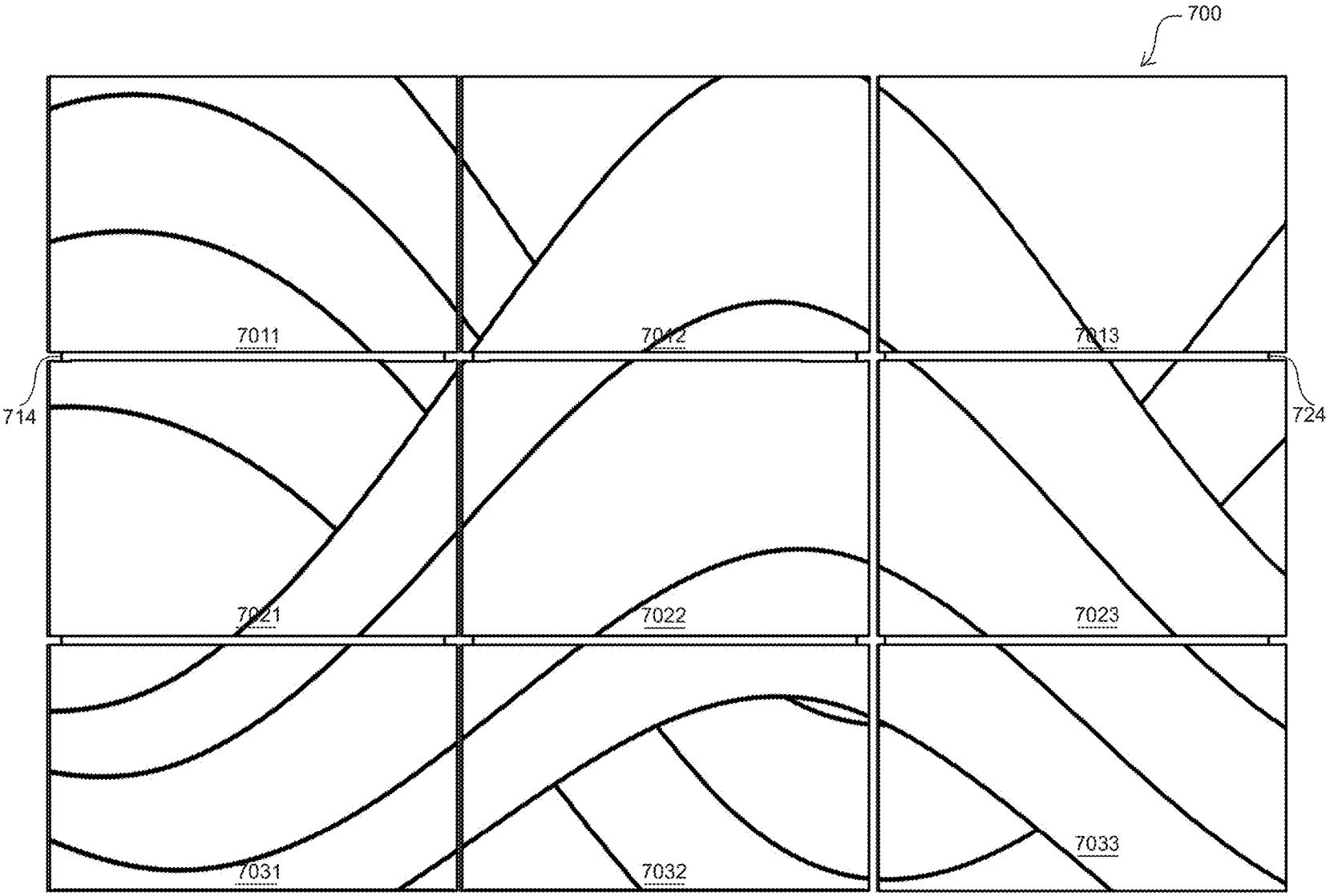
FIG. 7B further illustrates the segmented display array wherein the display panel embodiments are now opaque and collectively form a portion of a single coherent image.
Figure 7C:
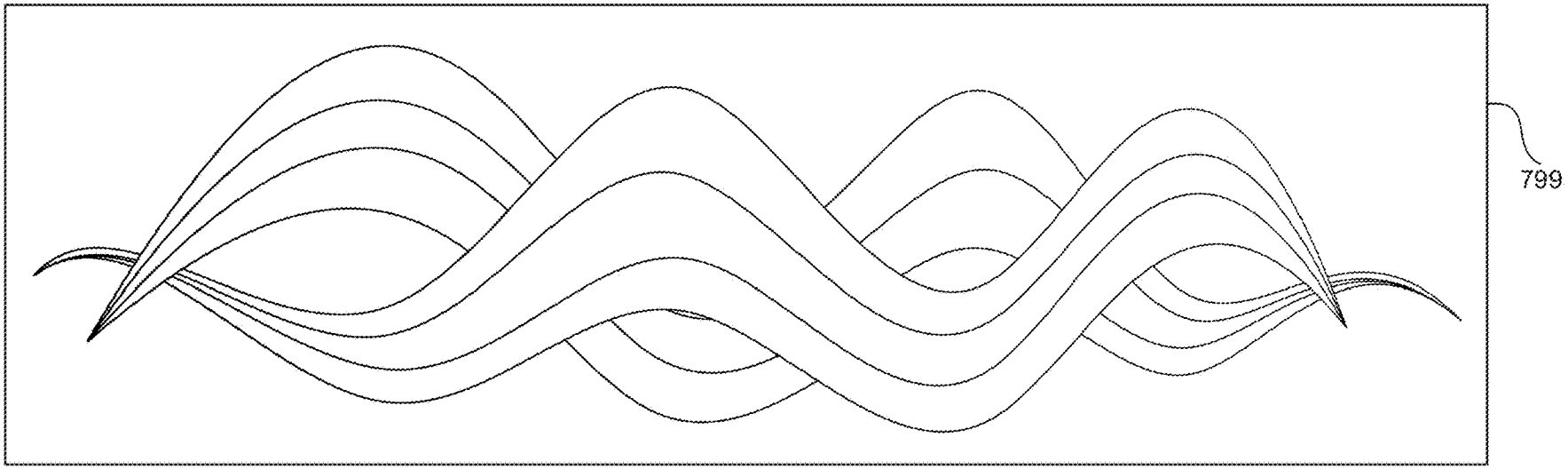
FIG. 7C shows the original single coherent image.

The top row of display panels 7011, 7012, 7013 limit (and, from some angles block) the visibility of the underlying standoff members 702, 704, 706 in relation to an observer of the segmented display array 700. The bottom row of display panels 7031, 7032, 7033 correspondingly also limit (and, from some angles block) the visibility of the underlying standoff members 708, 710, 712 in relation to an observer of the segmented display array 700. This is illustrated in FIG. 7B where the display panels 7011, 7012, 7013, 7021, 7022, 7023, 7031, 7032, 7033 are shown in opaque form, with different images on each panel that collectively form a portion of a single coherent image 799 shown in FIG. 7C.

Figure 7E:
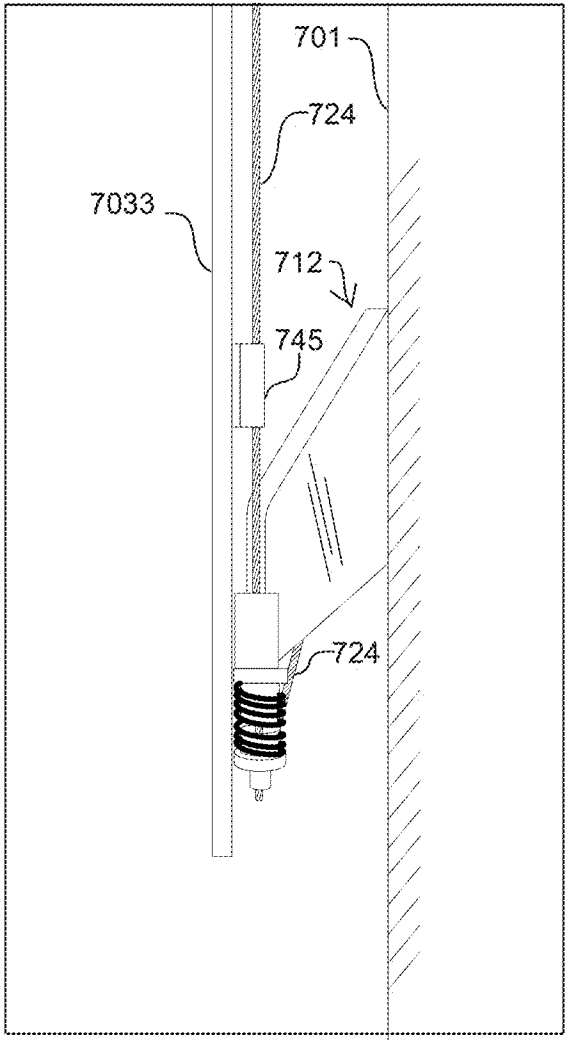
FIG. 7E shows a side view of a bottom panel (and underlying hardware) of the embodiment of a segmented display array.
Figure 7D:
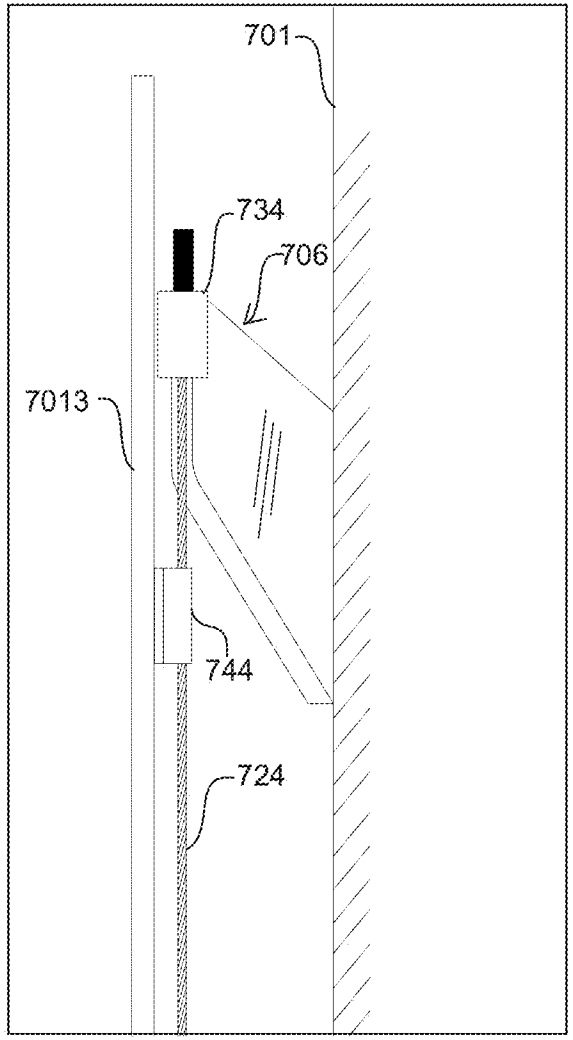
FIG. 7D shows a side view of a top panel (and underlying hardware) of the embodiment of a segmented display array.

FIGS. 7D and 7E show right side views of portions of the top right display panel 7013 and the bottom right display panel 7033, respectively. The associated respective standoff members 706, 712 are also shown here mounted to the wall 701. Visible further, securing the display panels 7013, 7033 to the right-most elongated member segment 724 (in concert with two other retention members not shown), are the respective retention members 744, 745, whose form and function will be subsequently illustrated in more detail herein.

Many other hardware and display panel arrangements are understood to be represented by the foregoing illustrative embodiment. For example, in addition to the arrangement shown here of there being three rows and three columns of display panels (i.e., 3×3), the array could be 3×4, 4×4, 8×5, 5×10, and many other such arrangements. Further, differing sizes and irregularly shaped or non-uniformly arranged display panels may also be used.

It is further noted that, as shown in FIG. 7A, the loaded portions of the elongated member segments 714, 716, 718, 720, 722, 724 are straight for the most part, not being required to go through any sharp angular transitions. For example, the region of elongated member segment 714 between its associated terminal 771 (analogous to terminal 422, shown in detail in FIG. 4A) and its associated bottom gripper 772 (analogous to gripper 532, shown in detail in FIG. 5B) is not forced through any sharp corners. This is advantageous, as sharp angular transitions would create kinks in embodiments where the elongated member segments are composed of cable or the wire rope.

Though minimal visibility of underlying supporting hardware, as illustrated by the embodiment of the segmented display array 700 presented in FIGS. 7A, 7B, 7D, and 7E is often desirable, this does not preclude partial or full visibility of this hardware falling within the scope of the present disclosure.

Additional Segmented Display Array Embodiment

Figure 7F:
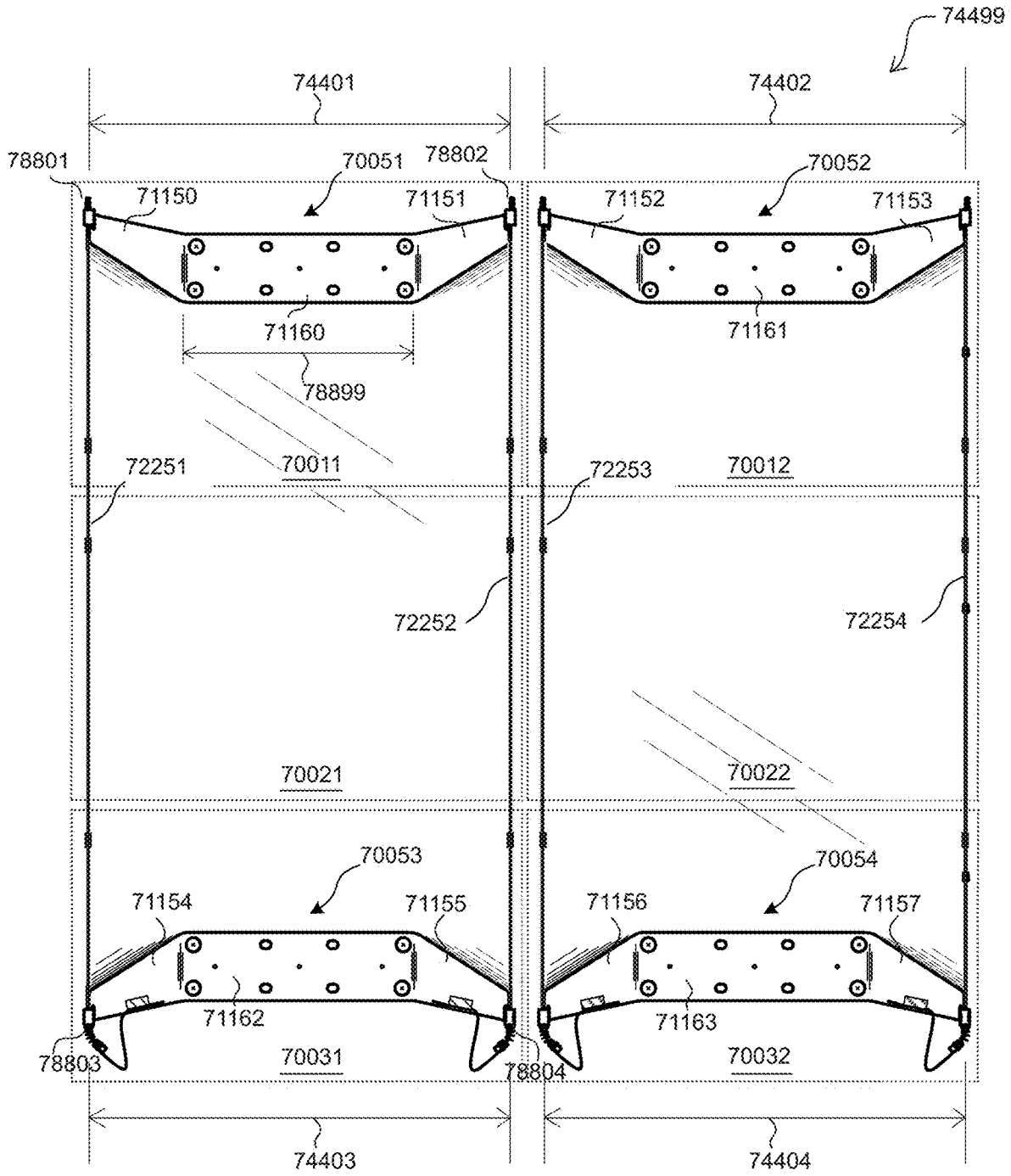
FIG. 7F is a front view of an embodiment of a segmented display array.

Shown in FIG. 7F is an embodiment of segmented display array 74499 showing an embodiment of a first and second standoff member 70051, 70053 respectively, having respective planar bases 71160, 71162. Extending angularly from the standoff member 70051 are planar arms 71151, 71150 incorporating respective connection points 78802, 78801 near their ends. These connection points 78802, 78801 are positioned apart by distance 74401 which is further than the longest dimension 78899 of the associated planar base 71160. The second standoff member has corresponding positioning of its connection points 78804, 78803. A first elongated member segment 72251 is coupled between the connection point 78801 (which is associated with the planar arm 71150 which is associated with the first standoff member 70051) and connection point 78803 (which is associated with the planar arm 71154 which is associated with the second standoff member 70053). Similarly, a second elongated member segment 72252 is coupled between the connection point 78802 (which is associated with the planar arm 71151 which is associated with the first standoff member 70051) and the connection point 78804 (which is associated with the planar arm 71155 which is associated with the second standoff member 70053). Embodiments of display panels 70011, 70021, 70031 are coupled between the first and second elongated member segments 72251, 72252. In an analogous manner, respective third and fourth standoff members 70052, 70054 and associated hardware facilitate the coupling of display panels 70012, 70022, 70032 to respective third and fourth elongated member segments 72253, 72254.

Embodiment Including Plurality of Standoff Arms

Figure 8A:
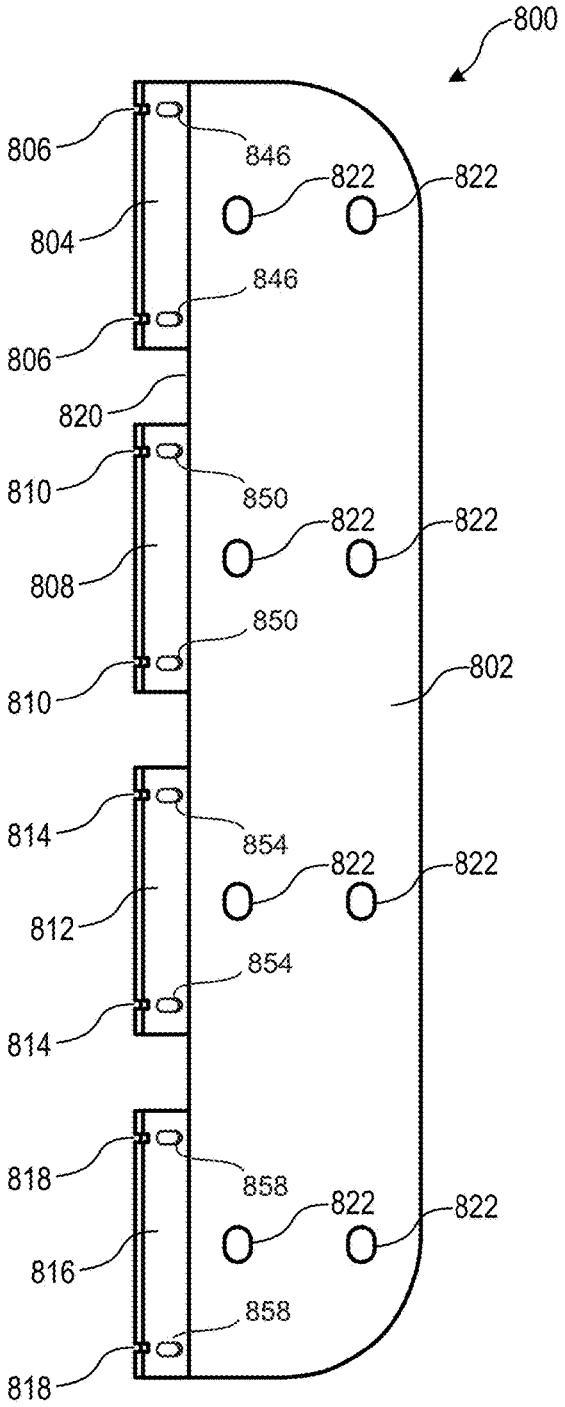
FIG. 8A is a front view of an embodiment of a standoff member having a plurality of standoff arms along a common edge.
Figure 8B:
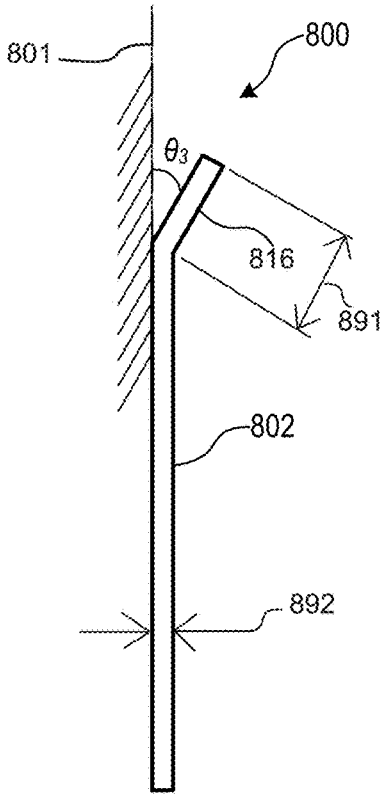
FIG. 8B is a side view of the embodiment of the standoff member having the plurality of standoff arms along the common edge.

FIGS. 8A and 8B are front and side views, respectively, of an embodiment of standoff member 800 with a plurality of standoff arms, which is suitable for supporting a plurality of elongated member segments. The standoff member 800 comprises a wall attachment base 802, which includes a plurality of apertures 822 formed therethrough to facilitate the passage of anchors, which can be used to mount the wall attachment base 802 to a wall 801. The wall attachment base 802 has thickness 892. The standoff member 800 further comprises standoff arms 804, 808, 812, 816 extending therefrom. In other embodiments, a different number of standoff arms may be used (e.g., one, two, three, five, etc.). In some embodiments, as illustrated, the standoff arms 804, 808, 812, 816 are disposed along a common edge 820 of the wall attachment base 802 and oriented with respect to the wall attachment base 802 at an angle $\theta_3$. When the standoff member 800 is in its installed state, this angle is in relation to the wall, and therefore also meaningful for non-planar wall attachment base embodiments. In some embodiments, one or more of the standoff arms may be oriented at different angles. Each of the standoff arms 804, 808, 812, 816 have length 891, yet in some embodiments may have differing lengths. Each of the standoff arms 804, 808, 812, 816 may have one or more slots 806, 810, 814, 818, respectively, formed therein for seating elongated member segments, and respective slots 846, 850, 854, 858 formed therein for coupling elongated member segments to the standoff arms, as will be shown.

Figure 9A:
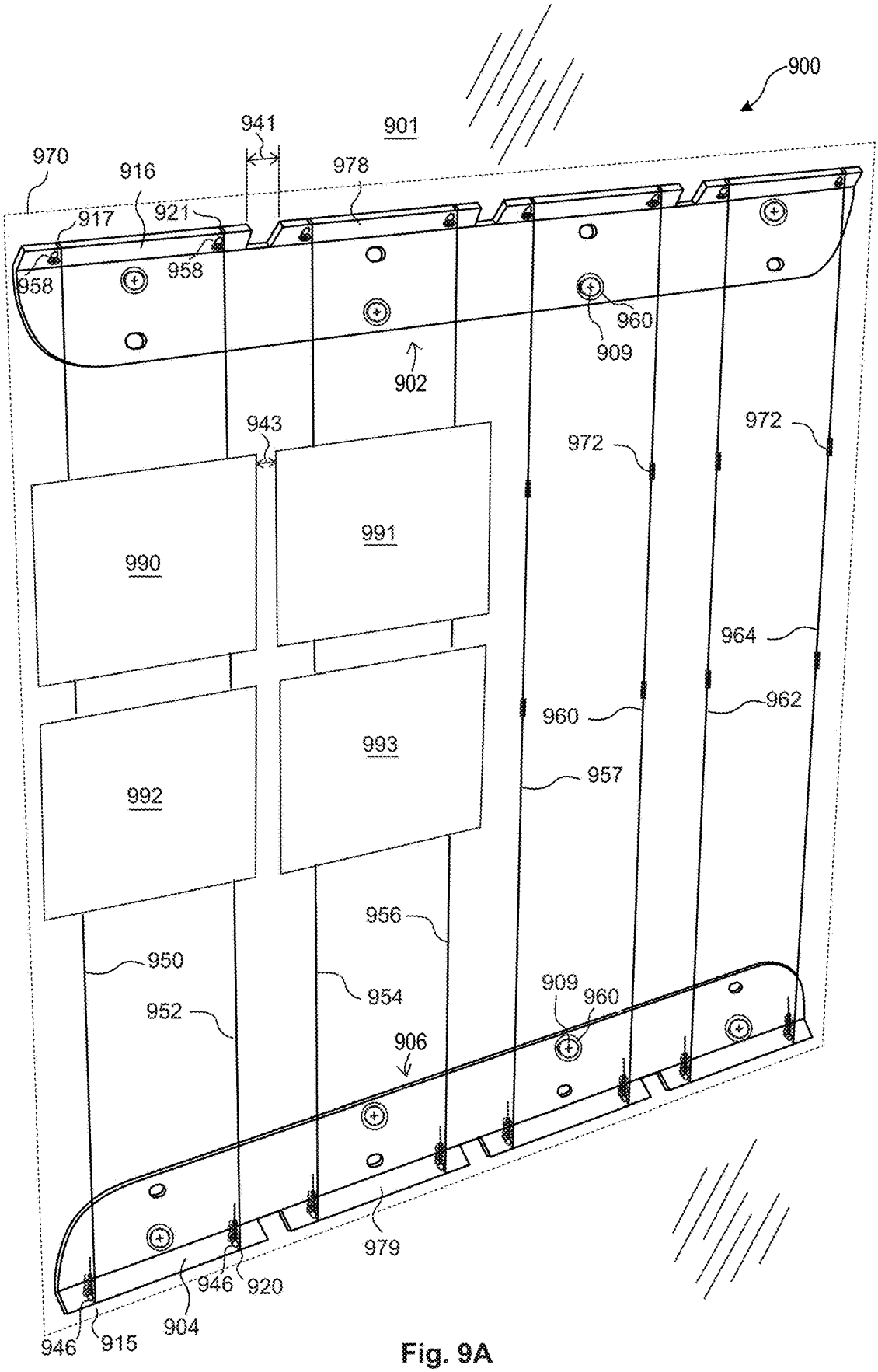
FIG. 9A illustrates a segmented display array assembled from standoff members each having a plurality of standoff arms.

FIG. 9A illustrates an embodiment of a segmented display array 900 assembled from a first standoff members 902 and, below and separate, a second standoff member 906. These standoff member embodiments 902, 906 may be the same or similar to the standoff member 800. Analogous to previous embodiments disclosed herein (e.g., FIGS. 4A, 4B, and 6A), the first and second standoff members 902, 906 are attached to a wall 901 via wall anchors 909 and washers 960. The first standoff member 902 has horizontally separated standoff arms, including respective horizontally separated first and second standoff arms 916, 978 which are separated by distance 941. The second standoff member 906 also has horizontally separated standoff arms, including respective horizontally separated first and second standoff arms 904, 979. Each standoff arm, including standoff arms 916, 978, 904, 979 have horizontally separated first and second connection points that are each positioned away from the wall 901. For example, standoff arm 916 has horizontally separated respective first and second connection points 917, 921. As another example, standoff arm 904 has horizontally separated respective first and second connection points 915, 920. This pattern continues for the remaining standoff arms.

An elongated member segment 950 is coupled between the first connection points 917, 915 of the first and second standoff arms 916, 904 of the first and second standoff members 902, 906. An elongated member segment 952 is coupled between the second connection points 921, 920 of the first and second standoff arms 916, 904 of the first and second standoff members 902, 906. This pattern is continued for all elongated member segments 950, 952, 954, 956, 957, 960, 962, 964 as illustrated, which are noted by way of non-limiting example to substantially lie in plane 970.

Two display panels 990, 992 are coupled to the first and second elongated member segments 950, 952. Two additional display panels 991, 993 are coupled to the third and fourth elongated member segments 954, 956 and are horizontally separated from the other two display panels 990, 992 by distance 943. These display panels 990, 991, 992, 993 together form a 2×2 array. Larger or smaller arrays can be formed, such as 1×2, 2×1, 2×3, 3×3, 4×4, 5×4, etc.

The coupling of the display panels 990, 991, 992, 993 to the elongated member segments 950, 952, 954, 956 is accomplished in this illustrative embodiment via sleeves 972 which are affixed to the elongated member segments 950, 952, 954, 956 (as illustrated elongated member segments 957, 960, 962, 964). Retention members are affixed to the rear sides of display panels 990, 991, 992, 993 (these are illustrated in detail later herein). These retention members are elastically releasable and serve to releasably couple the display panels 990, 991, 992, 993 to the elongated member segments 950, 952, 954, 956. Specifically, in this illustrative embodiment, the retention members serve to retain the elongated member segments laterally (with respect to the elongated member segments) yet allow free longitudinal translation, whereas the sleeves 972 serve to limit this longitudinal translation and therefore serve to register the retention members, and therefore the affixed display panels 990, 991, 992, 993, at longitudinal positions along the elongated member segments 950, 952, 954, 956. Other attachment hardware known in the art may be used instead of or in unison with that which is illustrated herein, such as permanent magnets, clips, alternate clamps, and many other options.

Tensioning assemblies similar in composition and/or function to the tensioning assembly 570 in FIG. 5B may serve for the embodiment of the segmented display array 900 correspondingly to retain and induce tension in elongated member segments 950, 952, 954, 956, 957, 960, 962, 964.

Figure 9B:
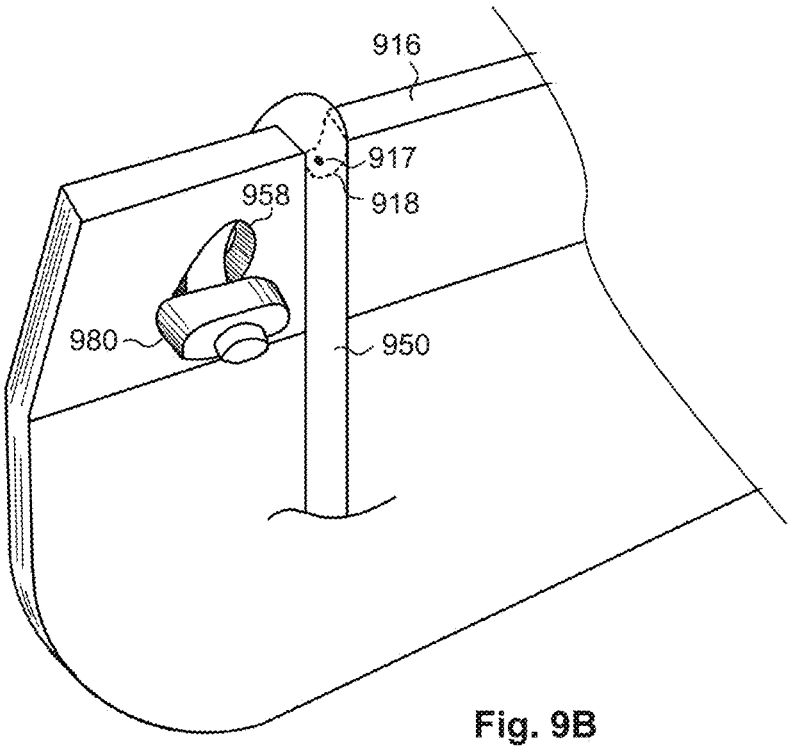
FIG. 9B shows a front perspective detail view of the upper end routing and coupling of an elongated member from the segmented display array assembled from standoff members each having a plurality of standoff arms.
Figure 9C:
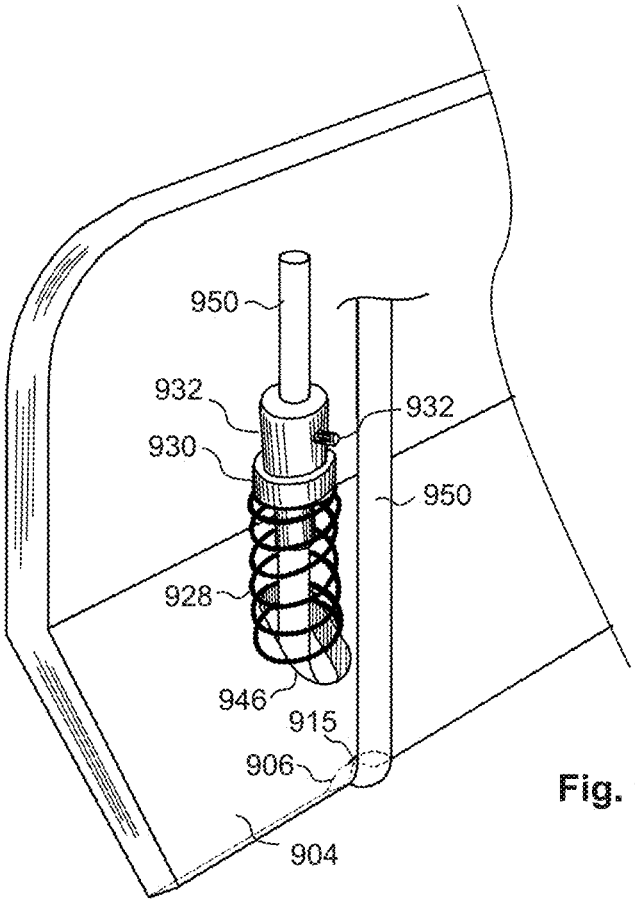
FIG. 9C shows a front perspective detail view of the lower end routing, coupling, and tensioning of the elongated member from the segmented display array assembled from standoff members each having a plurality of standoff arms.

To further illustrate the elongated member segment coupling and tensioning exemplified in the present segmented display array embodiment 900, attention is now directed to FIGS. 9B and 9C, which are close-up views of the respective upper and lower ends of the elongated member segment 950 shown in FIG. 9A. Focusing on FIG. 9B, the elongated member segment 950 is seen to wrap around the standoff arm 916 and to be seated in slot 918, which encourages stable positioning of the elongated member segment 950 along standoff arm 916 and establishes the connection point 917. The end of elongated member segment 950 is threaded through slot 958, which may also be a circular hole or another form of aperture, and is secured in place via terminal 980, which may be a crimped sleeve, clip, mechanical clamp, gripper (such as gripper 532 in FIG. 5A), crushed piece of metal, adhered material, or the like, which prevents the end of the elongated member segment 950 from passing back through slot 958. Note that terminal 980 may be applied to the end of elongated member segment 950 once elongated member segment 950 has been threaded through slot 958, or terminal 980 may be pre-installed on elongated member segment 950. In this second scenario, 958 is sized such that terminal 980 can be passed through in one or more specific relative orientations, while not passing through in others, thereby providing for stable coupling.

An embodiment of a tensioning assembly is illustrated for the lower end of elongated member segment 950 in FIG. 9C. The elongated member segment 950 wraps around standoff arm 904, is seated in slot 906 (establishing the connection point 915), and inserts through slot 946. A spring 928, flange washer 930, and gripper 932 thread on to the elongated member segment 950 (analogous to components 528, 530, 532 shown to thread on to elongated member segment 520 in FIG. 5A). During installation, with these components in place, and with some tension established in the elongated member segment 950 via pulling on its end while compressing the spring 928, clamping screw 932A is used to secure the gripper 932 to the elongated member segment 950, thereby providing sustained tension to elongated member segment 950. Additional descriptive information on the analogous tensioning assembly 570 of FIG. 5B is provided above.

Figure 9D:
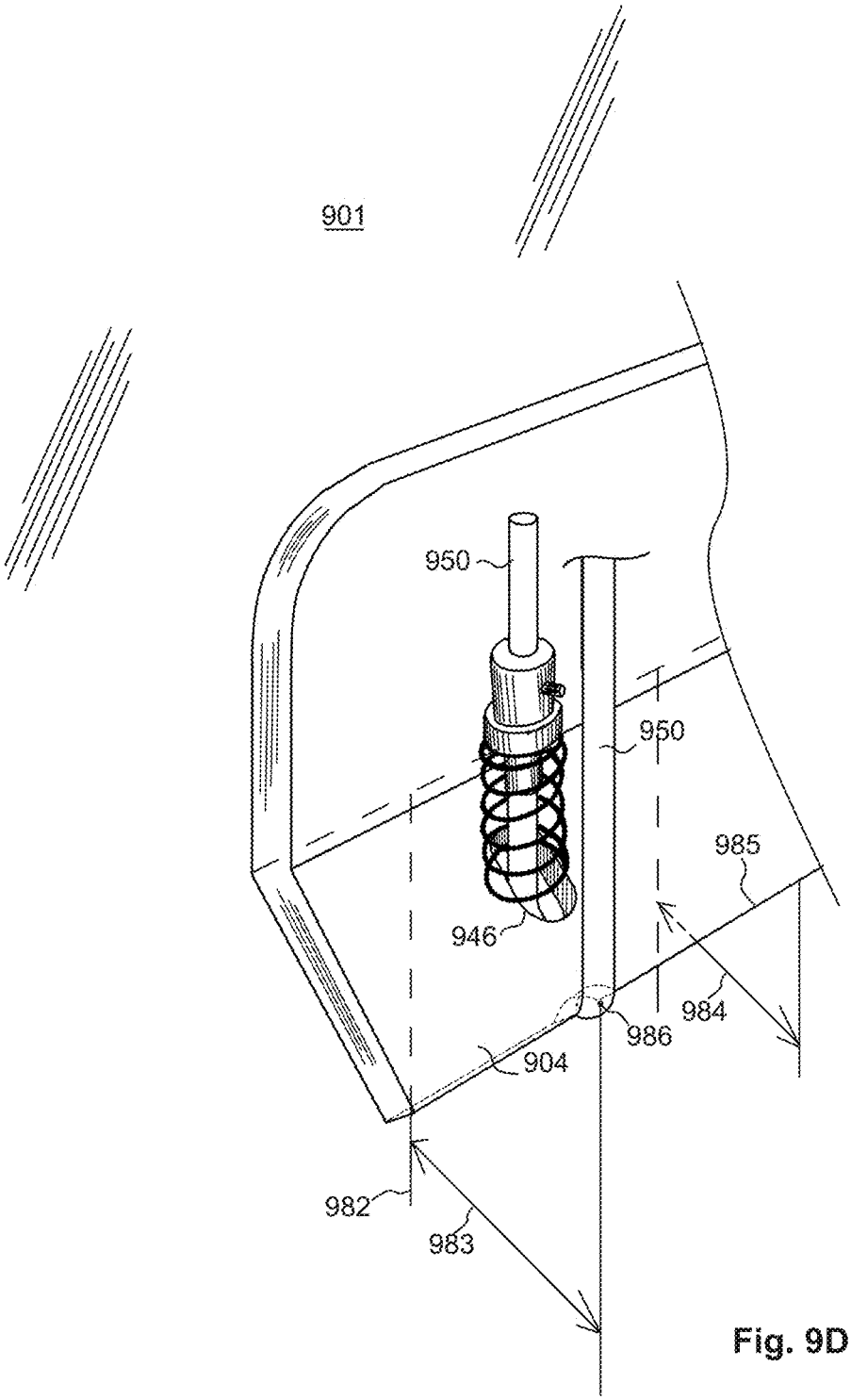
FIG. 9D shows the view of FIG. 9C where wall offset distances are indicated.

FIG. 9D shows how, in this illustrative embodiment, a portion 986 of elongated member segment 950 is as far (if not further) from the wall 901 (as indicated by dimension 983), as an edge 985 of the standoff arm 904 (as indicated by dimension 984).

Figure 9E:
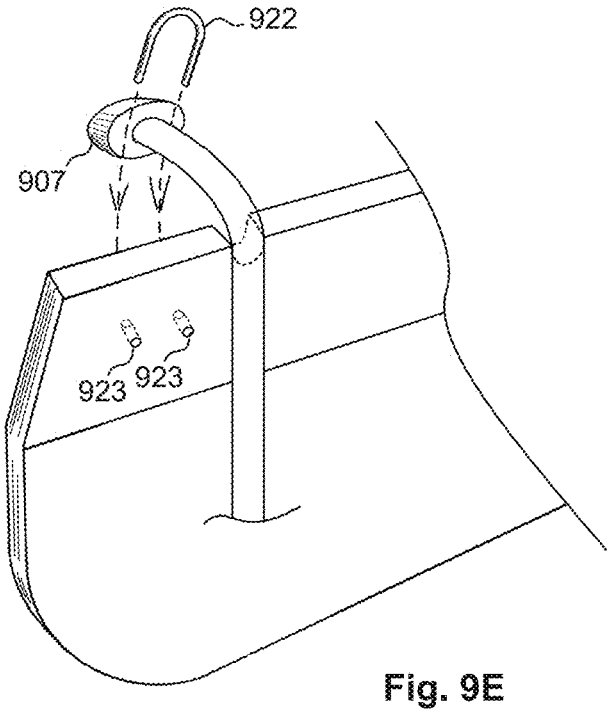
FIG. 9E shows an alternately routed and coupled elongated member segment at its upper end prior to final assembly.
Figure 9F:
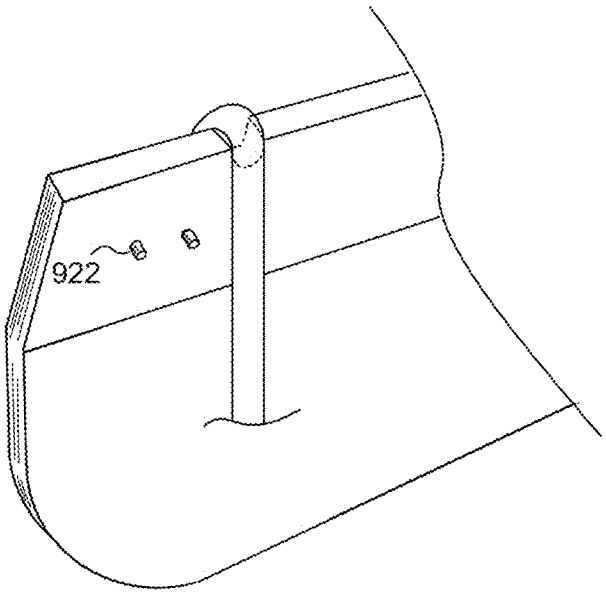
FIG. 9F shows the alternately routed and coupled elongated member segment at its upper end after being assembled.
Figure 9G:
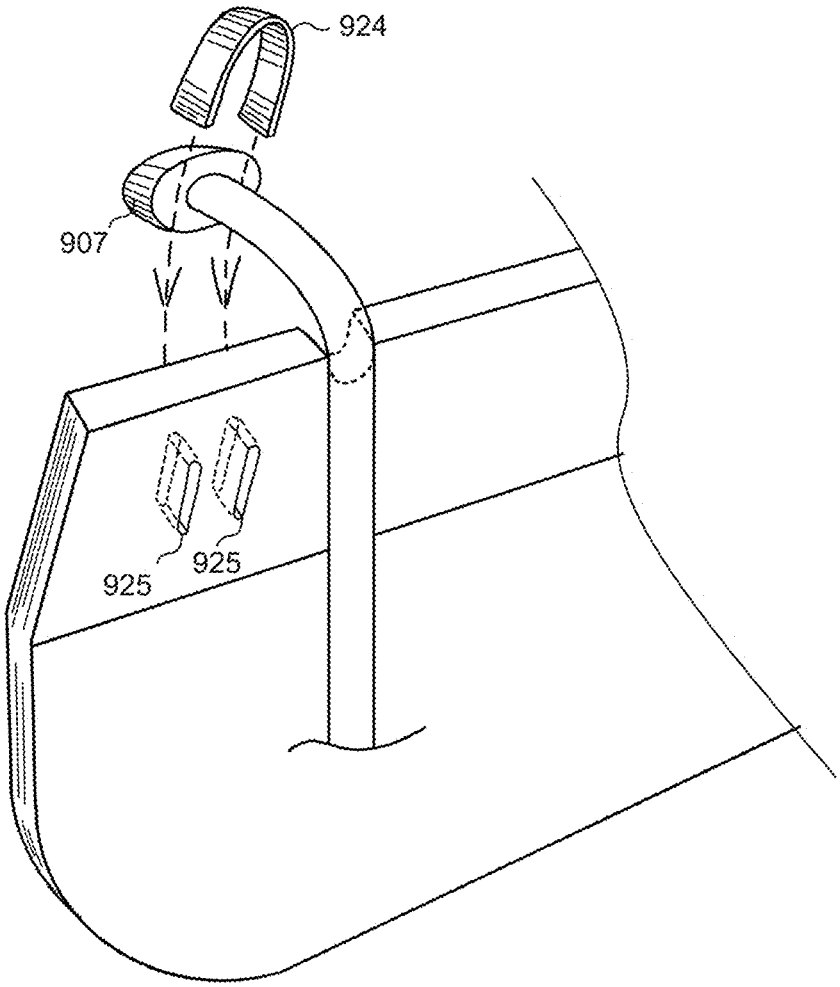
FIG. 9G shows another alternately routed and coupled elongated member segment at its upper end prior to final assembly.

While the present embodiment illustrates an approach for elongated member segment coupling and tensioning, it is emphasized that there exist many other approaches that achieve the same or similar results and fall within the scope of the present disclosure. For example, the compression spring 928 in FIG. 9C could be replaced by a flexure or set of flexures to correspondingly provide the tensioning force to the elongated member segment 950. Furthermore, returning to the coupling of the upper end of the elongated member segment 950 to the standoff arm 916, a u-shaped rod 922 and associated receiving holes 923 could be used to capture the elongated member segment terminal 907 as illustrated in the open position in FIG. 9E, and in the closed (i.e., coupled) position in FIG. 9F (compare with FIG. 9B). A capture band 924 and associated slots 925 could also be used for this coupling, as shown in FIG. 9G.

Figure 9H:
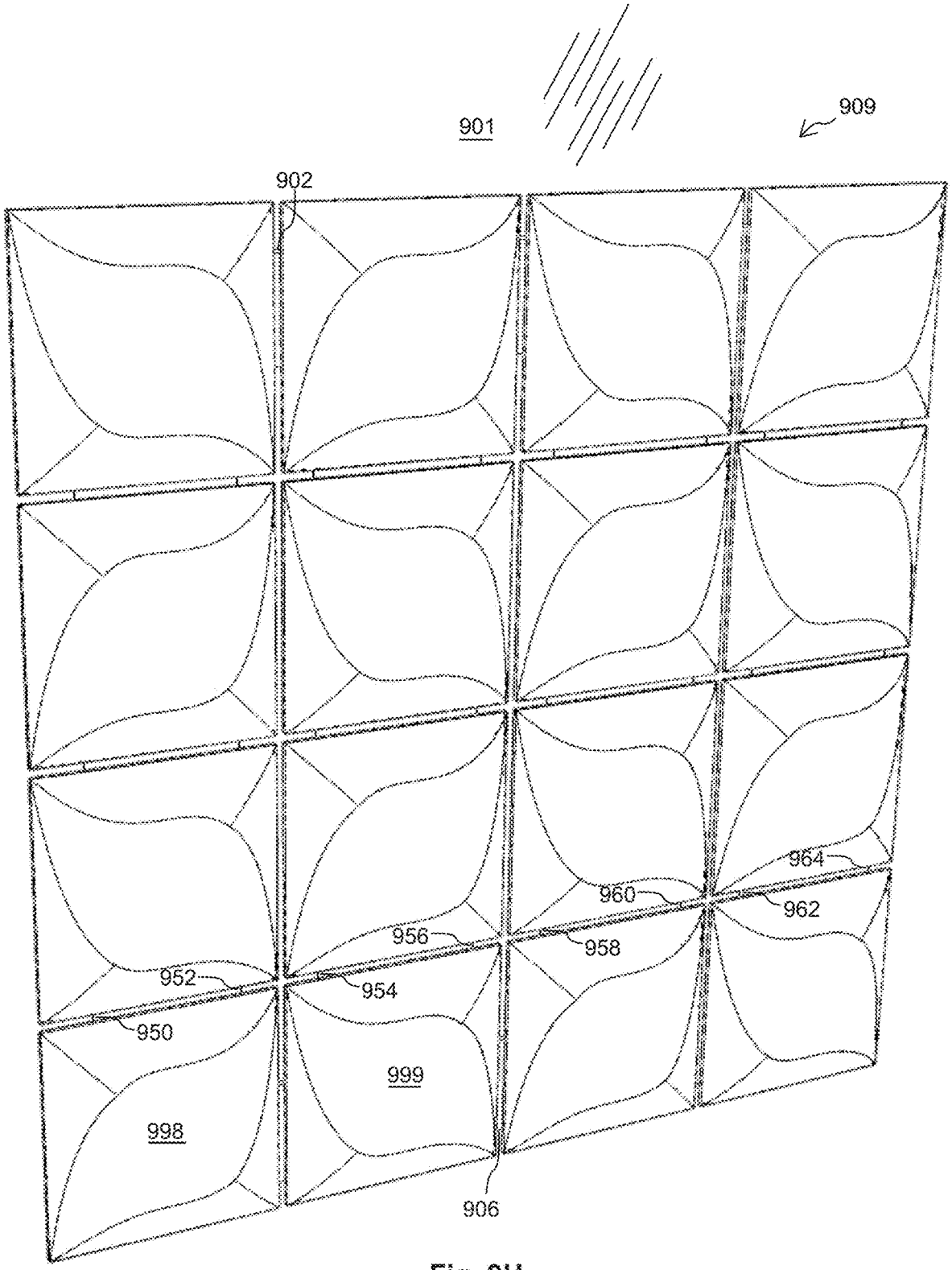
FIG. 9H shows an embodiment of a segmented display array incorporating sculptural panels.

FIG. 9H illustrates an embodiment of a segmented display array 909 with display panels that are sculptural in form and arranged in a 4×4 array. In particular, the sculptural display panels are of two types: display panel type A 998 and display panel type B 999. It can be seen that the wall-mounting hardware is low-visibility, as the standoff members 902, 906 and elongated member segments 950, 952, 954, 956, 958, 960, 962, 964 are the only visible elements, and this visibility is low.

Additional Embodiment Including Plurality of Standoff Arms

Figure 9I:
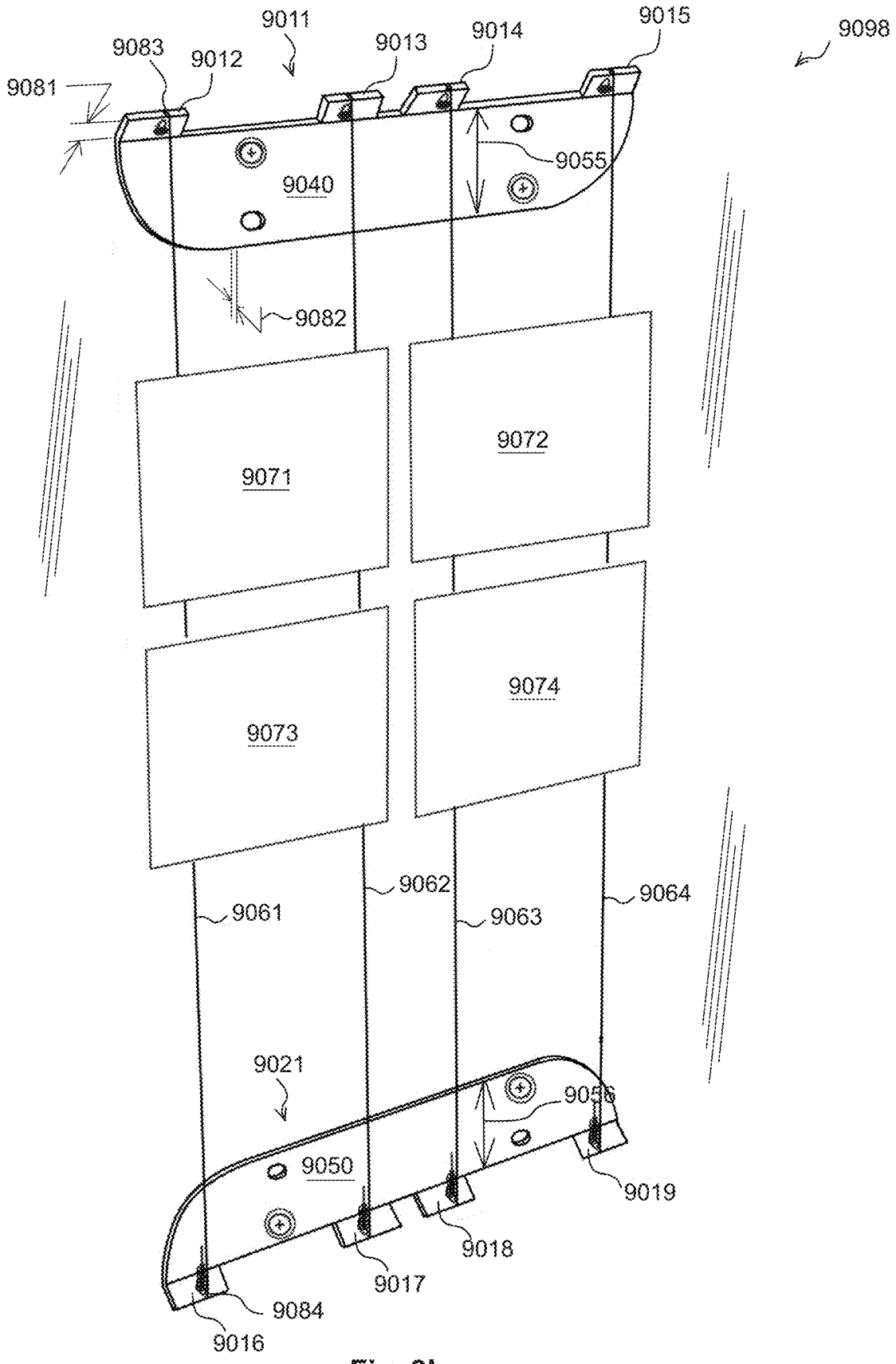
FIG. 9I is an embodiment of a segmented display array showing four elongated member segments and four pairs of opposing standoff arms.

Shown in FIG. 9I is an embodiment of a segmented display array 9098 where a first standoff member 9011 has first, second, third, and fourth standoff arms 9012, 9013, 9014, 9015, respectively. Additionally, a second standoff member 9021 has first, second, third, and fourth standoff arms 9016, 9017, 9018, 9019. The first standoff member 9011 has a wall attachment base 9040 with a thickness 9082. The first standoff arm 9012 associated with standoff member 9011 has a length 9081. The standoff arms 9012, 9013, 9014, 9015 associated with the standoff member 9011 each have one end coupled to the wall attachment base 9040. Similarly, the standoff arms 9016, 9017, 9018, 9019 associated with the standoff member 9021 each have one end coupled to the wall attachment base 9050. The wall attachment bases 9040, 9050 have respective vertical dimensions 9055, 9056 as shown. The standoff arms 9012, 9013, 9014, 9015 associated with the first standoff member 9011 position connection points away from the wall as indicated in FIG. 9I by the upper-most visible portions of respective first, second, third, fourth elongated member segment 9061, 9062, 9063, 9064, (see example connection point 9083) and as illustrated in detail an analogous system in FIG. 9B by connection point 917. The standoff arms 9016, 9017, 9018, 9019 associated with the second standoff member 9021 position connection points away from the wall as indicated in FIG. 9I by the lowest most visible portions of the elongated member segment 9061, 9062, 9063, 9064 (see example connection point 9084), and as illustrated in detail in an analogous system in FIG. 9C by connection point 915.

The first elongated member segment 9061 is coupled between the connection points 9083, 9084 of the first standoff arms 9012, 9016 of the first and second standoff members 9011, 9021. The second elongated member segment 9062 is coupled between the connection points of the second standoff arms 9013, 9017 of the first and second standoff members 9011, 9021. The third elongated member segment 9063 is coupled between the connection points of the third standoff arms 9014, 9018 of the first and second standoff members 9011, 9021. The fourth elongated member segment 9064 is coupled between the connection points of the fourth standoff arms 9015, 9019 of the first and second standoff members 9011, 9021.

Two display panels 9071, 9073 are coupled to the first and second elongated member segments 9061, 9062. Two additional display panels 9072, 9074 are coupled to the third and fourth elongated member segments 9063, 9064.

Embodiment Including Large Capture Bands

Figure 10:
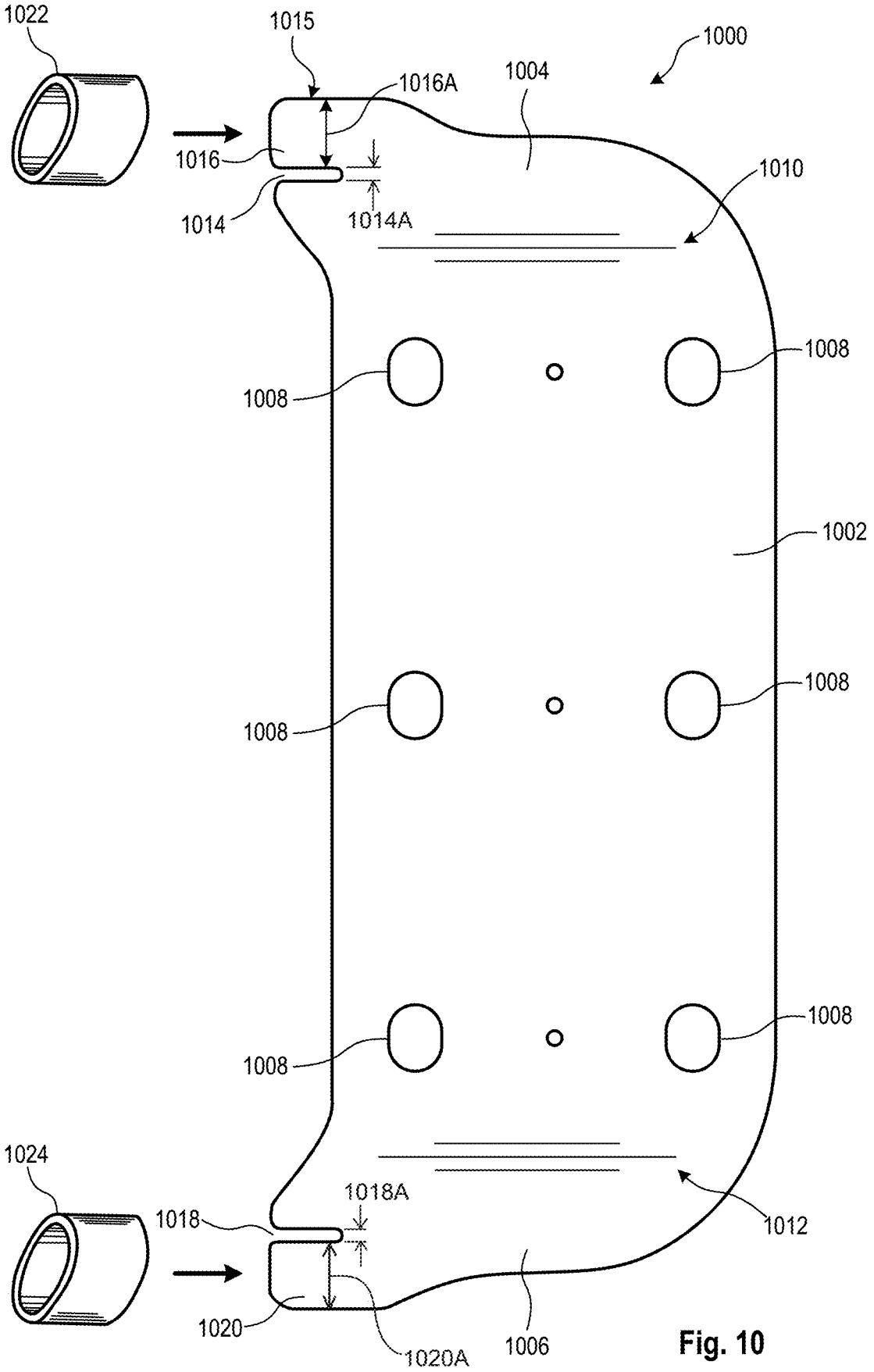
FIG. 10 is an embodiment of a standoff member that is capable of coupling to large capture bands.

FIG. 10 is an embodiment of a standoff member 1000 that is capable of coupling to large capture bands 1022, 1024. The standoff member 1000 comprises a wall attachment base 1002 and standoff arms 1004, 1006 that form joints 1010, 1012, respectively, with the wall attachment base 1002. The wall attachment base 1002 includes a plurality of slotted apertures 1008 formed therethrough to allow the passage of anchors, which can be used to mount the wall attachment base 1002 to a wall.

The standoff arms 1004, 1006 each have slots 1014, 1018, respectively, formed therein, to which elongated member segments may be coupled as discussed herein. In order to accommodate larger capture bands 1022, 1024, ligaments 1016, 1020 adjacent to the slots 1014, 1018, respectively, are sized accordingly. For example, the ligament 1016 may have a width 1016A (from an outer-most internal edge of the slot 1014 to an outer edge 1015 of the standoff arm 1004) that is from 0.25 to 0.75 inches. A width 1020A on the opposing side ligament 1020 may be similarly sized. The larger capture bands 1022, 1024 can take on the form of hallow cylinders or, as illustrated in FIG. 10, may be laterally elongated in one direction, akin to partially crushed hallow cylinders. This latter approach allows them to seat closely to respective ligaments 1016, 1020 (as illustrated in FIG. 4B, in relation to capture bands 424, 434).

The use of large capture bands provides a greater load capacity for the standoff arms 1004, 1006 given the greater widths 1016A, 1020A. Also, the ligaments 1016, 1020 have a lower chance of being bent when the standoff member 1000 is in transit or is inadvertently dropped.

Embodiment Including Elastically Releaseable Retention Members

Figure 11A:
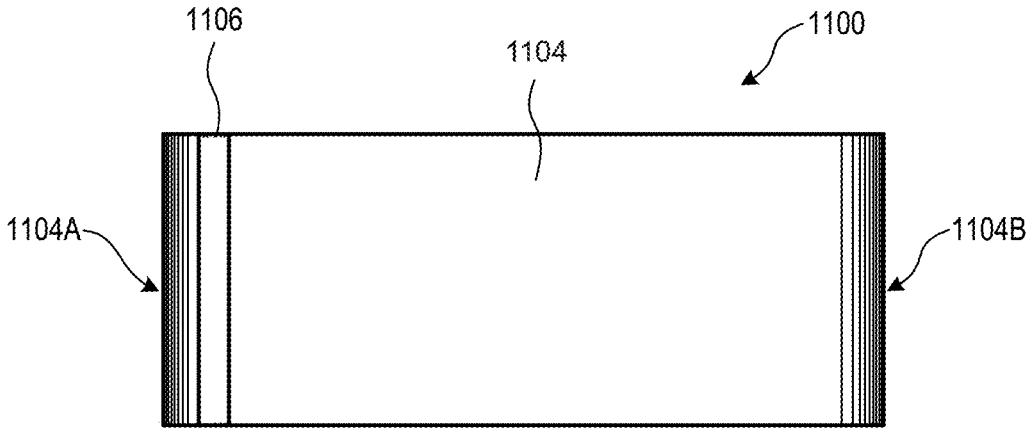
FIG. 11A is a front view of an embodiment of a retention member.
Figure 11B:
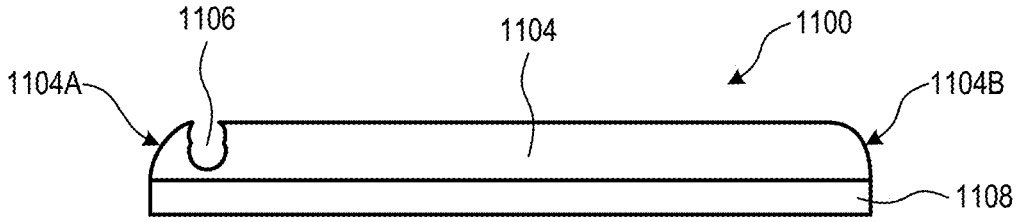
FIG. 11B is a side view of the embodiment of the retention member.
Figure 11C:
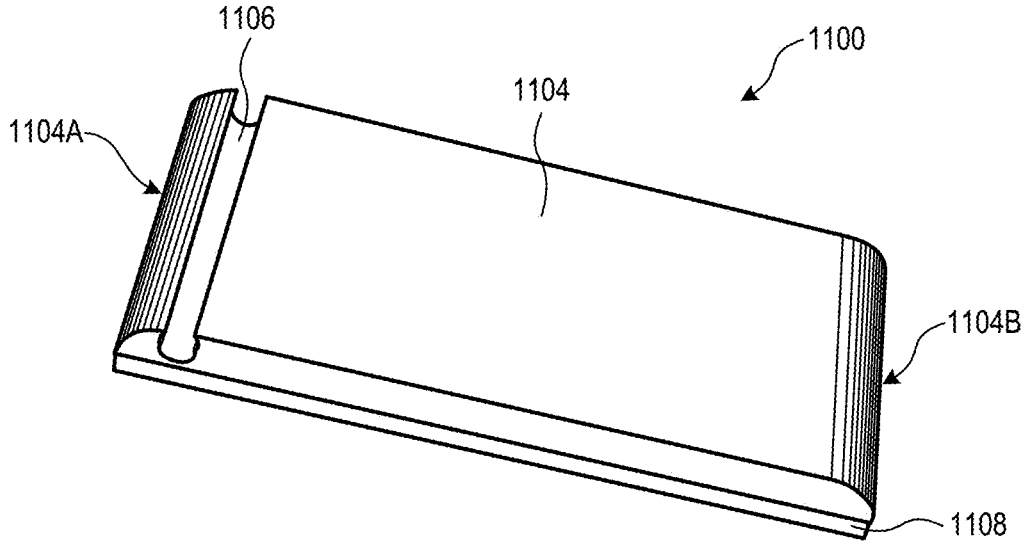
FIG. 11C is a perspective view of the embodiment of the retention member.

Examples of retention members include clamps, finger-releasable clamps, tool-free-releasable retention members, alligator clips with elastically-opposing halves, magnets, clips, and more. Here an embodiment of a retention member akin to those shown elsewhere in the present disclosure (744, 745, 791, 792, 793, 794) is presented to provide greater illustrative insight. Specifically, FIGS. 11A-11C show front, side, and perspective views, respectively, of an elastically releasable retention member 1100. The retention member 1100 comprises a body 1104, which may be made of a polymer such as polyethylene, polypropylene, polyvinyl chloride, or other suitable polymer that provides the necessary durability and elasticity, as will be illustrated. Type I polyvinyl chloride has been found to be particularly well-suited for this application. The body 1104 has a slot 1106 formed therein with an opening that is more narrow than its nominal width. Slot 1106 is thus sized to allow passage of a given elongated member segment by elastically flexing to receive the elongated member segment, and then elastically flexing to release it. A force is required for this. The body 1104 has rounded edges 1104A, 1104B, which aid in the elongated member segment mate-up process. In some embodiments, the retention member 1100 includes an adhesive layer 1108, which can be used to adhere the retention member 1100 to a rear surface of a display panel, for example. As an example of a suitable adhesive layer 1108, VHB foamed acrylic tape by 3M may be used, as could other adhesive products known to those skilled in the art.

Figure 12A:
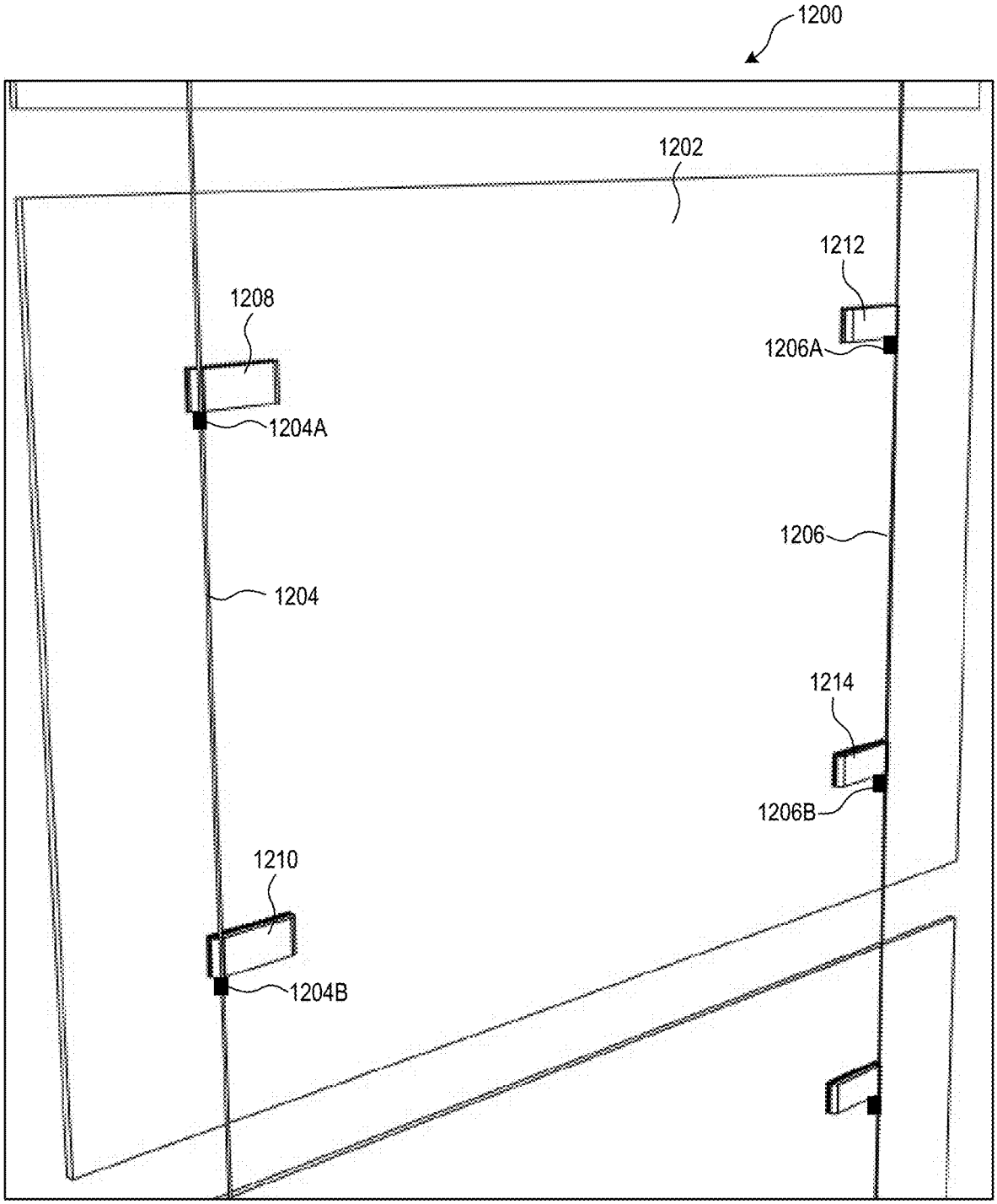
FIG. 12A is a perspective view of a rear portion of a display array.

FIG. 12A is a perspective view of a rear portion of segmented display array 1200. The segmented display array 1200 includes a display panel 1202 and elongated member segments 1204, 1206. Elastically releasable retention members 1208, 1210, 1212, 1214 are affixed to the rear surface of the display panel 1202, and are the same as or similar to the retention member 1100. The retention members 1208, 1210 are elastically releasable akin to retention member 1100, and retain elongated member segment 1204 laterally (with respect to the elongated member segment 1204 direction), and the retention members 1212, 1214 are also elastically releasable akin to retention member 1100 and retain elongated member segment 1206 laterally, thus securing the display panel 1202 to the segmented display array 1200. That is, display panel 1202 is releasably coupled to elongated member segments 1204, 1206 and therefore is releasably coupled to the segmented display array 1200. The retention members 1208, 1210, 1212, 1214 are sized to allow free longitudinal translation (i.e. sliding) of the elongated member segments 1204, 1206. The elongated member segments 1204, 1206 therefore have sleeves 1204A, 1204B, 1206A, 1206B affixed thereto that are sized larger than the diameter of the elongated member segments 1204, 1206 to limit this longitudinal translation (sliding). That is, the sleeves 1204A, 1204B, 1206A, 1206B register the respective retention members 1208, 1210, 1212, 1214 (and therefore the display panel 1202) in their shown longitudinal position along the elongated member segments 1204, 1206. To put it yet another way, the sleeves 1204A, 1204B, 1206A, 1206B prevent the display panel 1202 from sliding along the elongated member segments 1204, 1206 due to the force of gravity. These sleeves may be the same as, or similar to, their identically named counterparts of FIGS. 4A, 6A, 7A, and 9A. It is appreciated in the present exemplary embodiment shown in FIG. 12A that, to support the weight of the display panel 1202, all four sleeves 1204A, 1204B, 1206A, 1206B need not be present. For example, sleeves 1204B, 1206B could be eliminated, and the display panel 1202 could still be successfully supported (remaining sleeves 1204A, 1206A would bear the weight of the display panel 1202, analogous to how display panel 7031 is supported in FIG. 7A). In this same respect, all retention members 1208, 1210, 1212, 1214 need not be present for successful support of display panel 1202. For example, a display panel can have just two affixed retention members that releasably couple the display panel to a pair of elongated member segments.

Figure 12B:
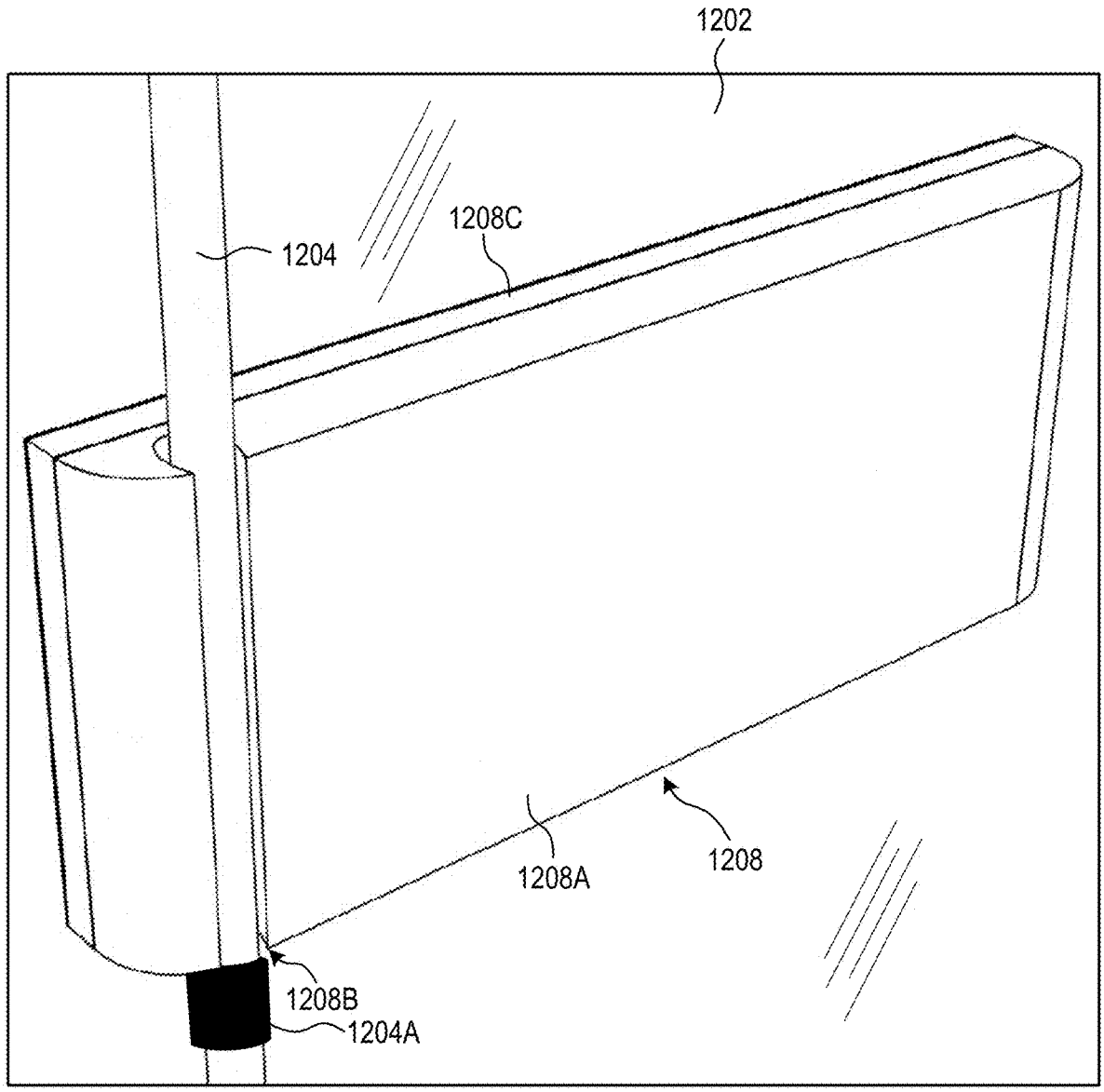
FIG. 12B is a perspective view of a retention member coupled to an elongated member segment.

FIG. 12B is a perspective close-up view of the elongated member segment 1204 coupled to the elastically releasable retention member 1208. A slot 1208B within a body 1208A of the retention member 1208 retains the elongated member segment 1204. In particular, the body 1208 is made of an elastic material and the opening of slot 1208B is smaller than the diameter of elongated member segment 1204. Thus slot 1208B elastically widens to receive elongated member segment 1204 when the two are pressed together. The slot 1208B is sized to allow longitudinal translation of the elongated member segment 1204 therewithin (i.e. sliding), while retaining it otherwise. An adhesive layer 1208C on a rear surface of the body 1208A adheres the retention member 1208 to the display panel 1202. Sleeve 1204A registers the retention member body 1208A, limiting its sliding along the longitudinal direction of elongated member segment 1204. The retention member 1208 is elastically releasable in the sense that, provided sufficient separation force is applied between the elongated member segment 1204 and the retention member 1208, the elongated member segment 1204 will elastically widen the opening of slot 1208B and the elongated member segment 1204 will be released. FIGS. 7D and 7E show side views of retention members 744, 745 which retain elongated member segment 724. These retention members 744, 745 are noted to not have corresponding sleeves against which they abut (this occurring elsewhere for the respective display panels), and simply serve the purpose of retaining the elongated member segment 724 (in the lateral sense).

Figure 12C:
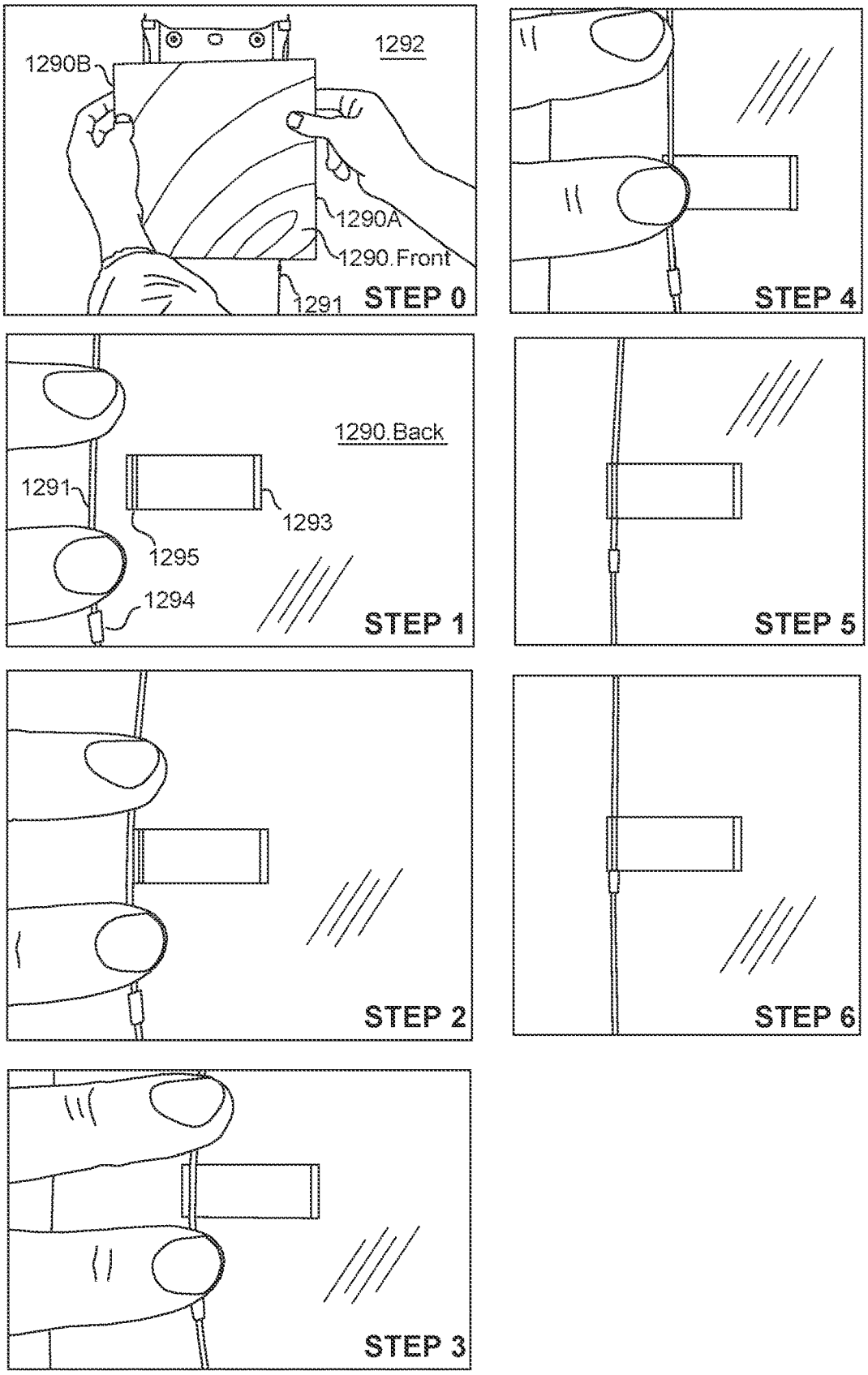
FIG. 12C presents a step-by-step sequence showing the coupling process of a retention member to an elongated member segment.

To illustrate the process of coupling a display panel (such as display panel 1202) to an elongated member segment (such as elongated member segment 1204), FIG. 12C shows a step by step sequence. It is noted that in this illustrative embodiment the retention members are affixed to a rear face of the associated display panel, thus blind mate-up, done by feel, must be accomplished. This is done as follows.

Step 0: shows the first-person view of how a display panel 1290 is releasably coupled to an elongated member segment 1291. The remaining steps are shown as though looking through the back of a wall 1292.

Step 1: with the display panel 1290 held using both hands (at vertical left and right edges 1290A, 1290B), the elongated member segment 1291 is approached and received with middle and pointer fingers and pressed into the back of the display panel 1290 to the outside of the retention member 1293, as shown in the Step 1 image of FIG. 12C.

Step 2: the elongated member segment 1291 is pressed inward from the display panel 1290 edge until it contacts the retention member 1293 as shown.

Step 3: the elongated member segment 1291 is pressed up and over the rounded edge of the retention member 1293 until it aligns with a slot 1295.

Step 4: The elongated member segment 1291 is firmly pressed into the slot 1295; an audible click is heard and a toggle-like snap-through is felt.

Step 5: the elongated member segment 1291 is now laterally retained by the retention member 1293 but is allowed free longitudinal translation. The above steps are repeated for all retention members associated with the display panel 1290.

Step 6: The weight of the display panel 1290 is released and the sleeves (such as sleeve 1294) affixed to the elongated member segments serve to limit longitudinal translation of the elongated member segments with respect to the retention members, and register the retention members (and hence the affixed display panel 1290) at the desired longitudinal position along the elongated member segments.

As a final note, display panel removal is accomplished by slipping ones fingers between the elongated member segment 1291 and display panel 1290, and using a gentle prying force to elastically open the slot 1295 in the retention member 1293, therefore releasing the elongated member segment 1291.

Embodiment Including Magnetically Releasable Retention Members

Figure 12D:
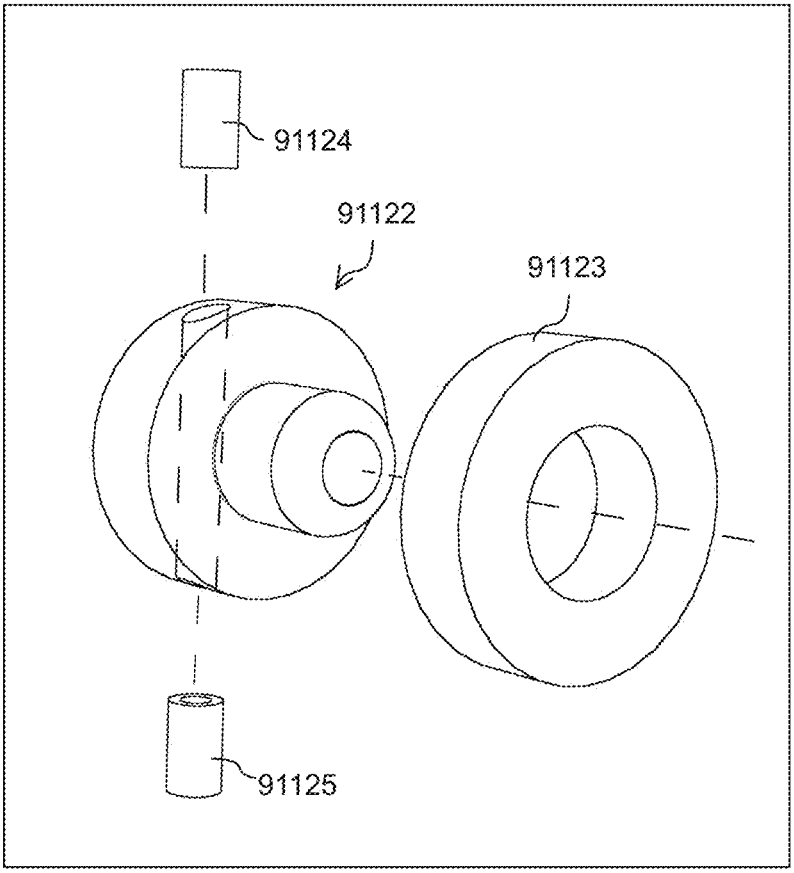
FIG. 12D Exploded front perspective view of dual magnet coupling assembly with retaining pin.

Some embodiments of segmented display arrays include permanent magnets for coupling display panels and elongated member segments. An illustrative embodiment of magnetically releasable retention members is pictorially shown in FIGS. 12D-12K. Here, a dual magnet coupling assembly is illustrated. Referring to FIG. 12D, an exploded front perspective view of an embodiment of a dual magnet coupling assembly is shown (where the elongated member segment is not including for clarity). Here the magnet carrier 91122 receives magnet 91123 with retaining pin 91126 (FIG. 2E) which has rounded region 91127 and associated base 91129. The magnet 91123 can be glued, for example, to the base 91129 of the magnet carrier 91122. The magnet carrier 91122 can be made from several materials bonded together or can be a unitary machined or molded material, with plastic being a suitable choice in many applications. The base 91129 has a hole 91128 therethrough to allow passage of an elongated member segment, as shown by dotted lines in magnet carrier 91122 side view in FIG. 12F.

Figure 12E:
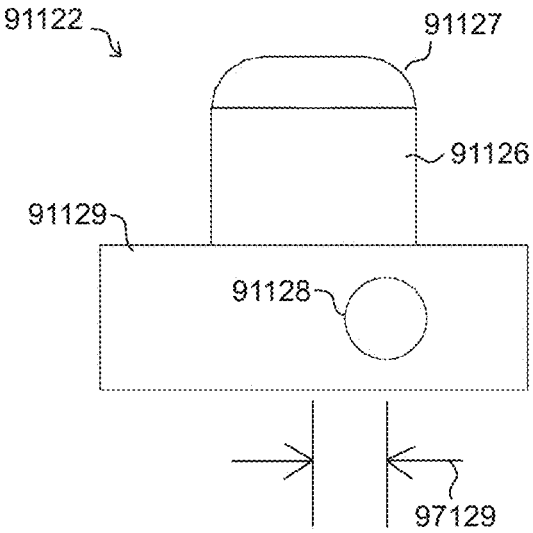
Figure 12F:
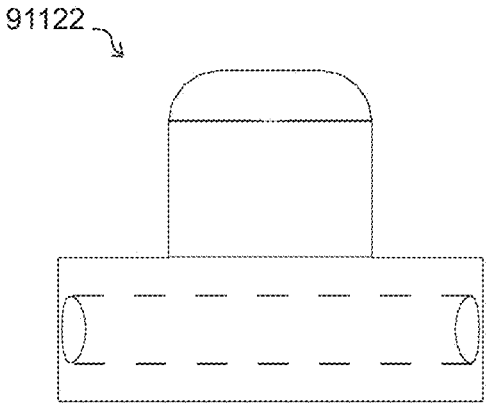
Figure 12G:
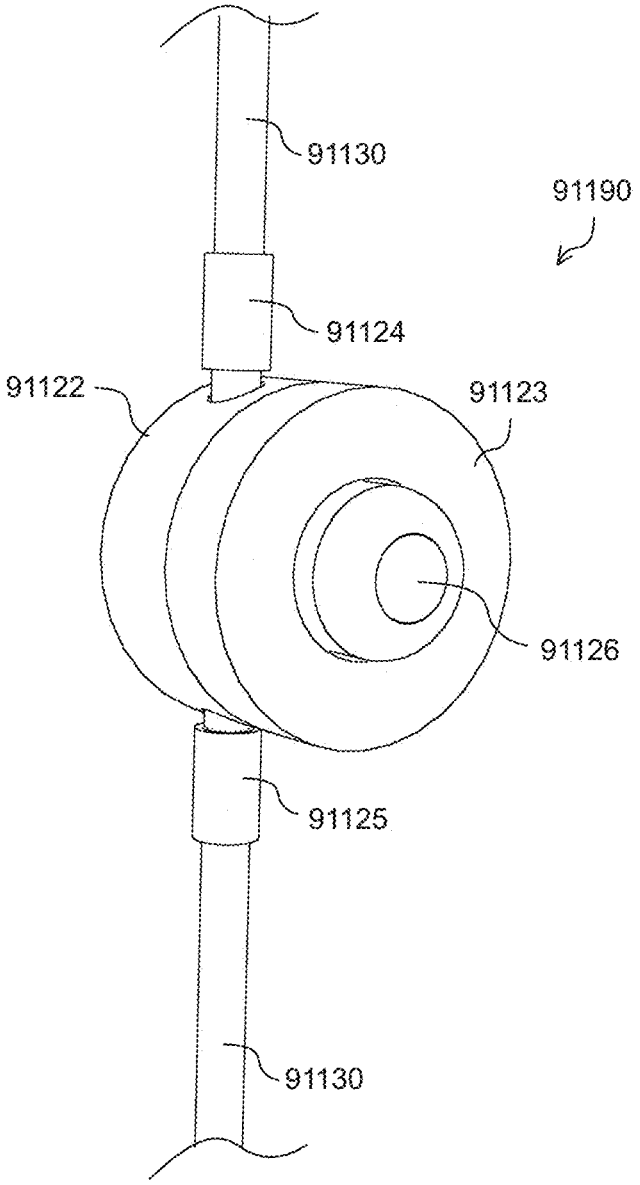
Figure 12H:
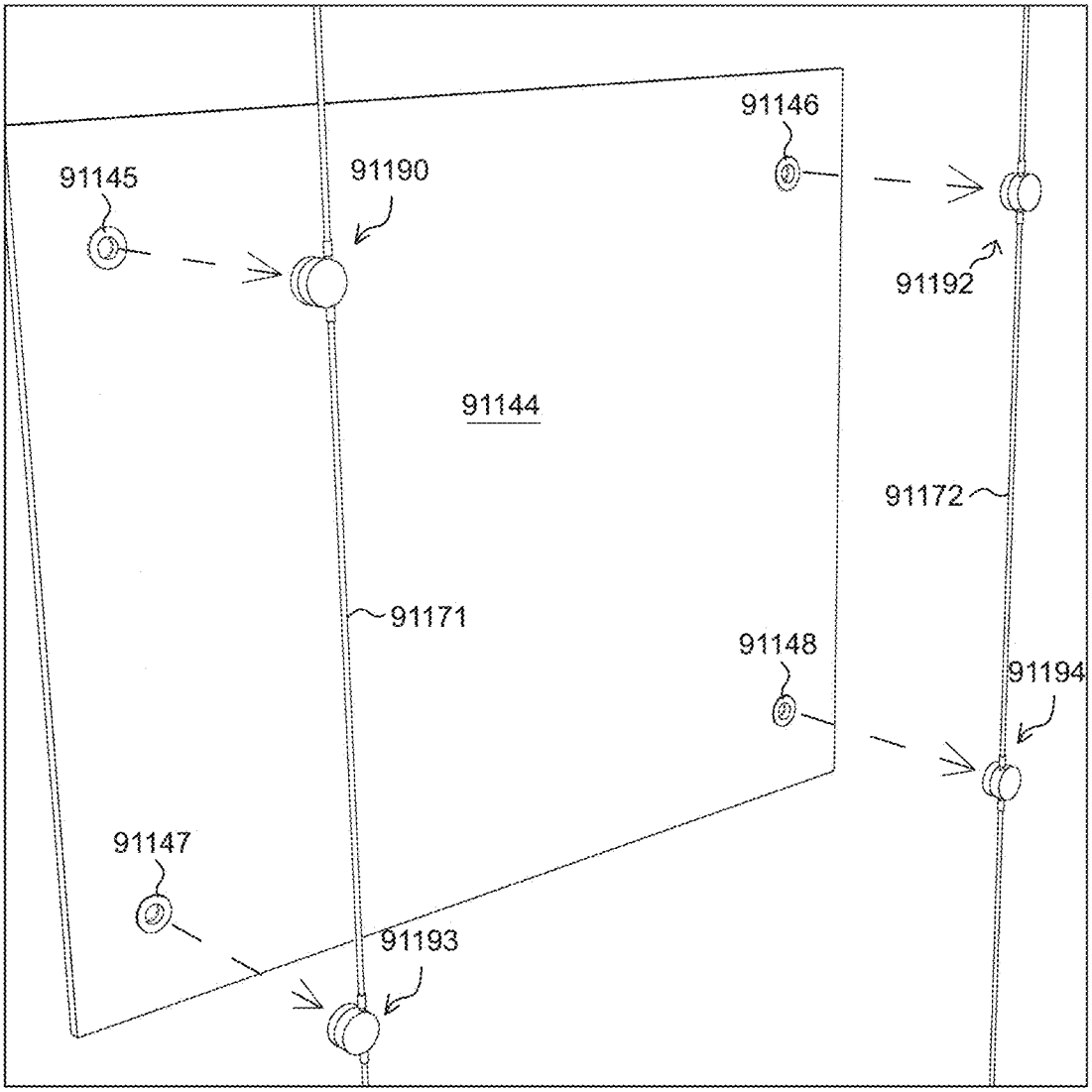
Figure 12I:
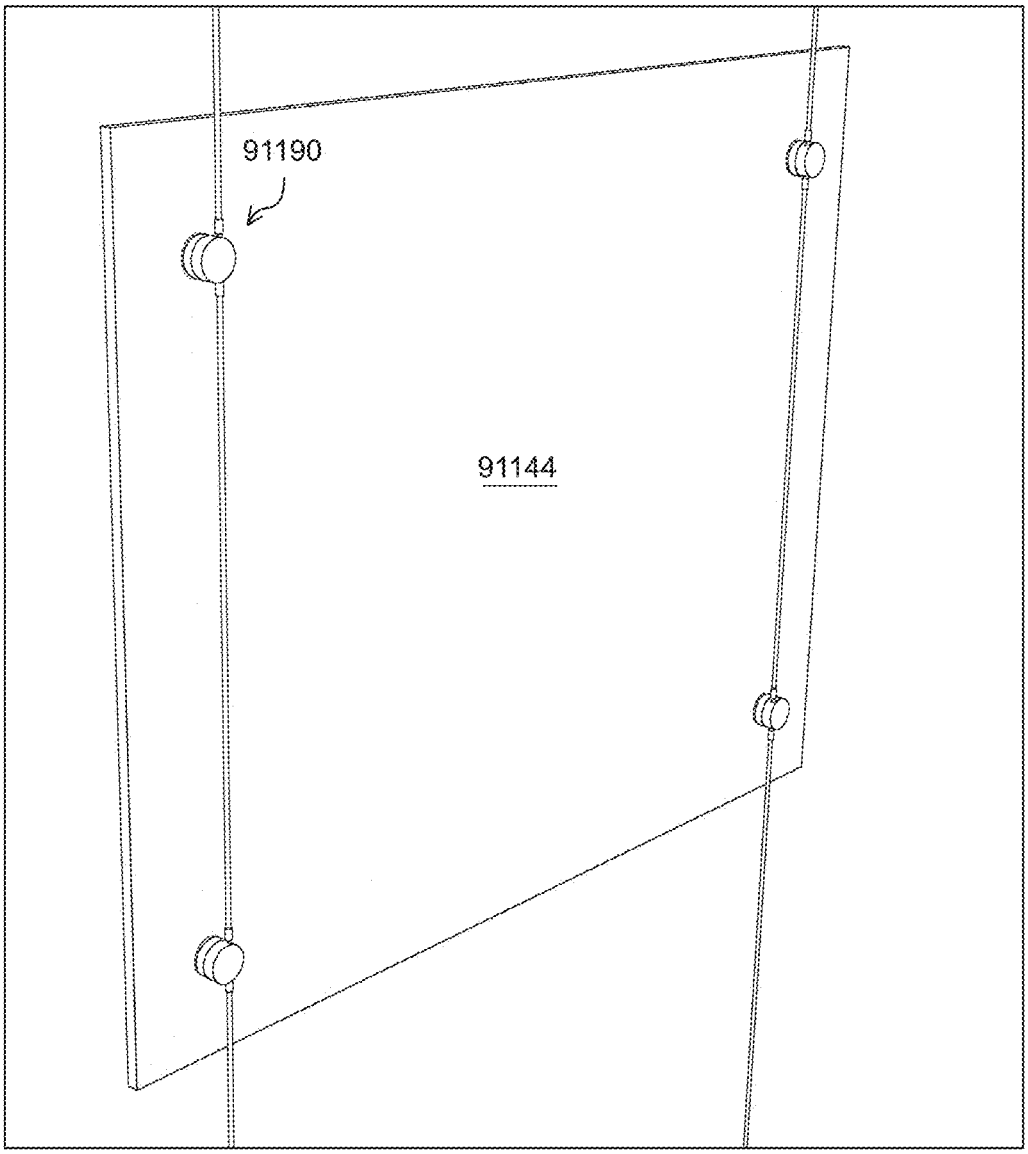
Figure 12J:
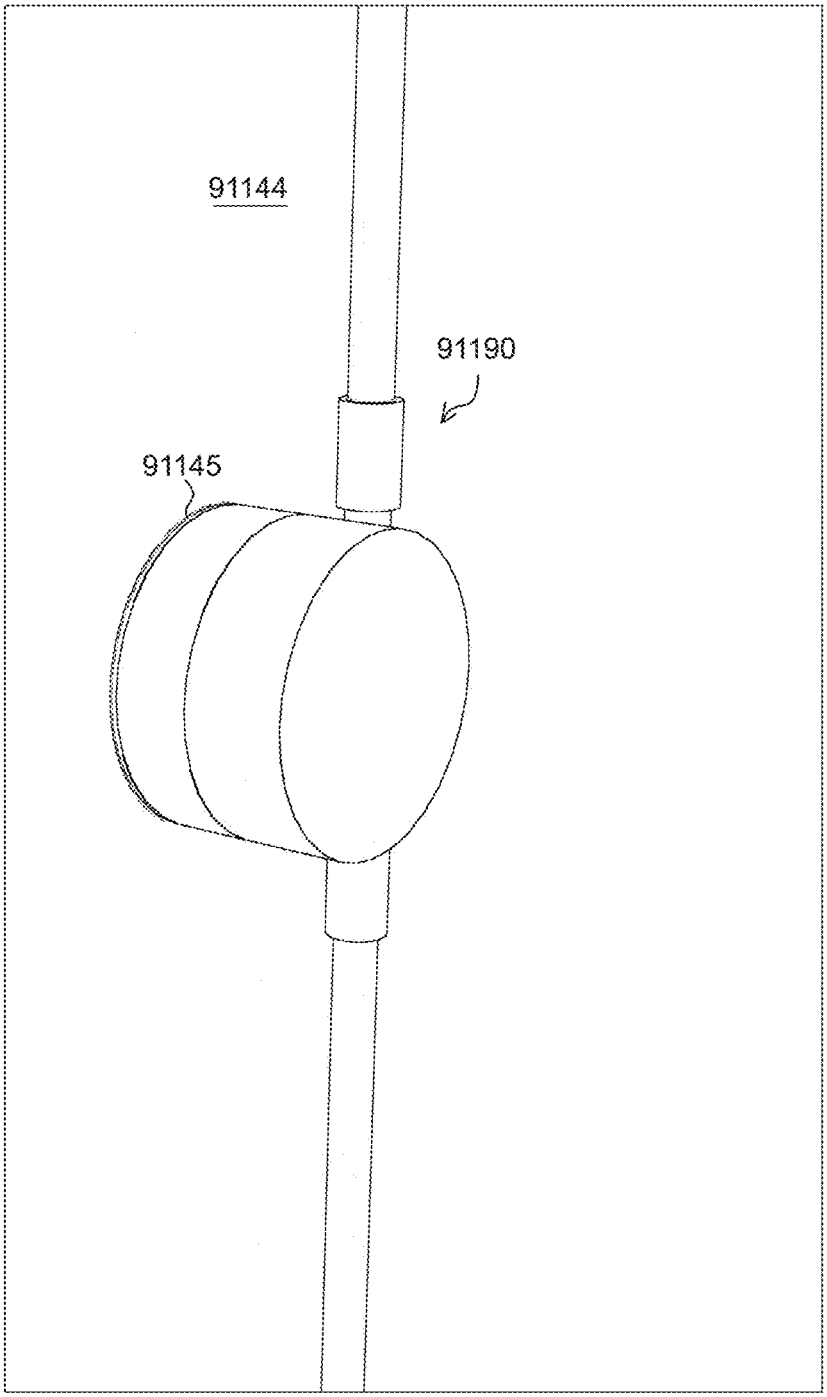
Figure 12K:
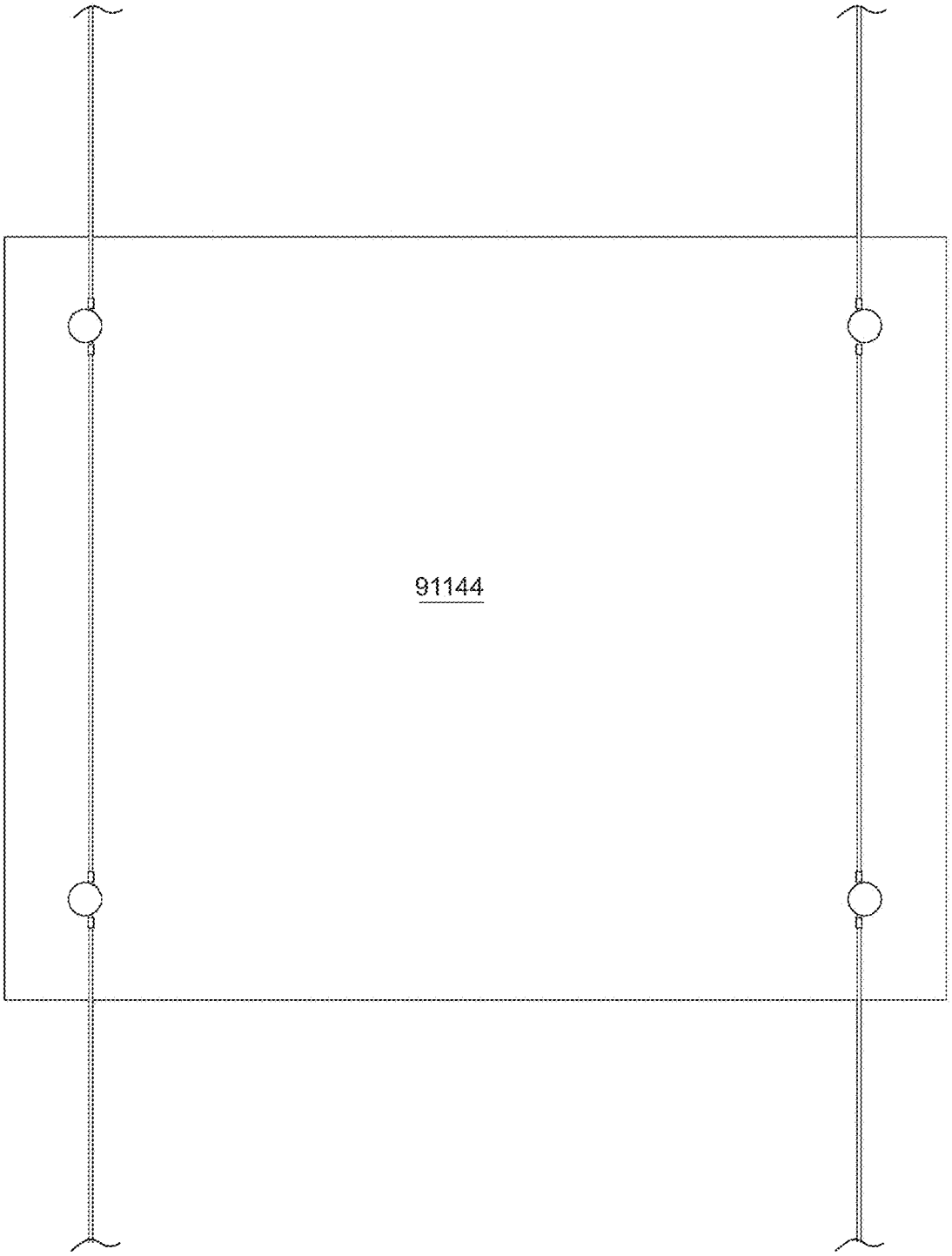

Sleeves 91124 and 91125, visible in FIG. 12D and in the full assembly drawing in FIG. 12G, limit the sliding of the magnet carrier assembly 91190 (which comprises of the magnet carrier 91122 and associated magnet 91123) on an associated elongated member segment 91130. Consistent with the teaching of the present disclosure, examples of sleeves 91124, 91125 numerous and include crimped metal, solidified epoxy, and wrapped foil or wrapped plastic material, to name a few. The lower sleeve 91125 performs the role of preventing the magnet carrier assembly 91190 from sliding down elongated member segment 91130 due to gravity (and especially when mated with a coupling magnet and loaded with display panel weight). Both sleeves 91124, 91125 ensure the magnet carrier assembly 91190 maintains a short range of free sliding motion along elongated member segment 91130 such that the magnet carrier assembly 91190 is free to rotate on the elongated member segment 91130 (and therefore can rotated into a mated position and engage when a coupling magnet is presented) but will not vertically escape mating by rotating around to a repulsion state and moving away vertically. The retaining pin 91126 is noted to protrude past the magnet 91123 and is designed to insert into a second magnet similar or the same as magnet 91123, such as a second magnet 91145 partially embedded in (and bonded to) a display panel 91144 as shown in FIG. 12H. Magnets 91123 and 91145 are situated in their respective assemblies with regard to pole direction such that they attract one another in their intended mated state, which is shown in FIG. 12I. The rounded region 91127 of the retaining pin 91126 facilitates ready mate-up of corresponding magnet sets, such as that shown in FIG. 12I and a close up of this in FIG. 12J. The presence of retaining pin 91126 facilitates load transfer across the coupled set of exemplary magnets 91123, 91145, resisting the tendency of panel weight to shear (slide) the coupled magnet pair 91123, 91145 past each other. Thus the retaining pin acts as a shear pin, increasing the load carrying capacity of the magnetically releasable retention member (i.e., allowing for heavier display panels). Four magnetically releasable retention member assemblies can be used to hold each panel, as shown in FIG. 12I, and optionally more or less can be used, such as two such assemblies in some cases and size such assemblies in others.

The through hole 91128 in the base 91129 of magnet carrier 91122 is noted to be off-center with respect to the base 91129, as seen in FIGS. 12D and 12E, by the dimension 97129. The ratio of this dimension 97129 to the magnet carrier base 91129 radius can vary from 0% to 50%, and for some through hole 91128 diameters more, with a range from 10% to 40% found to perform well, and a range of 30% to 35% to be of particular desirability. This offset dimension 97129 aids in preventing the occurrence of mating magnet pairs establishing an equilibrium condition of repulsion, where a magnet carrier flips around 180° and the magnet pair intended to mate do not. The off-center routing of the magnet carrier on the elongated member segments is shown in a rear view of full panel mate-up shown in FIG. 12K.

Many different magnets known in the art can be used for the magnetically releasable retention members, including neodymium magnets, and a great many alternate configurations of the illustrative embodiment presented here are within the spirit and scope of the present disclosure, such as departing from circular magnets, not requiring magnets on both mating elements (for example, a magnet could be just on one side of a given coupling, and a ferromagnetic material on the other), alternate retaining pin embodiments, and the like.

Demonstrative Hardware Visibility

Figure 13:
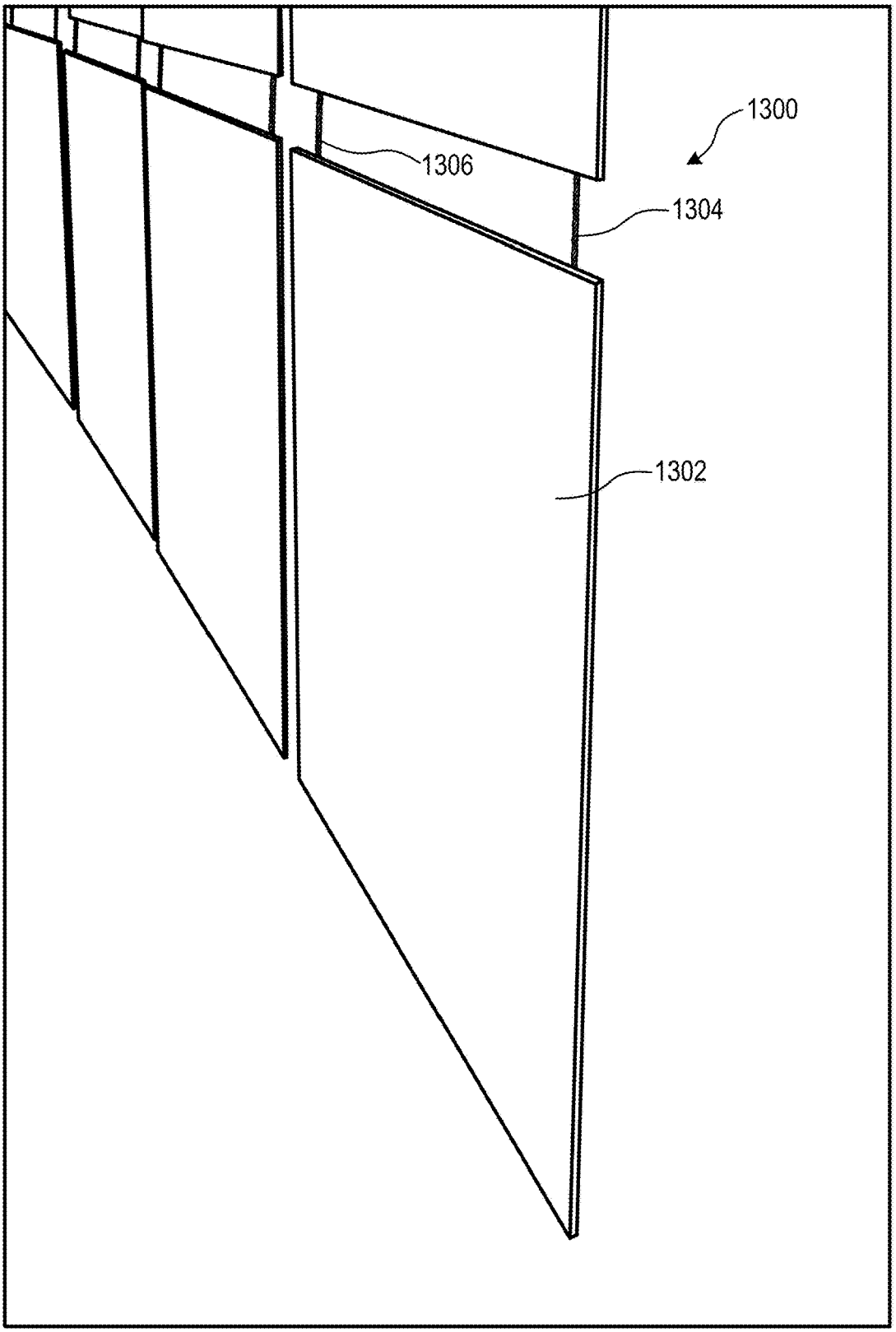
FIG. 13 is a perspective view illustrating an extreme line of sight angle of a segmented display array.

Without being bound by theory, a viewer is considered who is positioned directly in front of display panel 7033 shown in FIG. 7A. In this starting position, the viewer's line of sight is 90° to the display panel 7033 surface and his view of this display panel 7033 would appear similar to that of FIG. 7B, wherein the display panel 7033 fully obstructs the view of the underlying support hardware (including the associated standoff member 712, as shown in FIG. 7A). When the viewer repositions himself such that his line of sight is 0° (i.e. parallel) to the display panel 7033 surface, his view of the underlying support hardware is unobstructed, and may appear as depicted in FIG. 7E. In between these two line of sight extremes, there exists a transition angle at which the hardware goes from being obscured by the display panel 7033 to being just visible. To minimize hardware visibility, it is desirable for this transition angle to be as small as possible. The standoff member embodiment 712 makes allowance for this in that its wall attachment base 7002 is towards the center of display panel 7033 (as seen in FIG. 7A), it is made of a thin material (as illustrated in FIG. 7E), and the associated standoff arms 7090, 7091 extend distally from the wall attachment base 7002 at compound angles. FIG. 13 illustrates an embodiment of a segmented display array 1300 where a display panel 1302 successfully conceals underlying hardware even at a relatively low line of sight angle.

Assembling a Segmented Display Array

Figure 14:
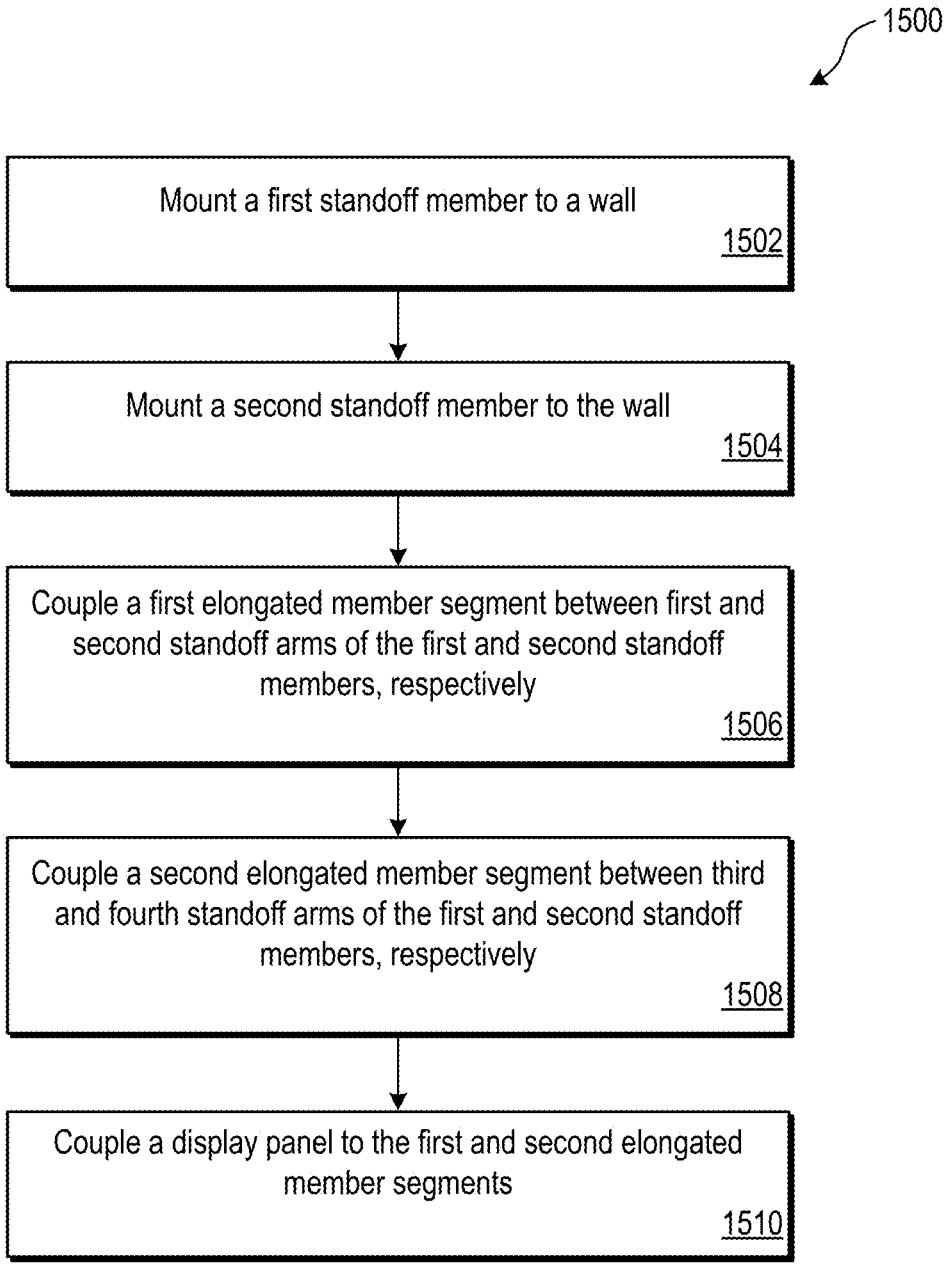
FIG. 14 is a flow diagram illustrating a method for assembling a segmented display array in accordance with embodiments of the present disclosure.

FIG. 14 is a flow diagram illustrating a method 1500 for assembling a segmented display array in accordance with one or more embodiments of the present disclosure. The method 1500 begins at block 1502, where a first standoff member is mounted to a wall (e.g., the standoff member 702 of FIG. 7A). At block 1504, a second standoff member is mounted to the wall, such as the standoff member 708, which is below and separate from the first standoff member 702.

At block 1506, a first elongated member segment (e.g., elongated member segment 714) is coupled between the first standoff arms of the first standoff member (e.g., standoff member 702) and the second standoff member (e.g., standoff member 708). In some embodiments, the coupling comprises coupling a first end of the first elongated member segment to a first slot formed in the first standoff arm of the first standoff member (e.g., standoff member 702), and coupling a second end of the first elongated member segment to a first slot formed in the first arm of the second standoff (e.g., standoff member 708).

In some embodiments, the first elongated member segment comprises a terminal disposed at the first end, and coupling the first end of the first elongated member segment to the first slot comprises inserting the first end of the first elongated member segment through a first capture band, and inserting a portion of the first capture band into the first slot such that the first elongated member segment is retained along a first edge of the first standoff arm of the first standoff member.

In some embodiments, coupling the second end of the first elongated member segment comprises: inserting the second end of the first elongated member segment through a second capture band; inserting a portion of the second capture band into the first slot in the first standoff arm in the second standoff member such that the first elongated member segment is retained along a first edge of the first standoff arm of the second standoff member; and coupling a tensioning assembly to the first elongated member segment, wherein the tensioning assembly comprises a spring that induces tension in the first elongated member segment between the first standoff arms of the first and second standoff members.

Similarly, at block 1508, a second elongated member segment (e.g., the elongated member segment 716) is coupled between the second standoff arms of the first and second standoff members, respectively.

At block 1510, at least one display panel (e.g., display panel 1202) is coupled to the first and second elongated member segments (e.g., via retention members 1208, 1210, 1212, 1214) as described in detail above.

It is to be understood by one of ordinary skill in the art that one or more of the blocks of the method 1500 may be combined, performed simultaneously, or performed in a different order than shown. This method 1500 may be repeated as many times as necessary to fully install a given segmented display array.

Kit Embodiment

In some embodiments, a kit for assembling a segmented display array comprises, for example, a plurality of display panels, a plurality of elongated member segments, a plurality of standoff members (which may correspond to any of the standoff members described herein), and components for coupling the elongated member segments to the standoff members, such as capture bands and any of the tensioning assemblies described herein. In some embodiments, for example, one or more of the standoff members may comprise a planar wall attachment base having a plurality of apertures formed therethrough to allow passage of anchors to mount the standoff member to the wall; and two standoff arms extending from each planar wall attachment base, the standoff arms each having a slot formed therein for coupling to one of the plurality of elongated member segments, wherein at least a portion of the standoff arm is planar. The kit may further comprise anchors, washers, retention members, adhesives (e.g., adhesive layers, liquid adhesives), magnets, mechanical clips (e.g., alligator clips), or other suitable components for assembling the segmented display array.

Display Panel Sculptural Embodiments

Figure 15A:
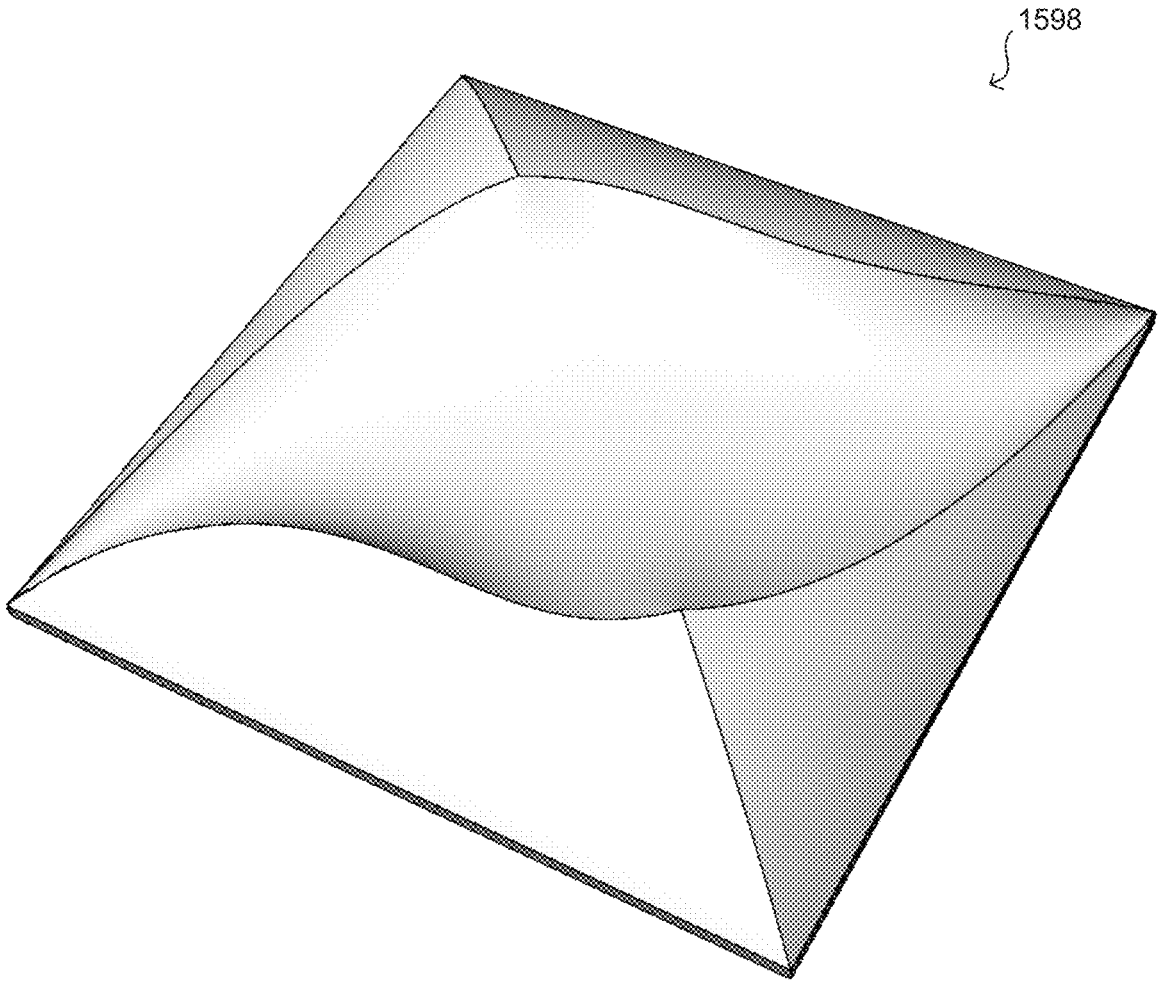
FIG. 15A is a front perspective view of a first embodiment of a sculptural display panel.
Figure 15B:
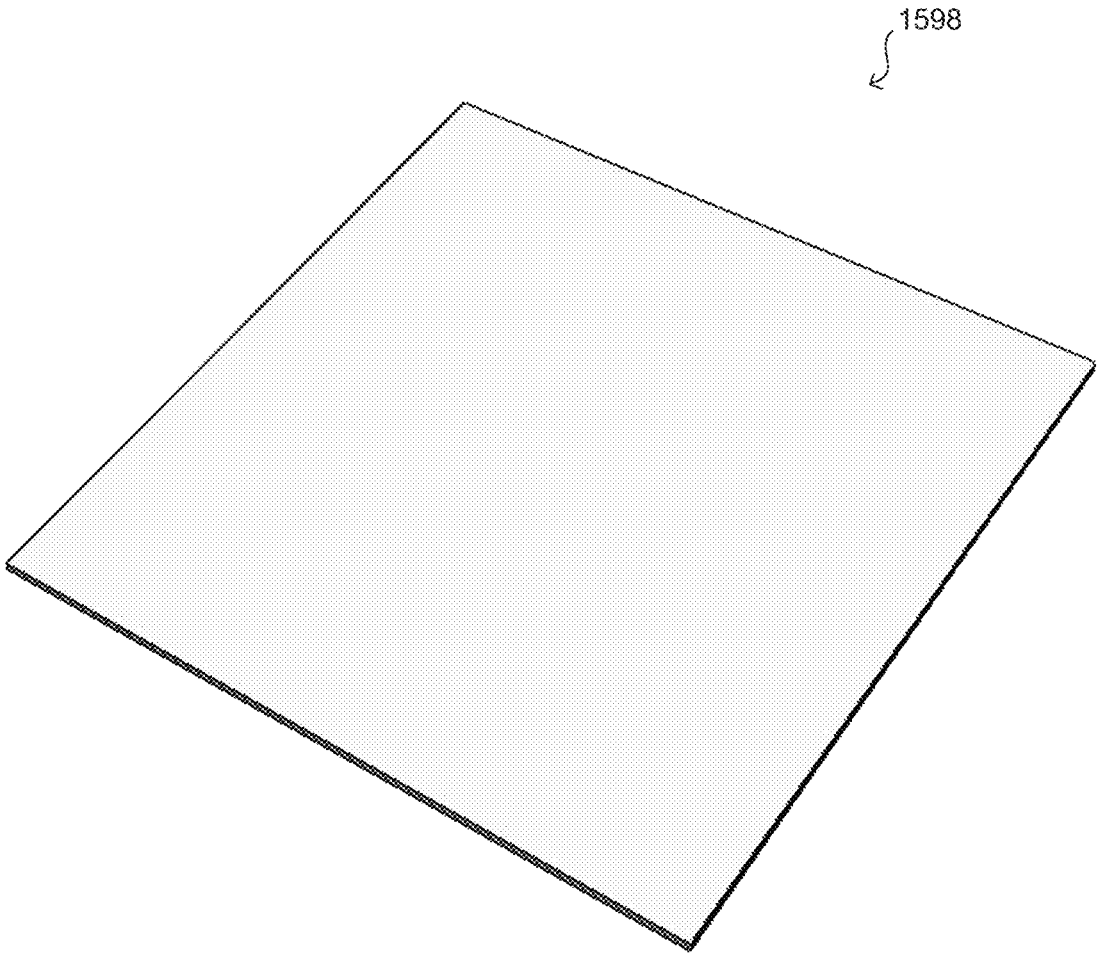
FIG. 15B is a rear perspective view of the first embodiment of the sculptural display panel.
Figure 15C:
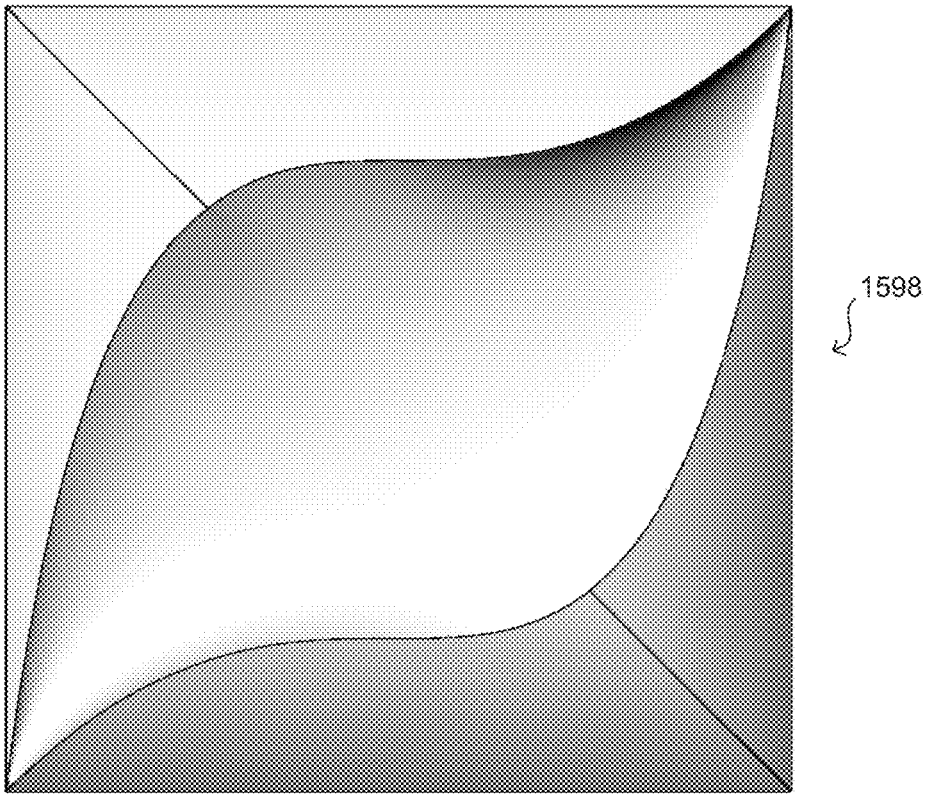
FIG. 15C is a front view of the first embodiment of the sculptural display panel.
Figure 15D:
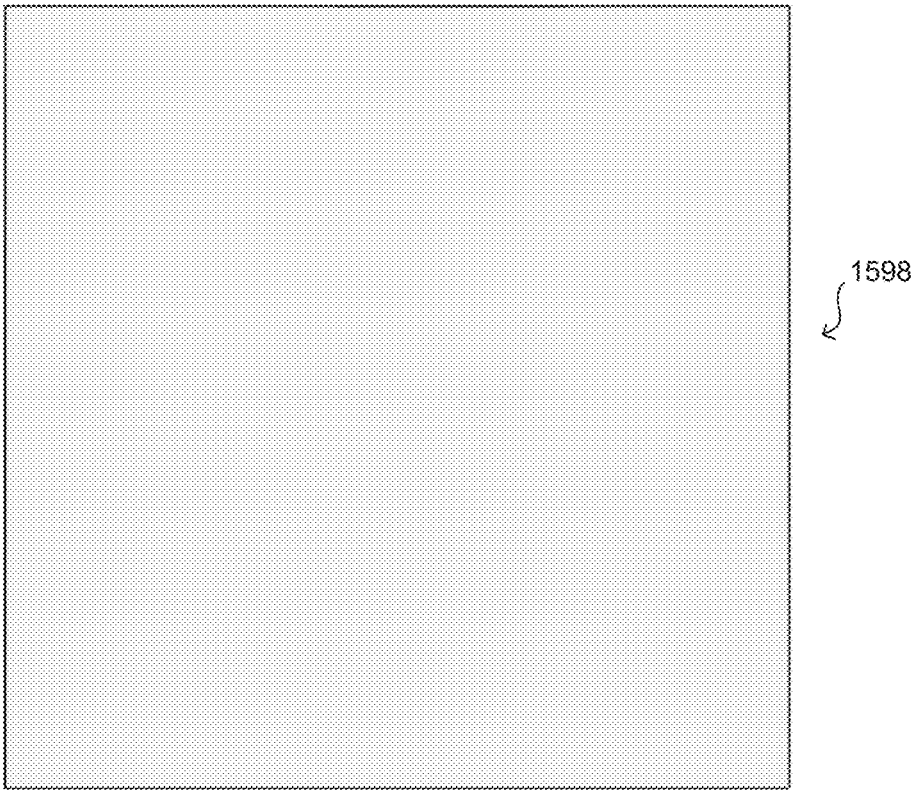
FIG. 15D is a rear view of the first embodiment of the sculptural display panel.
Figure 15E:
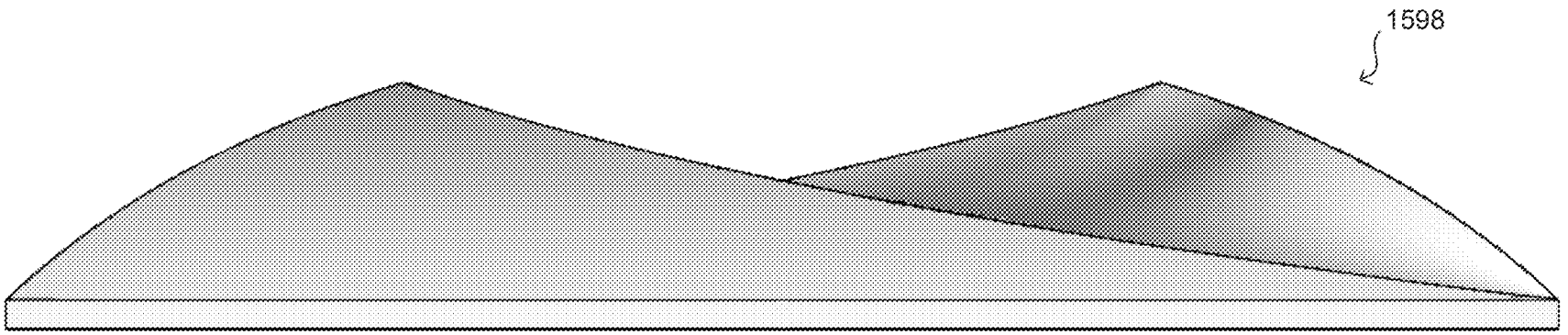
FIG. 15E is a right side view of the first embodiment of the sculptural display panel (the left side view appears identical)
Figure 15F:
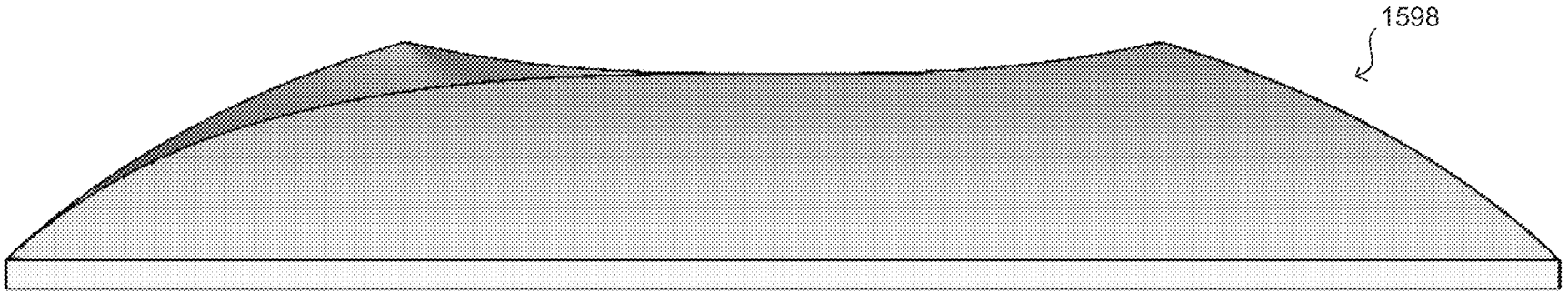
FIG. 15F is a top view of the first embodiment of the sculptural display panel (the bottom view appears identical)
Figure 15G:
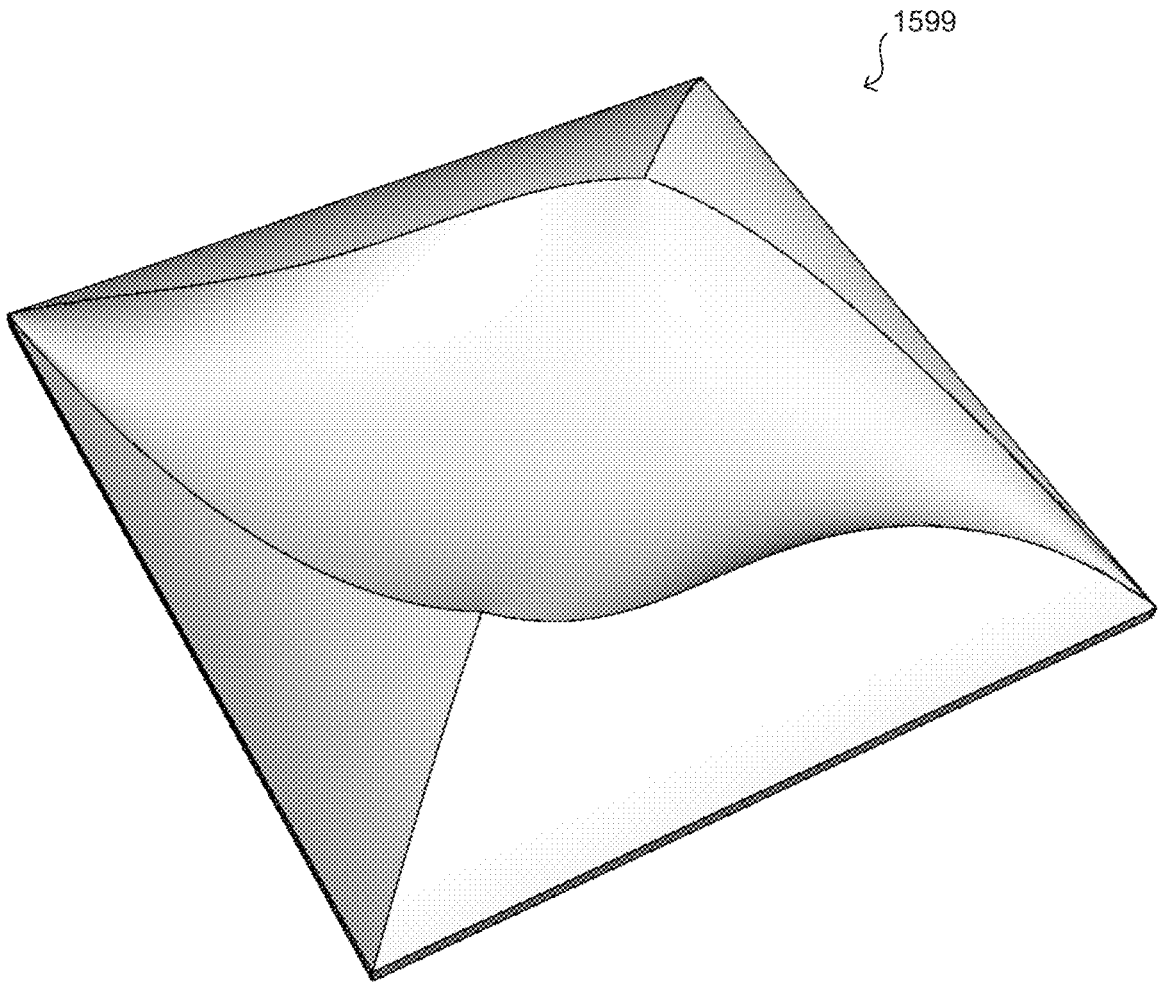
FIG. 15G is a front perspective view of a second embodiment of a sculptural display panel.
Figure 15H:
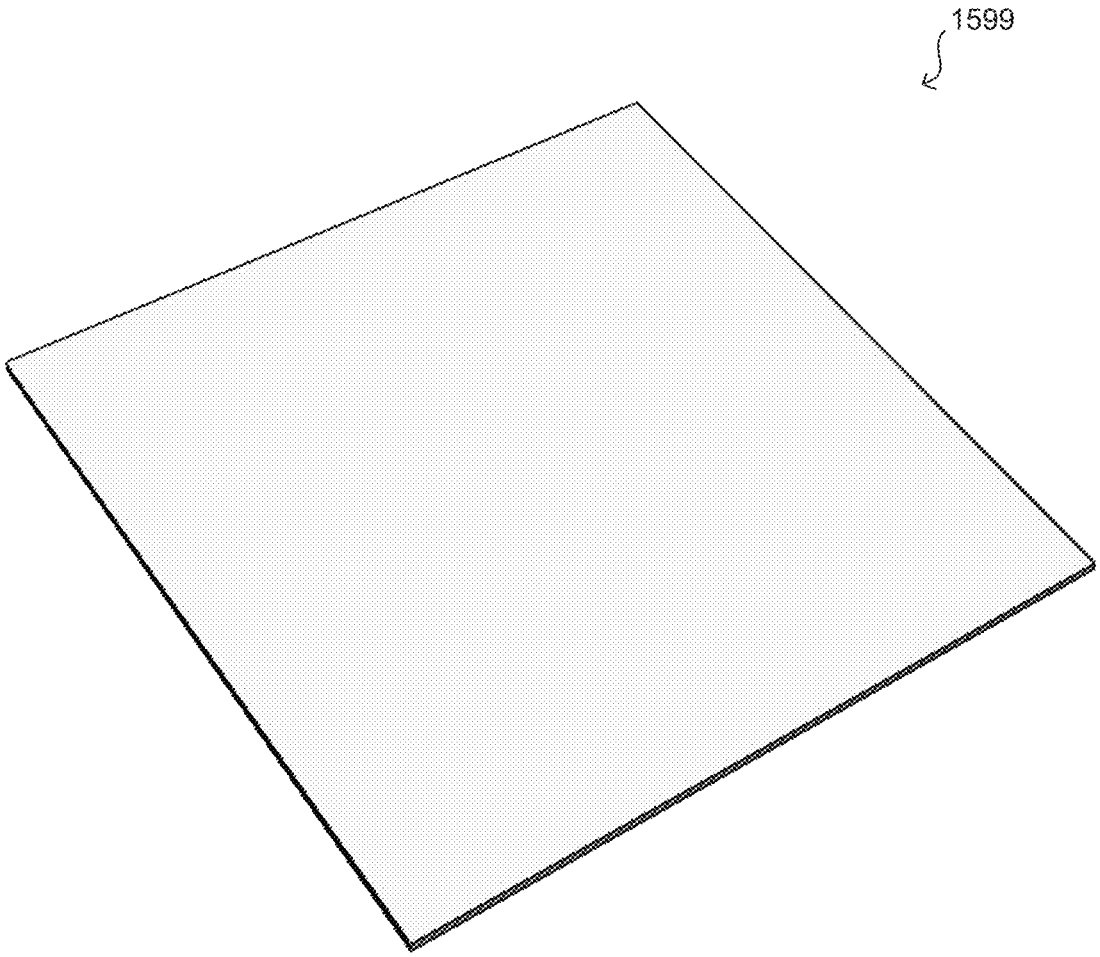
FIG. 15H is a rear perspective view of the second embodiment of the sculptural display panel.
Figure 15I:
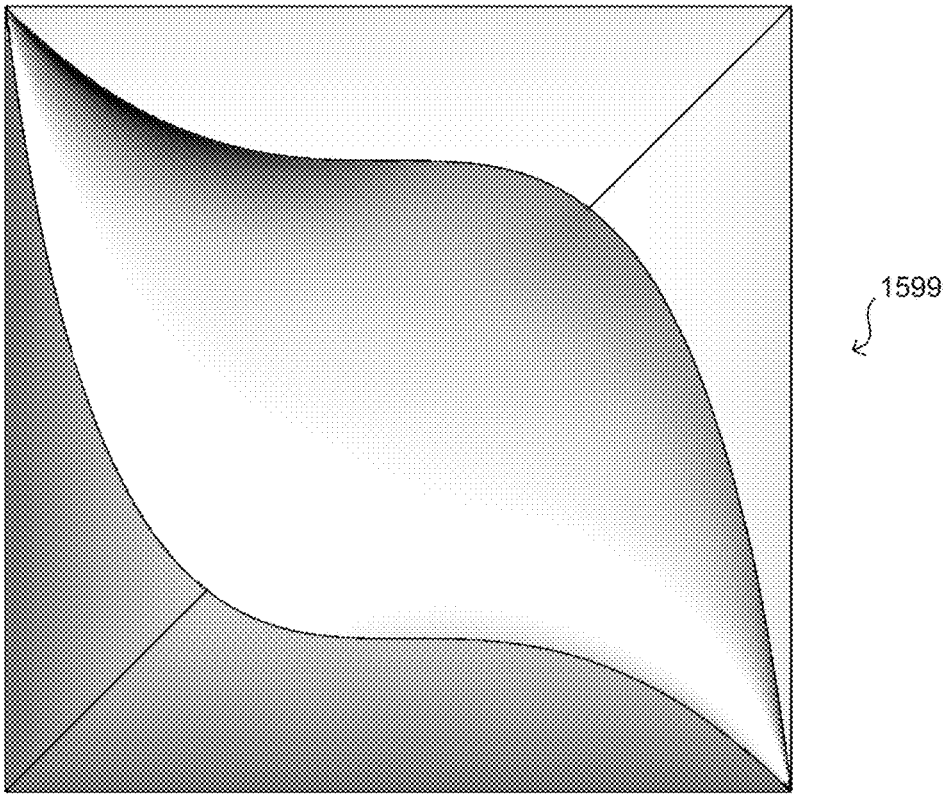
FIG. 15I is a front view of the second embodiment of the sculptural display panel.
Figure 15J:
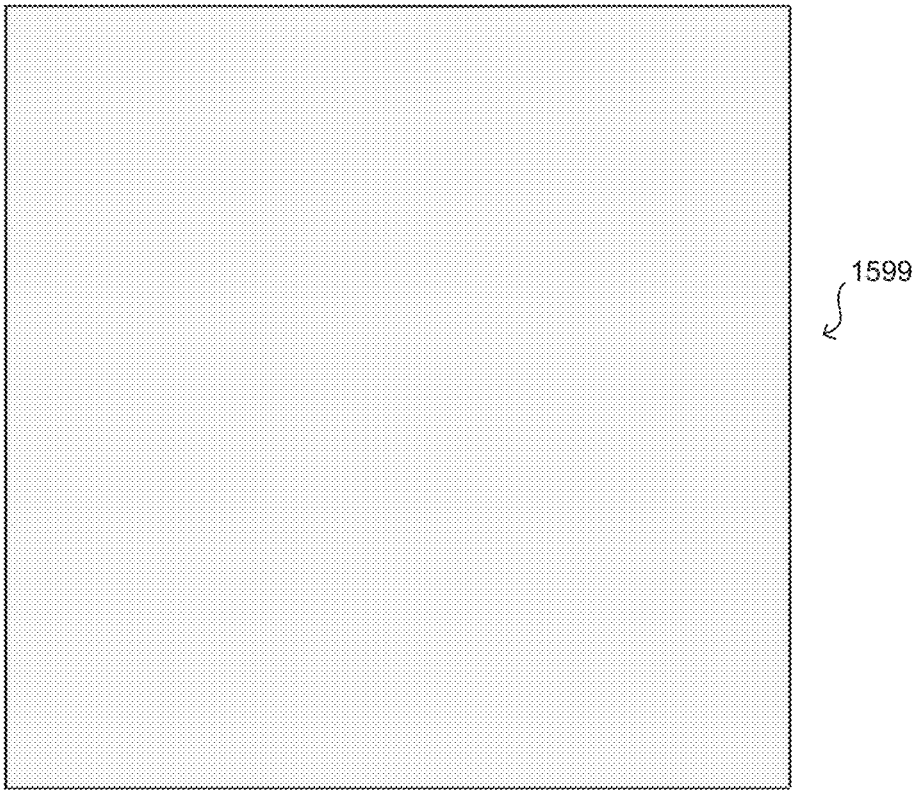
FIG. 15J is a rear view of the second embodiment of the sculptural display panel.
Figure 15K:
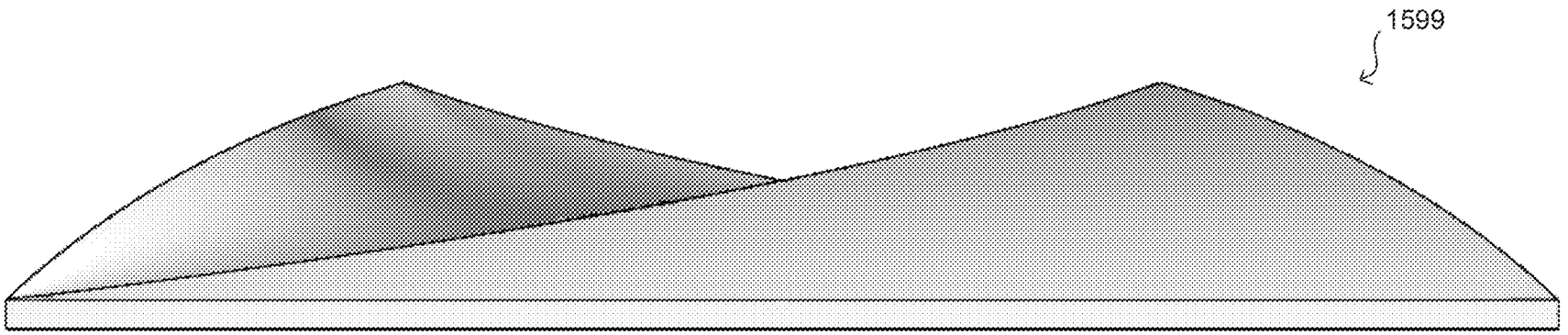
FIG. 15K is a right side view of the second embodiment of the sculptural display panel (the left side view appears identical)
Figure 15L:
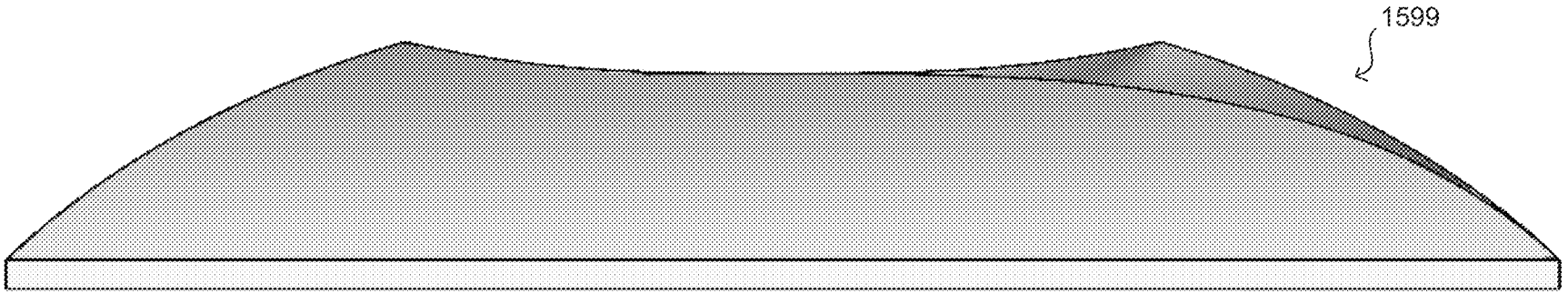
FIG. 15L is a top view of the second embodiment of the sculptural display panel (the bottom view appears identical)
Figure 15M:
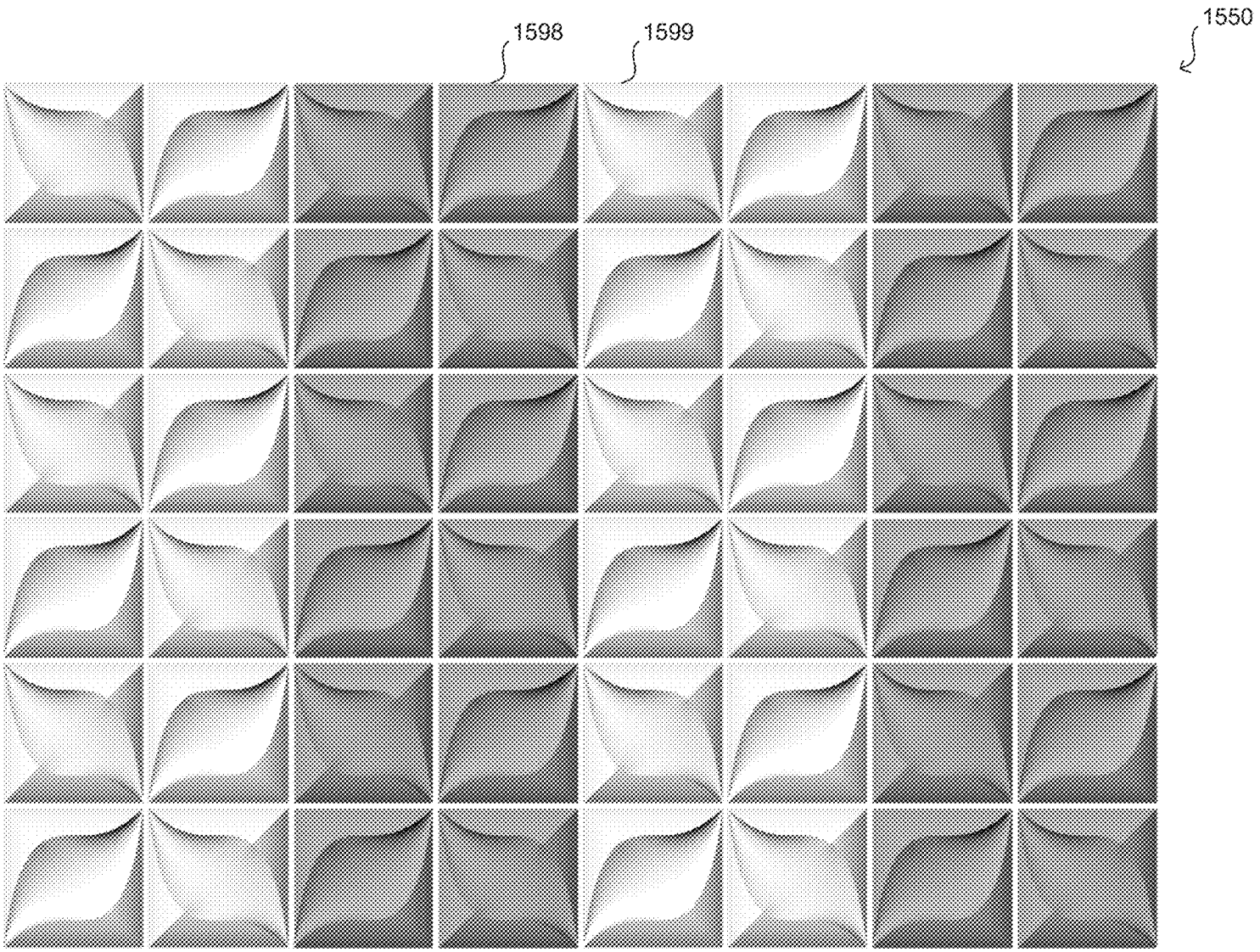
FIG. 15M is a front view of an arrangement of a plurality of the first and second embodiments of the sculptural display panels.

As has been noted, embodiments of segmented display arrays can include a wide variety of display panels, including those of sculptural (i.e., three-dimensional) form, as illustrated in FIG. 9H. This is illustrated further by a first embodiment of a sculptural display panel 1598 (which is similar to the display panel type A 998 shown in FIG. 9H) presented in various views in FIG. 15A through FIG. 15F. Additionally, a second embodiment of a sculptural display panel 1599 (which is similar to the display panel type B 999 shown in FIG. 9H) is presented in various views in FIG. 15G through FIG. 15L. A front view of an arrangement 1550 of a plurality of the first and second embodiments of the sculptural display panels 1598, 1599 is presented in FIG. 15M.

Display Panel Hexagonal Embodiments

Figure 16A:
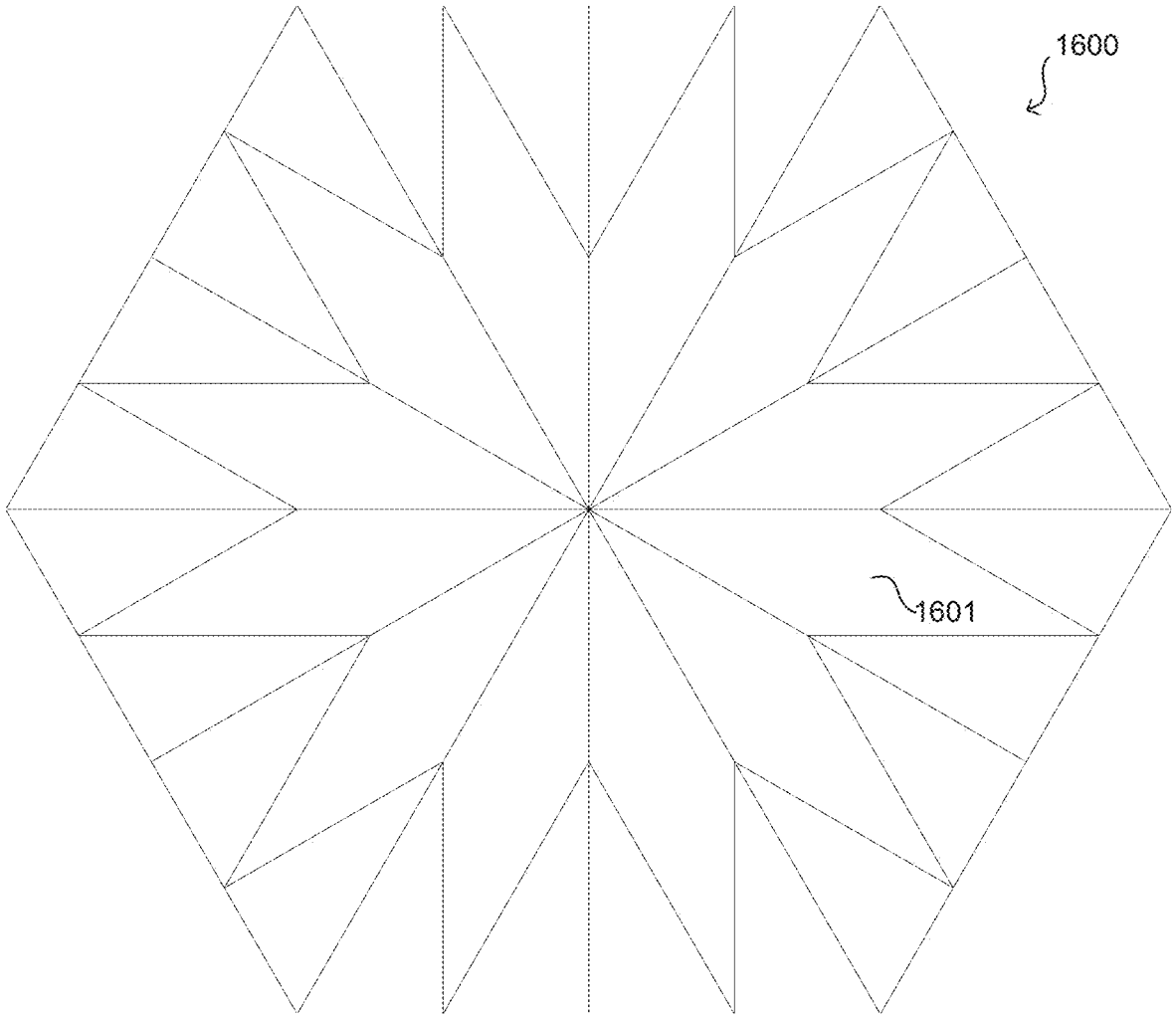
FIG. 16A is a front view of a patterned hexagonal display panel showing patterned zones.
Figure 16B:
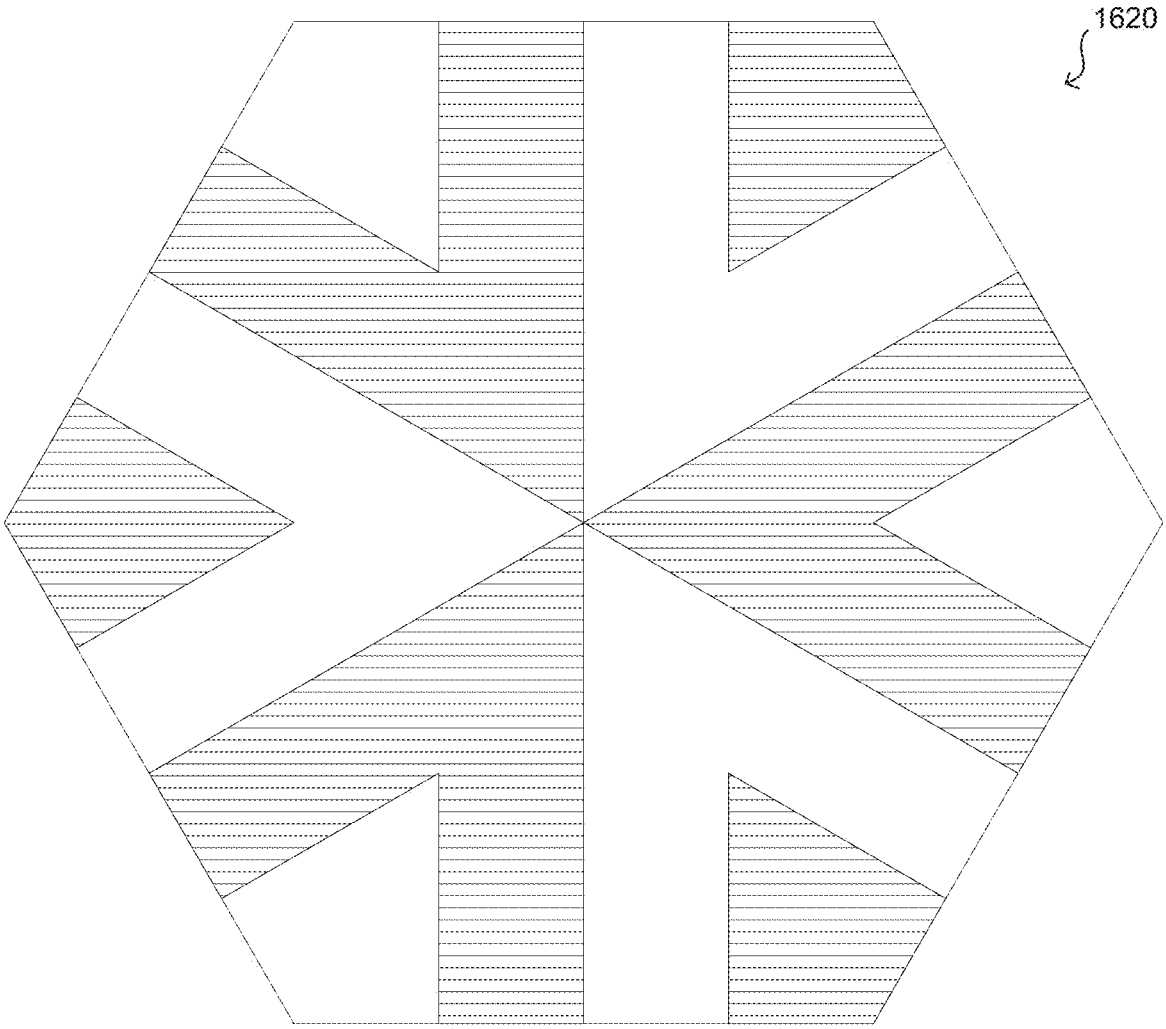
FIG. 16B is a front view of a first embodiment of a patterned hexagonal display panel.
Figure 16C:
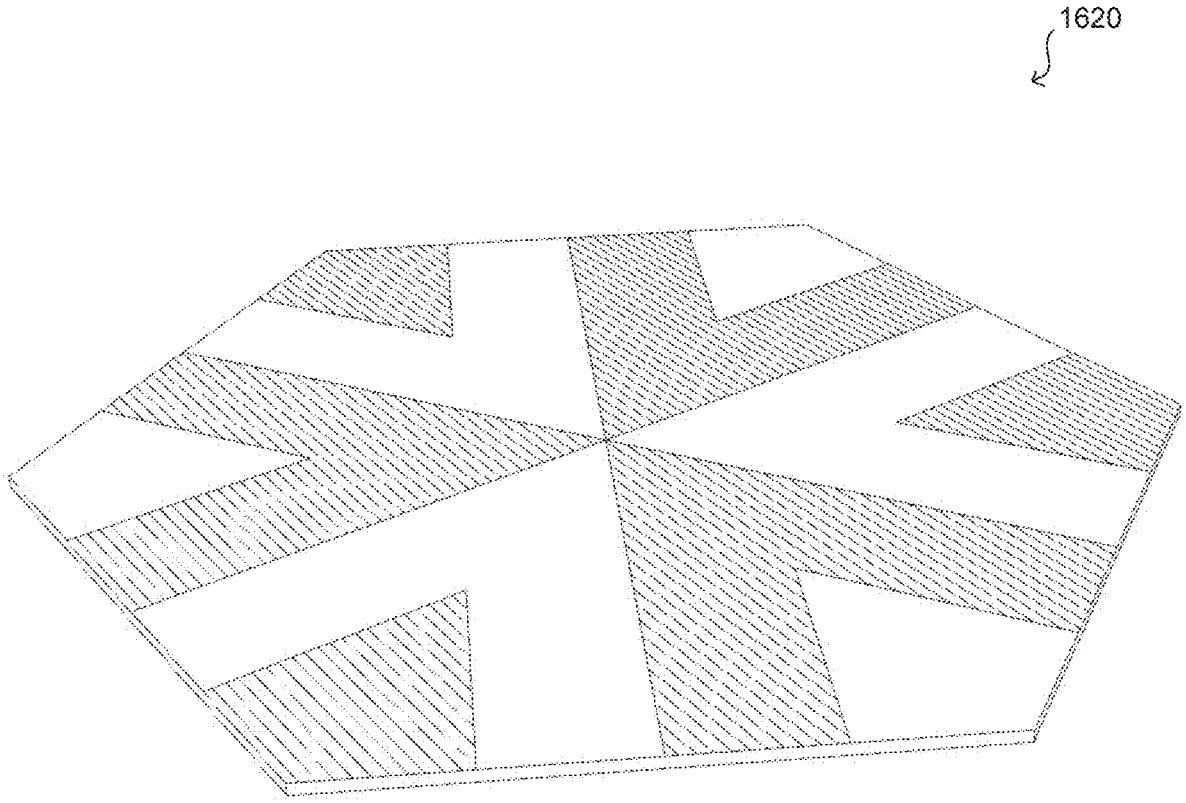
FIG. 16C is a front perspective view of the first embodiment of the patterned hexagonal display panel.
Figure 16D:
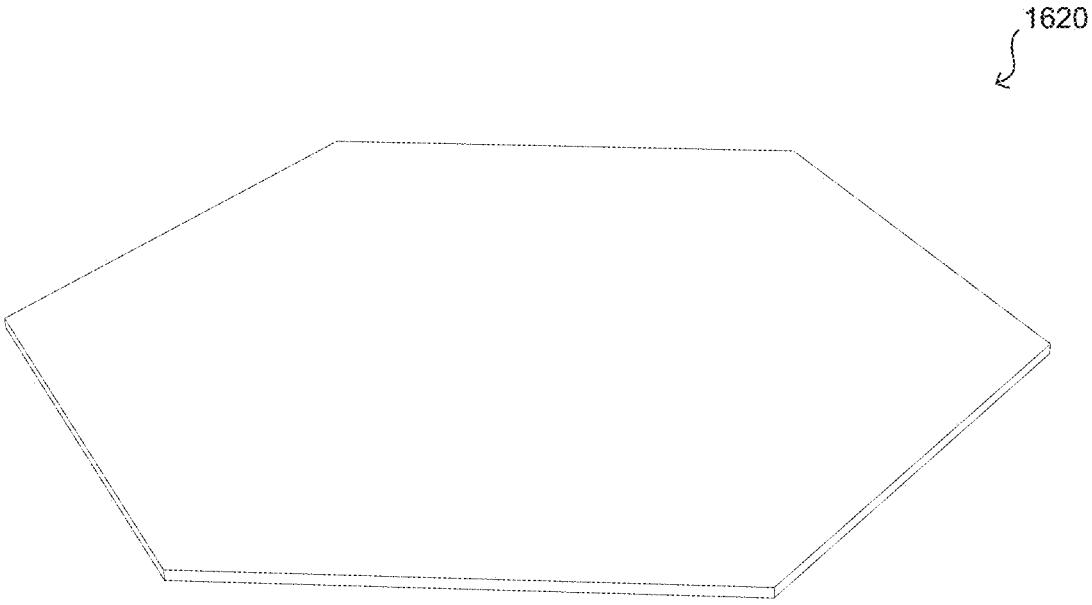
FIG. 16D is a rear perspective view of the first embodiment of the patterned hexagonal display panel.
Figure 16E:
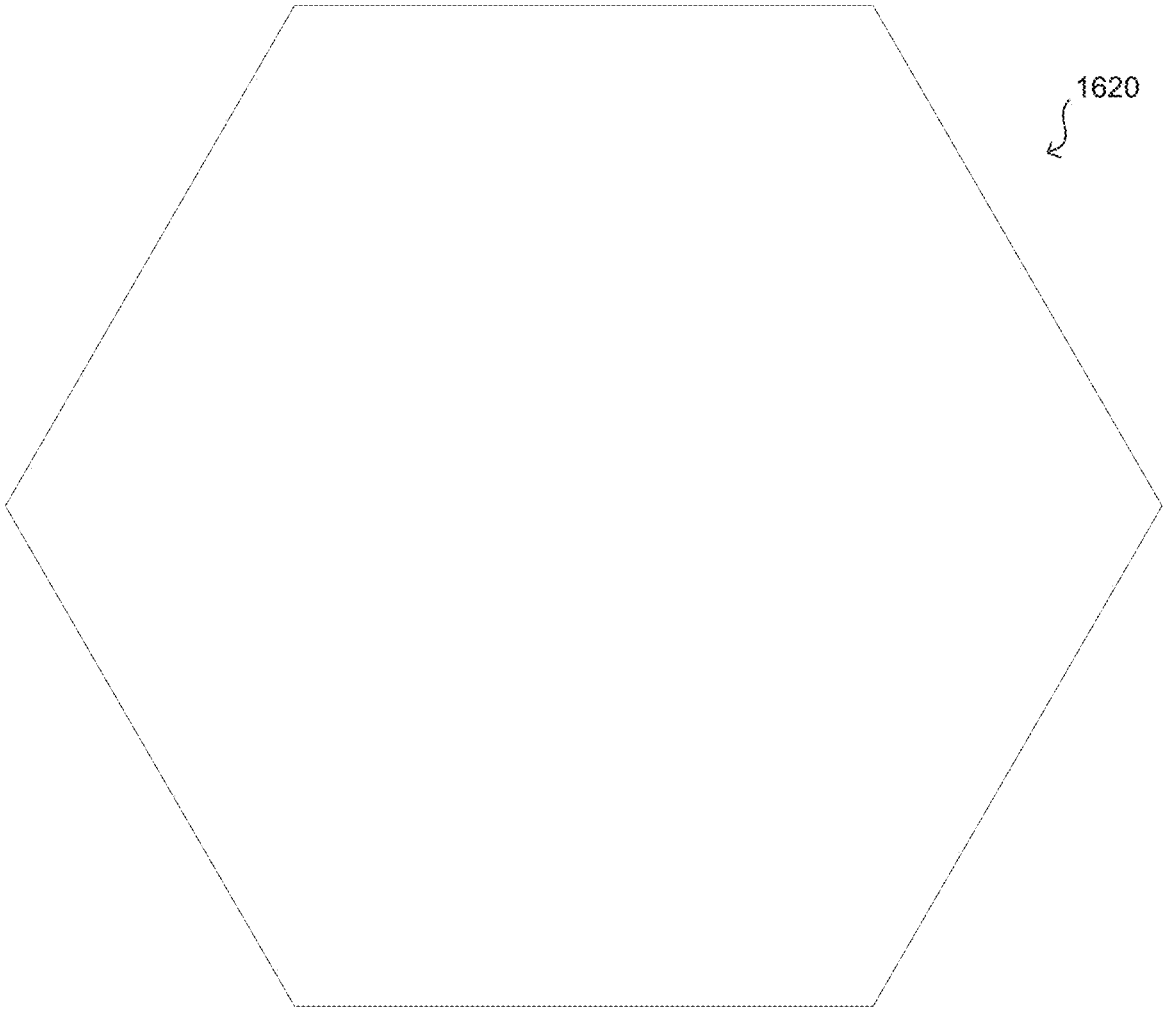
FIG. 16E is a rear view of the first embodiment of the patterned hexagonal display panel.
Figure 16F:
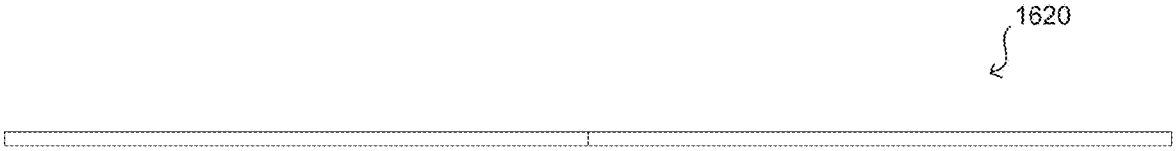
FIG. 16F is a right view of the first embodiment of the patterned hexagonal display panel.
Figure 16G:
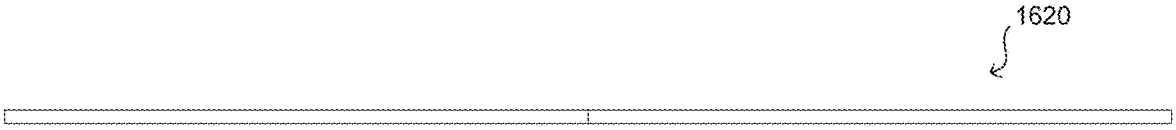
FIG. 16G is a left view of the first embodiment of the patterned hexagonal display panel.
Figure 16H:
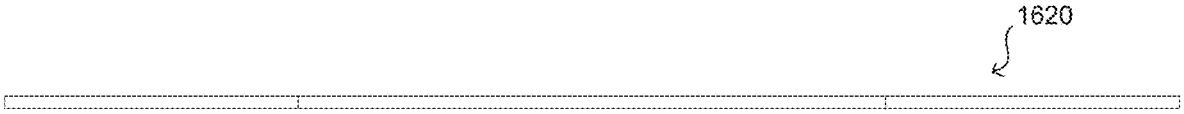
FIG. 16H is a top view of the first embodiment of the patterned hexagonal display panel.
Figure 16I:
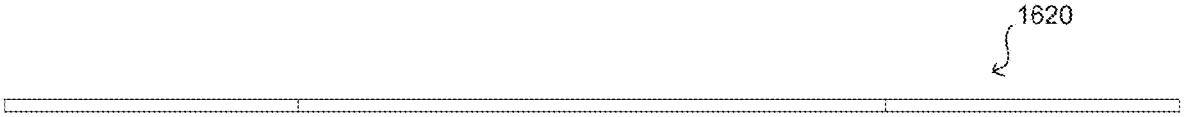
FIG. 16I is a bottom view of the first embodiment of the patterned hexagonal display panel.
Figure 16J:
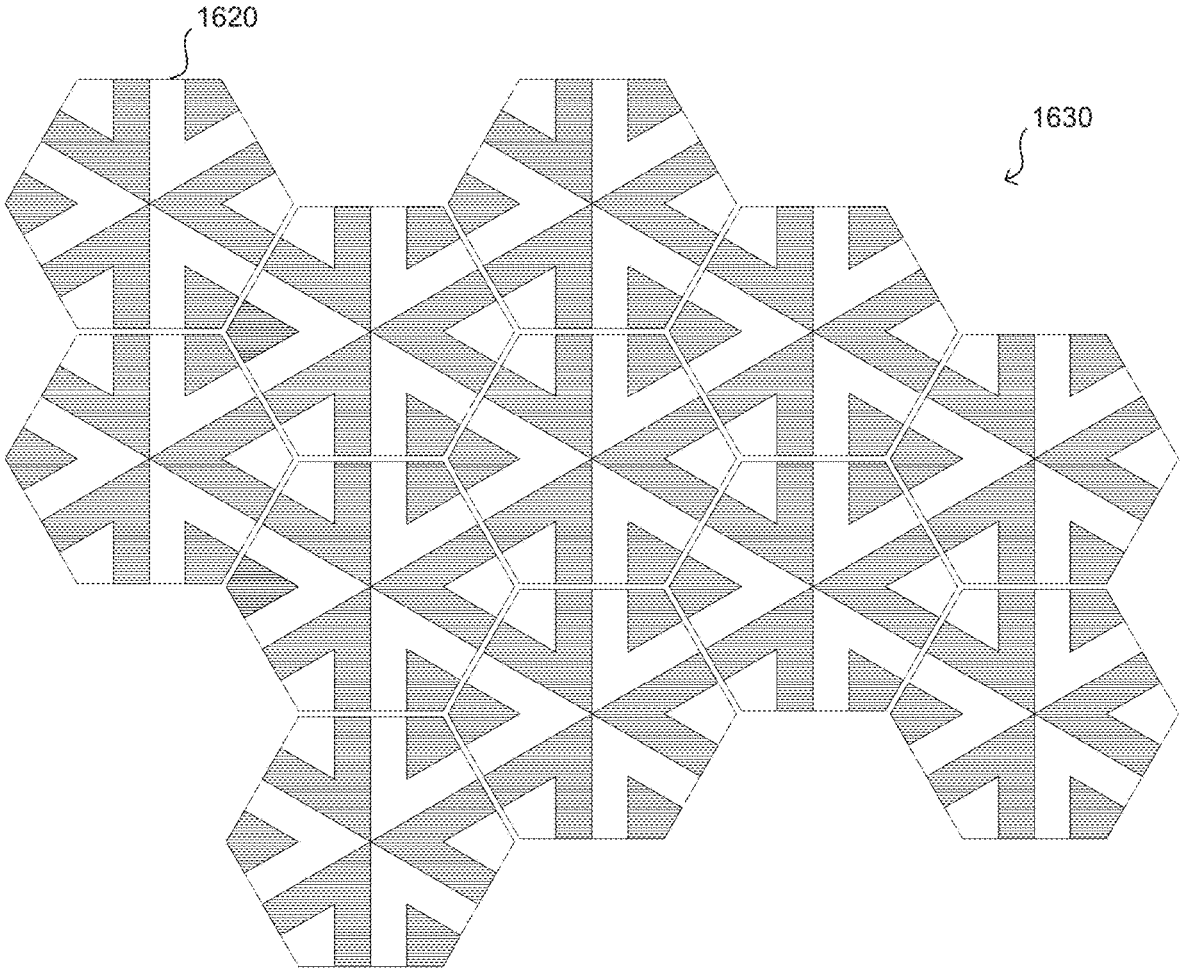
FIG. 16J is a front view of an arrangement of a plurality of the first embodiment of the patterned hexagonal display panel.
Figure 16K:
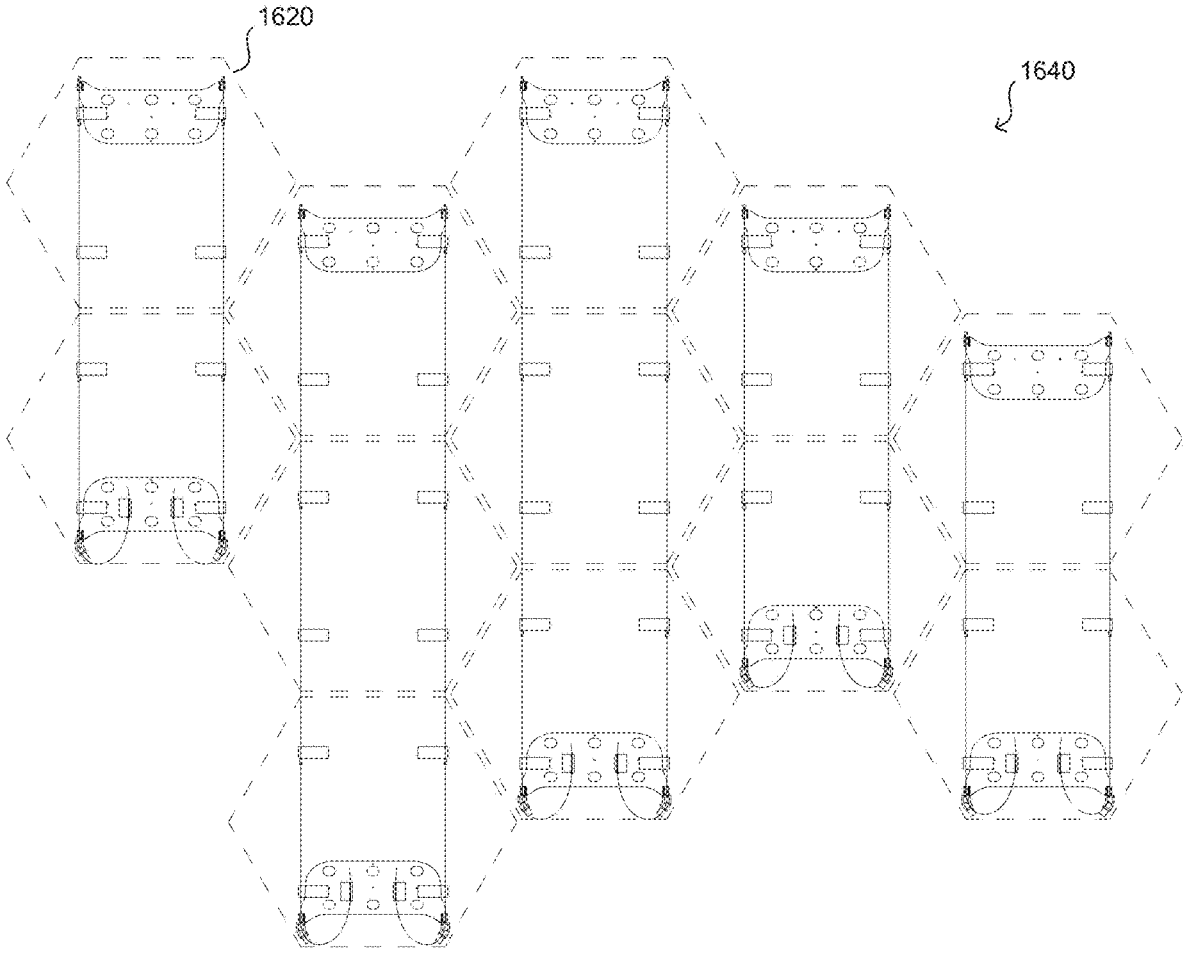
FIG. 16K is a front view of the display panel plurality of FIG. 16J (dashed lines) with wall attachment hardware incorporated.
Figure 16L:
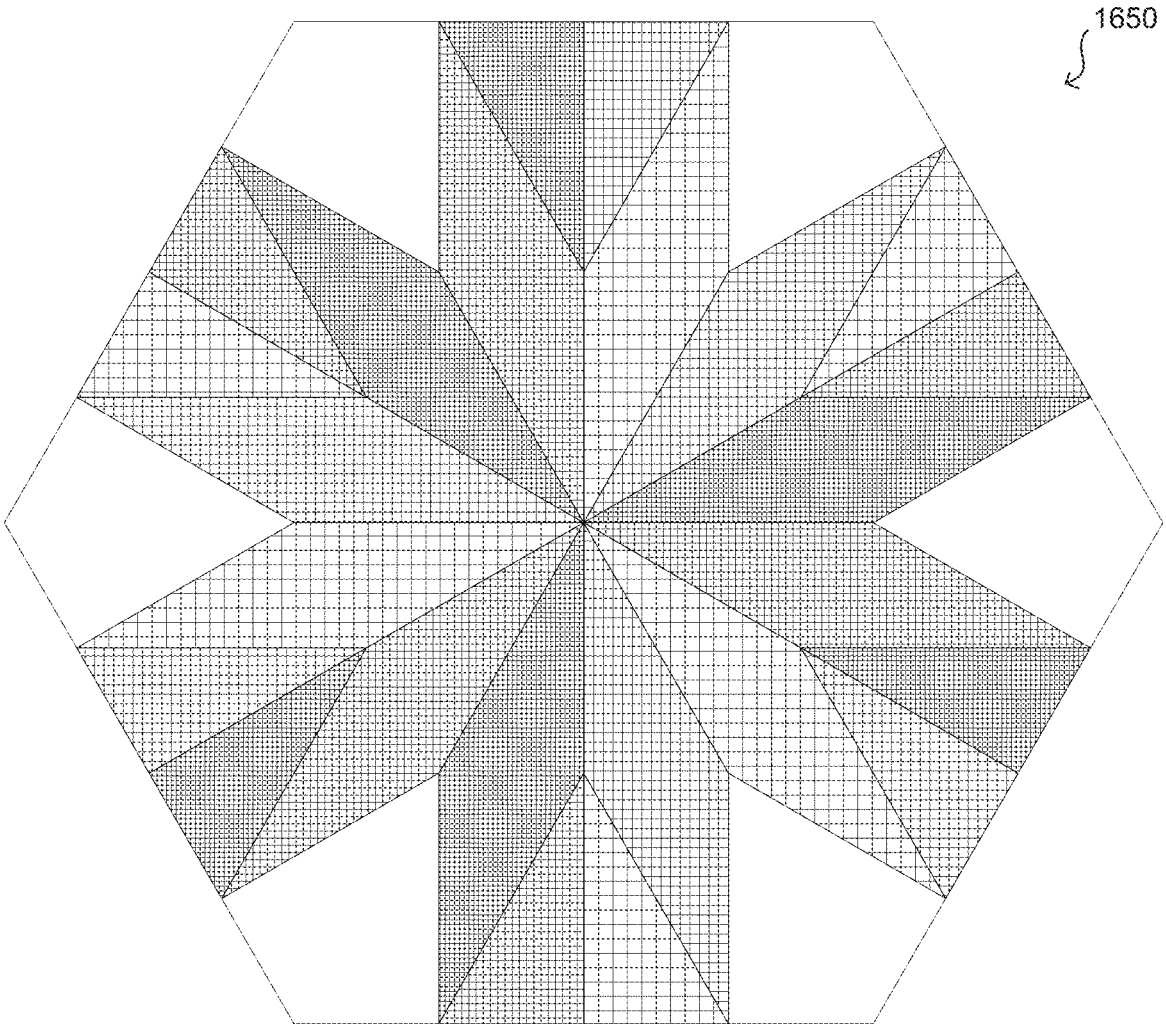
FIG. 16L is a front view of a second embodiment of a patterned hexagonal display panel.
Figure 16M:
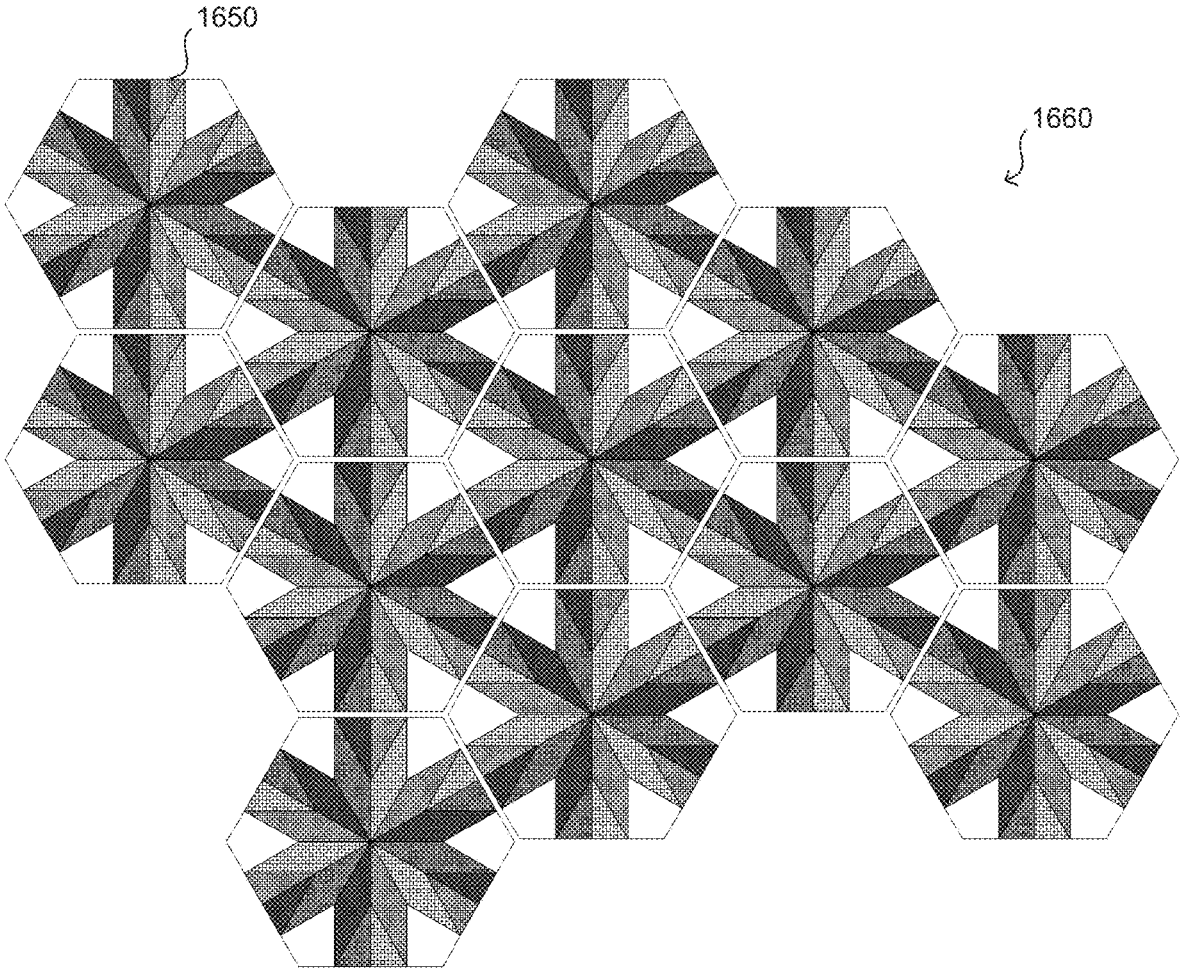
FIG. 16M is a front view of an arrangement of a plurality of the second embodiment of the patterned hexagonal display panel.
Figure 16N:
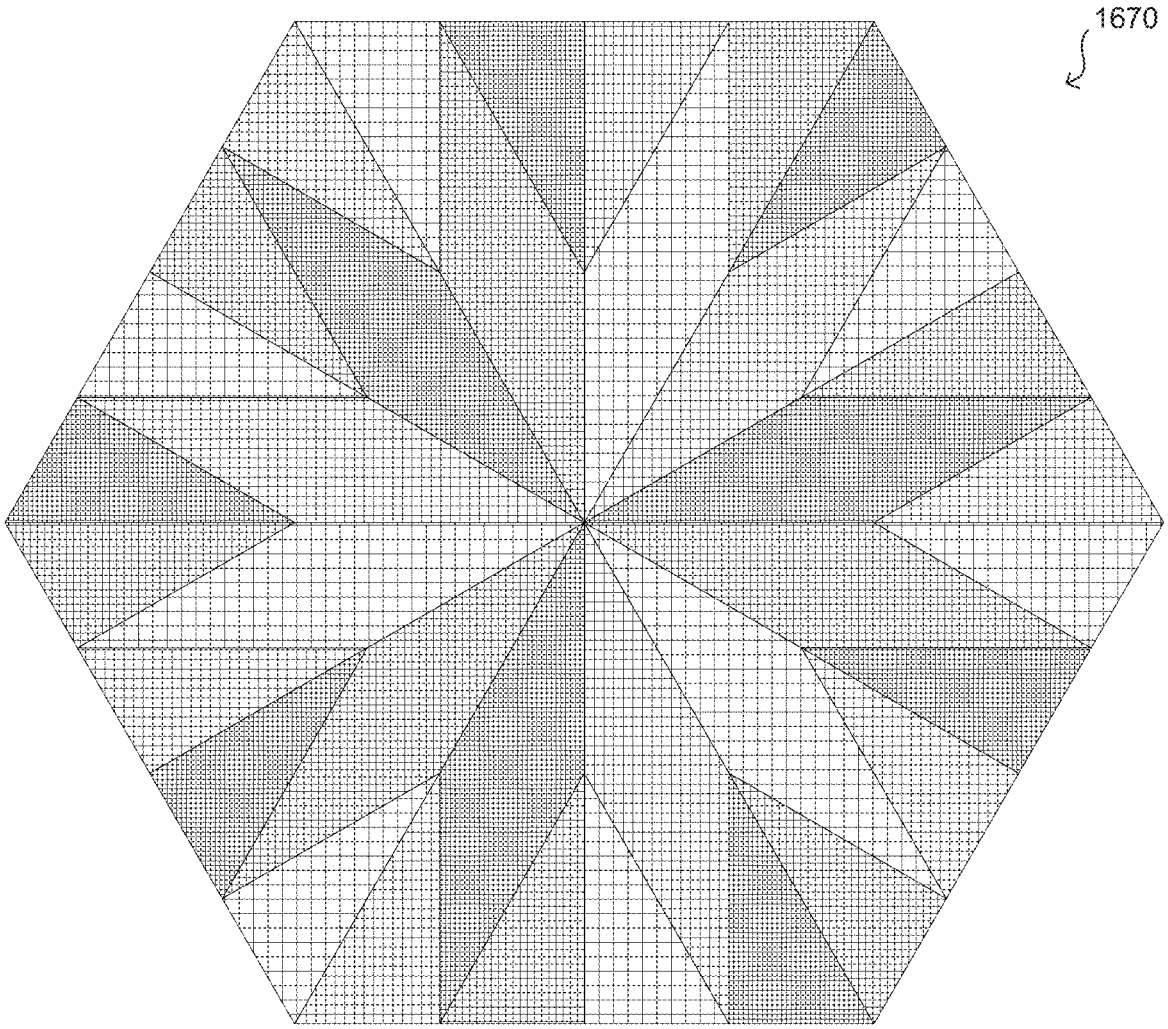
FIG. 16N is a front view of a third embodiment of a patterned hexagonal display panel.
Figure 16O:
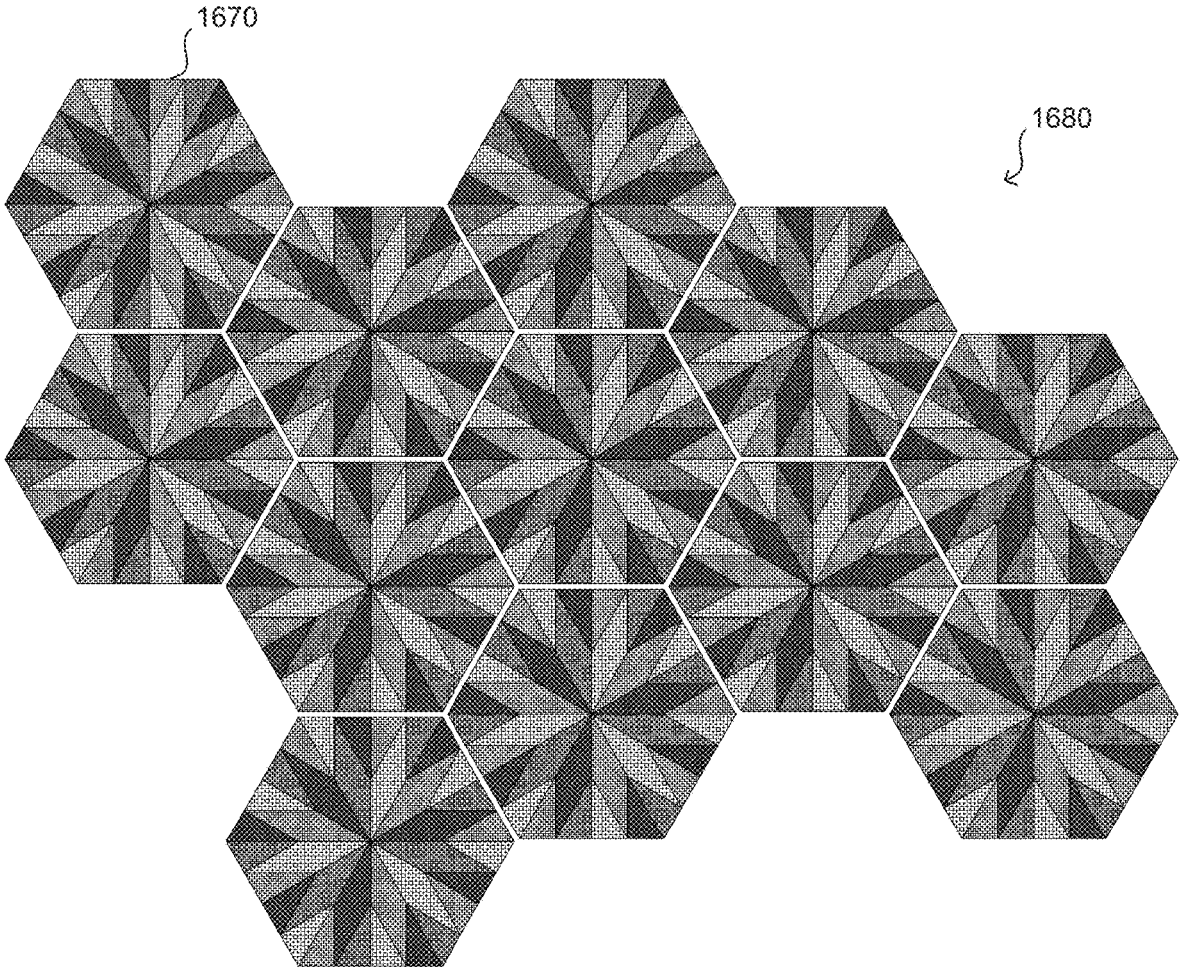
FIG. 16O is a front view of an arrangement of a plurality of the third embodiment of the patterned hexagonal display panel.

As has been noted, embodiment of segmented display arrays can include a wide variety of display panels. As illustrative examples, various patterned hexagonal display panel embodiments are presented in FIG. 16A through FIG. 16O. In particular, FIG. 16A shows a front view of a patterned hexagonal display panel 1600 showing patterned zones 1601 which can be colored or shaded in repetitive configurations to achieve a patterned appearance, as will be shown. FIG. 16B is a front view of a first embodiment of a patterned hexagonal display panel 1620, which is also shown in front perspective view in FIG. 16C, where it is evident that this illustrative embodiment is a thin panel. Subsequent FIGS. 16D-16I show other views (rear perspective, rear, right, left, top, bottom, respectively) for this first embodiment of the patterned hexagonal display panel 1620. By arranging a plurality of the patterned hexagonal display panel 1620, a patterned assemblage of display panels 1630 is achieved, as shown in FIG. 16J. This can be achieved via wall attachment hardware in accordance with embodiments of the present disclosure. Thus, FIG. 16K presents a segmented display array 1640 composed of a plurality of patterned hexagonal display panel 1620, where the panels 1620 are shown in dashed line to make the wall attachment hardware visible for present illustrative purposes. FIG. 16L presents a front view of a second embodiment of a patterned hexagonal display panel 1650, which is also thin and understood to appear the same as the first embodiment display panel 1620 in the alternate views shown in FIGS. 16D-16I. The second embodiment of the patterned hexagonal display panel 1650 is shown in a patterned assemblage of display panels 1660 in FIG. 16M. For further illustration, FIG. 16N presents a front view of a third embodiment of a patterned hexagonal display panel 1670, which is also thin and understood to appear the same as the first embodiment display panel 1620 in the alternate views shown in FIGS. 16D-16I. The third embodiment of a patterned hexagonal display panel 1670 is shown in a patterned assemblage of display panels 1680 in FIG. 16O.

Closing

It is to be understood that the above description is intended to be illustrative, and not restrictive. Many other embodiments will be apparent to those of skill in the art upon reading and understanding the above description. The scope of the disclosure should, therefore, be determined with reference to the appended claims, along with the full scope of equivalents to which such claims are entitled.

What is claimed is:

1. A segmented display array comprising:

a first standoff member mounted to a wall;

a second standoff member mounted to the wall below and separate from the first standoff member;

each of the first and second standoff members having a wall attachment base and a first and second standoff arm, each standoff arm having:

(a) a length greater than the maximum thickness of the corresponding wall attachment base, (b) one end of the arm coupling to the corresponding wall attachment base, and (c) the other end of the arm having a connection point positioned away from the wall at a height differing from the height of the closest point of the corresponding wall attachment base by no more than twice the largest vertical dimension of the wall attachment base;

a first elongated member segment coupled to and spanning between the connection points of the first standoff arms of the first and second standoff members;

a second elongated member segment coupled to and spanning between the connection points of the second standoff arms of the first and second standoff members; and at least two display panels each coupled to the first and second elongated member segments.

2. The segmented display array of claim 1 in which each standoff arm has an upper portion and a lower portion, with the upper portion being positioned directly above the corresponding lower portion.

3. The segmented display array of claim 1 in which each of the standoff arms extends at an obtuse angle from the wall behind the wall attachment base to which the standoff arm is attached.

4. The segmented display array of claim 1 additionally comprising releasable retention members affixed to the display panels whereby the display panels can be released from their coupling to the elongated member segments.

5. The segmented display array of claim 4 in which the retention members are elastically releasable from the elongated member segments.

6. The segmented display array of claim 5 in which the retention members, unless released, retain the elongated member segments while allowing limited sliding along the elongated member segments, and additionally comprising sleeves affixed to the elongated member segments to limit the sliding of the retention members.

7. The segmented display array of claim 4 in which permanent magnets releasably couple the display panels and elongated member segments.

8. The segmented display array of claim 1 in which at least a portion of each of the first and second standoff arms is planar.

9. The segmented display array of claim 1 in which each of the connection points associated with the first standoff arms is adjacent to a slot in its associated standoff arm, and whereby the first elongated member segment is coupled to the first standoff arms using the associated slots.

10. The segmented display array of claim 9 further comprising:

a capture band through which the first elongated member segment passes and which couples to one of said slots to couple the first elongated member segment to this slot via the capture band.

11. The segmented display array of claim 1 in which at least one said wall attachment base includes slots for attachment of the base to the wall.

12. The segmented display of claim 11 in which the slots are configured with their long dimension horizontal.

13. The segmented display array of claim 2 further comprising:

a tensioning assembly that secures the first elongated member segment to one of the first standoff arms and induces tension in the first elongated member segment.

14. The segmented display array of claim 1 in which each standoff arm is wider where it couples to its respective wall attachment base and tapers to become narrower at its other end.

15. The segmented display array of claim 1 in which each wall attachment base and its two associated arms are made of a single, unitary piece of material for the three parts.

16. The segmented display array of claim 15 in which the unitary piece of material is transparent.

17. The segmented display array of claim 1 in which at least one standoff member comprises a multilayered sheet material, in which one layer of the multilayered sheet material comprises a flexible polymer, and a second layer comprises a metal.

18. A segmented display array comprising:

a first standoff member mounted to a wall;

a second standoff member mounted to the wall below and separate from the first standoff member;

each of the first and second standoff members having a wall attachment base and horizontally separated first and second standoff arms, each standoff arm having:

(a) a length greater than the maximum thickness of the corresponding wall attachment base, (b) one end of the arm coupling to the corresponding wall attachment base, and (c) the other end of the arm having horizontally separated first and second connection points each positioned away from the wall;

a first elongated member segment coupled between the first connection points of the first standoff arms of the first and second standoff members;

a second elongated member segment coupled between the second connection points of the first standoff arms of the first and second standoff members;

at least two display panels each coupled to the first and second elongated member segments;

a third elongated member segment coupled between the first connection points of the second standoff arms of the first and second standoff members;

a fourth elongated member segment coupled between the second connection points of the second standoff arms of the first and second standoff members; and at least two additional display panels each coupled to the third and fourth elongated member segments and being horizontally separated from the other two display panels.

19. The segmented display array of claim 18 in which at least a portion of one of said elongated member segments is at least as far away from the wall as any portion of at least one of its associated arms.

20. The segmented display array of claim 18 in which at least one standoff member comprises a multilayered sheet material, in which one layer of the multilayered sheet material comprises a flexible polymer, and a second layer comprises a metal.

21. The segmented display array of claim 18 in which each wall attachment base and its two associated arms are made of a single, unitary piece of material.

22. The segmented display array of claim 1 where each of said first and second standoff members have third and fourth standoff arms, each third and fourth standoff arm having:

(a) a length greater than the maximum thickness of the corresponding wall attachment base, (b) one end of the arm coupling to the corresponding wall attachment base, and (c) the other end of the arm having a connection point positioned away from the wall at a height differing from the height of the closest point of the corresponding wall attachment base by no more than twice the largest vertical dimension of the wall attachment base;

a third elongated member segment coupled between the connection points of the third standoff arms of the first and second standoff members;

a fourth elongated member segment coupled between the connection points of the fourth standoff arms of the first and second standoff members; and at least two additional display panels each coupled to the third and fourth elongated member segments.

23. A segmented display array comprising:

A first and second standoff member each having a planar base and two planar arms extending angularly therefrom;

each of said two planar arms incorporating a connection point near its end, positioned so that the connection points for the two arms of the standoff member are further apart from one another than the longest dimension of its associated said planar base;

a first elongated member segment coupled to and spanning between the connection points of one arm of each of said first and second standoff members;

a second elongated member segment coupled to and spanning between the connection points of the other arm of each of said first and second standoff members; and at least two display panels each coupled to the first and second elongated member segments.

24. The segmented display array of claim 23 which additionally comprises a third and fourth standoff member each having a planar base and two planar arms extending angularly therefrom;

each of said two planar arms of said third and fourth standoff member incorporating a connection point near its end, positioned so that the connection points for the two arms of the standoff member are further apart from one another than the longest dimension of its associated said planar base;

a third elongated member segment coupled between the connection points of one arm of each of said third and fourth standoff members;

a fourth elongated member segment coupled between the connection points of the other arm of each of said third and fourth standoff members; and at least two more display panels each coupled to the third and fourth elongated member segments.

25. The segmented display array of claim 23 additionally comprising releasable retention members affixed to the display panels whereby the display panels can be released from their coupling to the elongated member segments.

26. The segmented display array of claim 25 in which the retention members are elastically releasable from the elongated member segments and, unless released, retain the elongated member segments while allowing limited sliding along the elongated member segments, and additionally comprising sleeves affixed to the elongated member segments to limit the sliding of the retention members.

27. A segmented display array comprising:

a first standoff member mounted to a wall, the first standoff member comprising a wall attachment base and first and second generally planar standoff arms extending from the wall attachment base in directions non-parallel with the wall;

a second standoff member mounted to the wall;

a first elongated member segment coupled to and spanning between each of the first and second standoff members;

a second elongated member segment coupled to and spanning between each of the first and second standoff members; and at least two display panels each coupled to the first and second elongated member segments, wherein:

the first elongated member segment is coupled to and substantially parallel with the first generally planar standoff arm, the second elongated member segment is coupled to and substantially parallel with the second generally planar standoff arm.

28. The segmented display array of claim 27, wherein the first elongated member segment is coupled at or near a distal edge of the first generally planar standoff arm, and the second elongated member segment is coupled at or near a distal edge of the second generally planar standoff arm.

29. The segmented display array of claim 28, wherein each generally planar standoff arm comprises a multilayered sheet material, in which one layer comprises a flexible polymer, and a second layer comprises a metal.

* * * * *